US008192239B2

(12) United States Patent
Ito et al.

(10) Patent No.: US 8,192,239 B2
(45) Date of Patent: Jun. 5, 2012

(54) MARINE VESSEL PROPULSION SYSTEM AND MARINE VESSEL

(75) Inventors: Makoto Ito, Shizuoka (JP); Takaaki Bamba, Shizuoka (JP); Noriyoshi Ichikawa, Shizuoka (JP); Yuki Ikegaya, Shizuoka (JP); Shu Akuzawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 268 days.

(21) Appl. No.: 12/749,635

(22) Filed: Mar. 30, 2010

(65) Prior Publication Data

US 2010/0248560 A1 Sep. 30, 2010

(30) Foreign Application Priority Data

Mar. 31, 2009 (JP) ..... 2009-87084
Apr. 2, 2009 (JP) ..... 2009-90386
Mar. 23, 2010 (JP) ..... 2010-66645

(51) Int. Cl.
*B63H 21/21* (2006.01)

(52) U.S. Cl. ..... 440/1; 440/84

(58) Field of Classification Search ..... 440/1, 84, 440/85; 701/21; 123/396, 399
See application file for complete search history.

(56) References Cited

U.S. PATENT DOCUMENTS 5,144,300 A * 9/1992 Kanno ..... 440/85
2004/0121666 A1 6/2004 Okuyama
2008/0119096 A1 5/2008 Ito et al.

* cited by examiner

*Primary Examiner* — Lars A Olson
(74) *Attorney, Agent, or Firm* — Keating & Bennett, LLP

(57) ABSTRACT

A marine vessel propulsion system includes a plurality of propulsion devices, each including a motor and a propeller rotated by the motor. The system further includes a common electric power supply switch arranged to be operated by an operator to turn on and off electric power supplies of the plurality of propulsion devices all at once, an electric power supply control unit arranged to put the electric power supplies of the respective propulsion devices in an on state all at once when the common electric power supply switch is turned on and to put the electric power supplies of the respective propulsion devices in an off state all at once when the common electric power supply switch is turned off, an abnormal state detection unit arranged to detect an abnormal state of each propulsion device, and a power transmission cutoff unit, which is arranged to, when an abnormal state of any of the propulsion devices is detected by the abnormal state detection unit, cut off transmission of power between the motor and the propeller of the propulsion device for which the abnormal state is detected.

29 Claims, 24 Drawing Sheets

BASIC MODE

FIRST MODIFIED MODE

SECOND MODIFIED MODE 2
3P
3C
3S
71P
71S
F
N
R 2
3C
3S
3P
FAULT 2
3C
3S
3P
ENGINE STOPPING OPERATION 2
3C
3S
3P
ENTRAINED ROTATION IS DETECTED 2
3C
3S
3P
FORCED SHIFT CONTROL TO NEUTRAL POSITION 2
3S
3P
FAULT 2
3S
3P
ENGINE STOPPING OPERATION 2
3S
3P
ENTRAINED ROTATION IS DETECTED 2
3S
3P
FORCED SHIFT CONTROL TO NEUTRAL POSITION 2
3S
3C
3P
FAULT 2
3S
3C
3P
MOTOR STOPPING OPERATION 2
3S
3C
3P
MOTOR IS STARTED DUE TO ENTRAINED ROTATION 2
3S
3C
3P
BREAKAGE OF MOTOR

MARINE VESSEL PROPULSION SYSTEM AND MARINE VESSEL

BACKGROUND OF THE INVENTION

1. Field of the Invention

The present invention relates to a marine vessel propulsion system and a marine vessel that includes a plurality of propulsion devices.

2. Description of the Related Art

An exemplary propulsion device for a marine vessel is an outboard motor. The outboard motor is, for example, attached to a stern of a hull. The outboard motor is an apparatus that obtains a propulsive force by rotation of a propeller by a power of a motor, such as an engine. A plurality of outboard motors may be attached to the hull in accordance with the required propulsive force. The outboard motor includes an outboard motor ECU (electronic control unit) for motor output control, etc.

A steering operation apparatus, a remote controller for adjusting the output of the outboard motor, and a gauge (meter) for displaying a state of the outboard motor are disposed at a marine vessel maneuvering compartment of the marine vessel. The steering operation apparatus includes, for example, a steering wheel. Operation of the steering wheel is transmitted by a cable to the outboard motor to enable the direction of the outboard motor to be changed.

The remote controller has a lever for shift position selection and motor output adjustment of the outboard motor. A position of the lever is detected by a position sensor. Information on the lever position detected by the position sensor is transmitted to the outboard motor. The shift positions are a forward drive position, a neutral position, and a reverse drive position. When the forward drive position is selected, a propeller rotation direction is set to the rotation direction that provides the propulsive force in the forward drive direction to the marine vessel. When the reverse drive position is selected, the propeller rotation direction is set to the rotation direction that provides the propulsive force in the reverse drive direction to the marine vessel. At the neutral position, the output of the motor is not transmitted to the propeller.

In a marine vessel that includes a plurality of outboard motors, a remote controller is provided individually for each outboard motor. However, a system has also been developed by which shift control (shift position selection and engine output adjustment) of all outboard motors in a marine vessel including a plurality of outboard motors is performed by fewer remote controllers than the number of outboard motors. For example, a system by which shift control of three outboard motors is performed by two remote controllers is disclosed in United States Patent Application Publication No. 2008/0119096 A1.

Specifically, one of the remote controllers is associated with an outboard motor at a starboard-side, the other remote controller is associated with an outboard motor at a port-side, and both remote controllers are associated with an outboard motor at a center to execute outboard motor control in accordance with operations of the remote controllers. Specifically, when the lever positions of both remote controllers are at the forward drive positions, the shift position of the central outboard motor is controlled to be at the forward drive position. When the lever positions of both remote controllers are at the reverse drive positions, the shift position of the central outboard motor is controlled to be at the reverse drive position. In a case where the combination of the lever positions of the two remote controllers is a combination other than the above, the shift position of the central outboard motor is controlled to be at the neutral position.

The gauge includes a display unit and is arranged to display an operation state of the outboard motor, the motor output (rotational speed), etc. When a plurality of outboard motors are included, a plurality of gauges are included accordingly and displays corresponding to the respective outboard motors are performed.

One battery is included for each outboard motor. In a case where an engine (internal combustion engine) is included as the motor, electric power is supplied from this battery to a starter for starting the engine and to the outboard motor ECU. The marine vessel maneuvering compartment includes an electric power supply switch arranged to switch between supplying and cutting off the electric power supply from the battery to the outboard motor. When a plurality of outboard motors are included, a plurality of electric power supply switches are included accordingly. The electric power supply switch is, for example, a key switch with which a main key is inserted and rotated, and serves in common as a start switch for starting the engine. More specifically, when a user operates the key switch from an off position to an on position, electric power is supplied from the battery to the outboard motor. When the key switch is operated further from the on position to the start position, the starter is actuated and a cranking operation is performed.

In a case where a plurality of outboard motors are included, electric power supply switches of a number corresponding to the number of outboard motors are present, and a user must carry around a plurality of main keys of a number corresponding to the number of outboard motors, which is troublesome. Provision of a single, common electric power supply switch in place of individual electric power supply switches for a plurality of outboard motors is thus proposed in United States Patent Application Publication No. 2004/0121666 A1. In such a case where a common electric power supply switch is provided, the main key can be consolidated to a single key and carrying of the main key is facilitated.

SUMMARY OF THE INVENTION

The inventors of preferred embodiments of the present invention described and claimed in the present application conducted an extensive study and research regarding a marine vessel propulsion system, such as the one described above, and in doing so, discovered and first recognized new unique challenges and previously unrecognized possibilities for improvements as described in greater detail below.

In the case where the single, common electric power supply switch is provided in place of individual electric power supply switches for the plurality of propulsion devices (for example, outboard motors), the carrying of the main key switch is facilitated as mentioned above. However, a problem may occur in a marine vessel adopting a system with which shift control of the plurality of propulsion devices installed on the hull is performed by fewer remote controllers than a total number of the propulsion devices.

This point shall now be described with reference to FIGS. 24A-24D. A marine vessel shown in FIGS. 24A-24D includes three propulsion devices (outboard motors) 3P, 3C, and 3S. Here, it shall be assumed that, in this marine vessel, shift control of the three propulsion devices is performed by commands from two remote controllers. A case where a fault occurs in a motor (for example, engine) of the single propulsion device 3C at the center during travel by the three propulsion devices as shown in FIG. 24A shall now be assumed. In this case, a user (operator) performs an operation of stopping the motor of faulty central propulsion device 3C by a start/stop switch corresponding to the central propulsion device 3C as shown in FIG. 24B. Here, an individual electric power supply switch is not provided, and thus the electric power supply of just the faulty central propulsion device 3C cannot be turned off. That is, although the motor of the propulsion device 3C can be stopped, the electric power supply of the propulsion device 3C remains on.

The electric power supply of the propulsion device 3C is still on and thus when travel using the other two propulsion devices 3P and 3S is performed thereafter, the shift position of the stopped central propulsion device 3C is controlled to be at the forward drive position or the reverse drive position depending on the lever positions of the two remote controllers. For example, when the levers of the two remote controllers are operated to the forward drive positions, the shift position of the central propulsion device 3C is set at the forward drive position. That is, a state in which a power transmission path between the motor and the propeller is connected is entered.

The propeller of the stopped propulsion device 3C rotates upon receiving a force of a relative water stream generated in accompaniment with the traveling of the marine vessel. If the shift position of the propulsion device 3C is at the forward drive position or the reverse drive position at this time, the rotation of the propeller is transmitted to a driving shaft (for example, a crankshaft) of the motor as shown in FIG. 24C. Starting of the motor may thereby occur. In the present specification, such rotation of the driving shaft of the motor included in the stopped propulsion device by the force that the propeller of the propulsion device receives from a water stream shall be referred to as "entrained rotation."

When the driving shaft is rotated in a state where a fault is occurring in the motor, depending on the type of fault, the motor may become damaged to an unrepairable degree as shown in FIG. 24D. For example, in a case where the motor is an engine, if the engine is started by entrained rotation after the engine has been stopped due to lowering of hydraulic pressure due to fault of an oil pump, the engine may become seized due to lack of hydraulic pressure.

As a matter of course, even in a case where the motor is not faulty, entrained rotation may occur in a case where a specific motor is in a driving-stopped state with its electric power supply being on. The motor may thus start against an intention of the user.

In order to overcome the previously unrecognized and unsolved challenges described above, a preferred embodiment of the present invention provides a marine vessel propulsion system including a plurality of propulsion devices, each in turn including a motor and a propeller rotated by the motor. The system further includes a common electric power supply switch arranged to be operated by an operator for turning on and off electric power supplies of the plurality of propulsion devices all at once, an electric power supply control unit arranged and programmed to put the electric power supplies of the respective propulsion devices in an on state all at once when the common electric power supply switch is turned on and to put the electric power supplies of the respective propulsion devices in an off state all at once when the common electric power supply switch is turned off, an abnormal state detection unit arranged to detect an abnormal state of each propulsion device, and a power transmission cutoff unit which is arranged to, when an abnormal state of any of the propulsion devices is detected by the abnormal state detection unit, cut off transmission of power between the motor and the propeller of the propulsion device for which the abnormal state is detected. "Motor" inclusively refers to an internal combustion engine, an electric motor, etc.

By this arrangement, the electric power supplies of the plurality of propulsion devices can be turned on all at once or turned off all at once by operating the common electric power supply switch (which may be a single common electric power supply switch). Thus, in a case where the common electric power supply switch is arranged as a key switch, consolidation of a main key for turning on and off the electric power supplies of the plurality of propulsion devices is enabled.

Also, when an abnormal state of any of the propulsion devices is detected, the transmission of power between the motor and the propeller of the propulsion device for which the abnormal state is detected is cut off. When the transmission of power between the motor and the propeller of propulsion device is cut off, even when the propeller is rotated due to water resistance during traveling of the marine vessel, the rotational force is not transmitted to the motor of the propulsion device. Entrained rotation thus does not occur. Problems due to entrained rotation can thus be avoided. Specifically, in a case where the motor is an engine (internal combustion engine), starting of the engine due to unintended cranking can be avoided.

Each of the propulsion devices may include a clutch mechanism that is switched between a transmitting state, in which power is transmitted between the motor and the propeller, and a cutoff state, in which the power transmission between the motor and the propeller is cut off. In this case, the power transmission cutoff unit may include a clutch control unit that is programmed to control the clutch mechanism to be in the cutoff state.

The clutch mechanism may be a shift mechanism enabling selection of a shift position among any of a forward drive position, a neutral position, and a reverse drive position. The forward drive position is a shift position at which a driving force of the motor is transmitted in a direction in which the propeller undergoes forward drive rotation. The neutral position is a shift position at which the driving force of the motor is not transmitted to the propeller. The reverse drive position is a shift position at which the driving force of the motor is transmitted in a direction in which the propeller undergoes reverse drive rotation. The forward drive rotation is a rotation in a direction in which the propeller applies a forward drive direction propulsive force to a hull. The reverse drive rotation is a rotation in a direction in which the propeller applies a reverse drive direction propulsive force to the hull. The forward drive position and the reverse drive position correspond to the transmitting state, and the neutral position corresponds to the cutoff state.

Preferably, in a case where the propulsion devices include the clutch mechanisms, a clutch state selection operation unit arranged for an operator to select states of the clutch mechanisms in the plurality of propulsion devices is further included. Preferably, in this case, the power transmission cutoff unit cuts off the transmission of power between the motor and the propeller of the propulsion device in the abnormal state regardless of the operation state of the clutch state selection operation unit. More specifically, the clutch state selection operation unit may be a shift position selection operation unit that is arranged for an operator to select the shift positions of the shift mechanisms.

The clutch state selection operation unit may have a fewer number of operation elements than a total number of the plurality of propulsion devices. In this case, the operation elements and the propulsion devices are not in a one-to-one association and at least one operating element is allocated to more than one propulsion device. When an abnormal state occurs in any of these two or more propulsion devices, the transmission of power between the motor and the propeller is cut off in the propulsion device in the abnormal state. Thus, when the associated operation element is operated, whereas the driving force of the motor can be transmitted to the propeller depending on the state of the clutch in the propulsion device without abnormality, a driving shaft of the motor is cut off from the propeller in the propulsion device in which the abnormality occurred.

As mentioned above, the motor may be an engine (internal combustion engine) or an electric motor.

The propulsion device may be in a form of an outboard motor, an inboard/outboard motor (a stern drive or an inboard motor/outboard drive), or an inboard motor. The outboard motor includes a propulsion unit provided outboard of the vessel and including a motor and a propeller, and is further provided with a steering mechanism that turns the entire propulsion unit horizontally with respect to the hull. The inboard/outboard motor includes a motor disposed inboard of the vessel, and a drive unit disposed outboard and including a propeller and a steering mechanism. The inboard motor preferably has a form where both a motor and a drive unit are incorporated in the hull, and a propeller shaft extends outboard from the drive unit.

In a preferred embodiment of the present invention, the abnormal state detection unit includes an entrained rotation detection unit that is arranged to detect rotation of the driving shaft of a motor due to entrained rotation as an abnormal state of the propulsion device that includes the motor.

By this arrangement, the rotation of the driving shaft of the motor due to entrained rotation is detected as an abnormal state of the propulsion device that includes the motor. The transmission of power between the motor and the propeller of the propulsion device is thus cut off promptly when entrained rotation occurs.

In a preferred embodiment of the present invention, the entrained rotation detection unit is arranged to detect that the driving shaft of a motor is rotating due to entrained rotation when, from a state where the motor is stopped, the driving shaft of the motor rotates with a starting device of the motor not being driven, or when, after starting a stopping process on the motor that is in a running state, the rotation of the driving shaft of the motor does not stop within a predetermined time.

By this arrangement, the transmission of power between the motor and the propeller can be cut off when, despite the motor being stopped once, the driving shaft of the motor begins to rotate thereafter due to entrained rotation. Further, by this arrangement, the transmission of power between the motor and the propeller can be cut off when, despite the stopping process being performed on the motor that is in operation, the rotation of the driving shaft of the motor does not stop due to entrained rotation. The entrained rotation state can thereby be resolved promptly to stop the motor reliably.

In a preferred embodiment of the present invention, the marine vessel propulsion system further includes a notification unit arranged to notify the cutting off of transmission of power between the motor and the propeller of a propulsion device for which an abnormal state is detected when the power transmission cutoff unit cuts off the transmission of power between the motor and the propeller of the propulsion device.

By this arrangement, when the transmission of power between the motor and the propeller of a propulsion device, for which an abnormal state is detected, is cut off, this is notified to a user (operator) by the notification unit. The user can thus recognize that the transmission of power between the motor and the propeller is cut off regardless of an operation state (for example, a position of an operation element) of the shift position selection operation unit. The user can thus be prevented from mistaking that the shift position selection operation unit or a shift mechanism of a propulsion device is faulty when these elements are not faulty.

In a preferred embodiment of the present invention, each of the propulsion devices includes a clutch mechanism that is arranged to be switched between a transmitting state, in which power is transmitted between the motor and the propeller, and a cutoff state, in which the transmission of power between the motor and the propeller is cut off. The marine vessel propulsion system further includes a clutch state selection operation unit arranged for an operator to select states of the clutch mechanisms in the plurality of propulsion devices. Further, the power transmission cutoff unit is arranged such that when the transmission of power between the motor and the propeller of a propulsion device for which an abnormal state is detected is cut off, the cutoff state is maintained until a selection operation for putting the state of the clutch mechanism of the propulsion device in the cutoff state is performed by the clutch state selection operation unit.

In a preferred embodiment of the present invention, the power transmission cutoff unit is arranged such that when the transmission of power between the motor and the propeller of a propulsion device for which an abnormal state is detected is cut off, the cutoff state is maintained until the motors of all propulsion devices are stopped.

In a preferred embodiment of the present invention, the marine vessel propulsion system further includes a speed detection unit that is arranged to detect a speed of the marine vessel. The power transmission cutoff unit is arranged such that when the transmission of power between the motor and the propeller of a propulsion device for which an abnormal state is detected is cut off, the cutoff state is maintained until the speed of the marine vessel detected by the speed detection unit becomes no more than a predetermined threshold value.

Here, for example, it shall be assumed that an abnormal state of one propulsion device is detected during traveling of the marine vessel and the transmission of power between the motor and the propeller of the propulsion device is cut off. The entrained rotation state is thereby resolved, and thus the abnormal state detection unit at least no longer detects the entrained rotation abnormality. Thus, if the clutch state is controlled in accordance with operation of the clutch state selection operation unit immediately after the abnormal state is no longer detected, needless clutch control may be performed. That is, there is a possibility for power transmission cutoff control based on abnormal state detection and clutch control in accordance with operation of the clutch state selection operation unit based on cancellation of the abnormal state to be repeated alternately.

By providing the arrangement described above, the repetition of the detection of the abnormal state and the cancellation of the abnormal state is prevented and the abovementioned clutch control and other control can be prevented from being performed needlessly.

A docking detection unit that is arranged to detect that the marine vessel is docked may be provided, and the power transmission cutoff unit may be arranged such that when the transmission of power between the motor and the propeller of a propulsion device for which an abnormal state is detected is cut off, the cutoff state is maintained until the docking of the marine vessel is detected. As the docking detection unit, for example, an arrangement that uses a navigation apparatus arranged to detect that the marine vessel is docked at a scheduled docking position set in advance may be used. Also, as the docking detection unit, an arrangement that is arranged to measure a distance to a scheduled docking position by a laser and to detect that the marine vessel is docked when the distance becomes no more than a predetermined value may be used. Further, as the docking detection unit, an arrangement that is arranged to detect that the marine vessel is docked based on an output of a sensor (such as a proximity sensor) that is arranged to detect that the marine vessel has approached the scheduled docking position (for example, has berthed at a quay, etc.) may be used.

In a preferred embodiment of the present invention, each of the propulsion devices includes a clutch mechanism that is arranged to be switched between a transmitting state, in which power is transmitted between the motor and the propeller, and a cutoff state, in which the transmission of power between the motor and the propeller is cut off. The marine vessel propulsion system further includes a clutch state selection operation unit arranged for an operator to select states of the clutch mechanisms in the plurality of propulsion devices. Further, the clutch state selection operation unit includes a fewer number of operation elements than the total number of the plurality of propulsion devices. Further, the marine vessel propulsion system further includes an association changing unit which is arranged to, when there is a propulsion device that has the transmission of power between the motor and the propeller cut off by the power transmission cutoff unit, change, in accordance with a location of the propulsion device, an association or correspondence of the respective propulsion devices and the operation elements.

By this arrangement, when there is a propulsion device that has the transmission of power between the motor and the propeller cut off by the power transmission cutoff unit, the association of the respective propulsion devices and the operation elements can be changed according to the location of the propulsion device that is cut off. Thus, when there is a propulsion device that has the transmission of power between the motor and the propeller cut off by the power transmission cutoff unit, the clutch state selection operation of the propulsion devices other than the propulsion device that is cut off can be performed readily.

Here, for example, a marine vessel that includes three propulsion devices of starboard-side, central, and port-side and is arranged such that the shift positions of the propulsion devices are selected by two levers (each of which is an example of an operation element) shall be assumed. It shall be assumed that the two levers are disposed in alignment to the right and left facing a stem direction. In a case where the three propulsion devices are in normal states, for example, the lever at the right side facing the stem direction is associated with the starboard-side propulsion device, the lever at the left side facing the stem direction is associated with the port-side propulsion device, and both levers are associated with the central propulsion device. More specifically, when the positions of both levers are at the forward drive position, the shift position of the central outboard motor is controlled to be at the forward drive position. When the positions of both levers are at the reverse drive position, the shift position of the central outboard motor is controlled to be at the reverse drive position. In a case where the combination of the positions of the levers is a combination other than the above, the shift position of the central outboard motor is controlled to be at the neutral position. The shift position of the starboard-side propulsion device is controlled in accordance with the position of the right-side lever. The shift position of the port-side propulsion device is controlled in accordance with the position of the left-side lever.

In a case where the port-side propulsion device enters an abnormal state and the transmission of power between the motor and the propeller thereof is cutoff, the association changing unit, for example, associates the left-side lever with the central propulsion device and associates the right-side lever with the starboard-side propulsion device. In a case where the starboard-side propulsion device enters an abnormal state, the association changing unit, for example, associates the right-side lever with the central propulsion device and associates the left-side lever with the port-side propulsion device. In a case where the central propulsion device enters an abnormal state, the association changing unit does not change the association of the propulsion devices and the levers. The association changing unit is preferably arranged such that the change of association of the propulsion devices and the levers is performed when all levers are at the neutral position. This is to prevent sudden change of behavior of the marine vessel due to change of the association of the propulsion devices and the levers during travel.

In a preferred embodiment of the present invention, the marine vessel propulsion system further includes a unit arranged to control a propulsion device, for which an abnormality is detected, such that the motor of the propulsion device is put in a driving-stopped state at the same time or after the transmission of power between the motor and the propeller of the propulsion device is cut off by the power transmission cutoff unit.

By this arrangement, a propulsion device, for which an abnormality is detected, is controlled so that the motor of the propulsion device is put in the driving-stopped state at the same time or after the transmission of power between the motor and the propeller of the propulsion device is cut off. Thus, even if the propulsion device, for which an abnormality is detected, is in a driving state when the transmission of power between the motor and the propeller of the propulsion device is cut off, the driving by the motor can be stopped reliably.

In a preferred embodiment of the present invention, each of the propulsion devices includes a clutch mechanism that is arranged to be switched between a transmitting state, in which power is transmitted between the motor and the propeller, and a cutoff state, in which the transmission of power between the motor and the propeller is cut off. The marine vessel propulsion system further includes a stopped state detection unit arranged to detect stopped states of the motors of the respective propulsion devices, a clutch state detection unit arranged to detect, when the stopped state detection unit detects the stopped state of the motor of any of the propulsion devices, the transmitting state of the clutch mechanism in the propulsion device for which the stopped state of the motor is detected, and an ignition and injection control unit arranged to cut, when the clutch state detection unit detects the transmitting state of the clutch mechanism in the propulsion device for which the stopped state of the motor is detected, an ignition and an injection of the motor.

By this arrangement, if the clutch of the propulsion device is in the transmitting state when the motor is in the stopped state, the ignition and the injection of the motor are cut. The starting of the motor by entrained rotation can thereby be avoided. The stopping of the motor and the transmitting state of the clutch can be detected even if entrained rotation is not actually occurring. The ignition and the injection of the motor can thus be cut before entrained rotation is detected and the starting of the motor by entrained rotation can thus be avoided.

The stopped state detection unit may include a unit arranged to detect that a rotational speed of the motor is less than a predetermined value. The stopped state detection unit may also include a unit arranged to detect that a stop switch for stopping the motor is operated.

In a preferred embodiment of the present invention, the power transmission cutoff unit is arranged to cut off the transmission of power between the motor and the propeller of a propulsion device for which the stopped state of the motor is detected when the clutch state detection unit detects that the clutch mechanism in the propulsion device for which the stopped state of the motor is detected is in the transmitting state.

By this arrangement, as long as the motor is in the stopped state and the clutch is in the transmitting state, the transmission of power between the motor and the propeller is cut off even if entrained rotation is actually not occurring. The occurrence of entrained rotation can thereby be prevented.

A preferred embodiment of the present invention provides a marine vessel propulsion system including a plurality of propulsion devices, each in turn including a motor, a propeller rotated by the motor. The system further includes a clutch mechanism that is arranged to be switched between a transmitting state, in which power is transmitted between the motor and the propeller, and a cutoff state, in which the transmission of power between the motor and the propeller is cut off. The marine vessel propulsion system further includes a common electric power supply switch arranged to be operated by an operator to turn on and off electric power supplies of the plurality of propulsion devices all at once, an electric power supply control unit arranged to put the electric power supplies of the respective propulsion devices in an on state all at once when the common electric power supply switch is turned on and to put the electric power supplies of the respective propulsion devices in an off state all at once when the common electric power supply switch is turned off, a stopped state detection unit arranged to detect stopped states of the motors of the respective propulsion devices, a clutch state detection unit arranged to detect, when the stopped state detection unit detects the stopped state of the motor of any of the propulsion devices, the transmitting state of the clutch mechanism in the propulsion device for which the stopped state of the motor is detected, an ignition and injection control unit arranged to cut, when the clutch state detection unit detects the transmitting state of the clutch mechanism in the propulsion device for which the stopped state of the motor is detected, an ignition and an injection of the motor, and a power transmission cutoff unit that is arranged to cut off the transmission of power between the motor and the propeller of a propulsion device for which the stopped state of the motor is detected when the clutch state detection unit detects that the clutch mechanism in the propulsion device for which the stopped state of the motor is detected is in the transmitting state.

By this arrangement, when it is detected that the motor is in the stopped state and the clutch is in the transmitting state, the ignition and the injection of the motor are cut and further, the power transmission between the motor and the propeller is cut off. Entrained rotation can thereby be prevented and the starting of the motor due to entrained rotation can be avoided.

In a preferred embodiment of the present invention, the ignition and injection control unit is arranged and programmed such that after cutting the ignition and the injection, the cutting of the ignition and the injection is maintained until the common electric power supply switch is turned off.

If the clutch mechanism is in the cutoff state, there is no apprehension of starting of the motor due to entrained rotation even if the motor is in the stopped state. However, if the clutch mechanism is put in the transmitting state again thereafter, the motor may start due to entrained rotation. It is thus wasteful to start and stop the control of cutting the ignition and the injection according to the detection results of the stopped state of the motor and the transmitting state of the clutch. This waste of control can be avoided by maintaining the cutting of the ignition and the injection until the common electric power supply switch is turned off.

In a preferred embodiment of the present invention, the marine vessel propulsion system further includes start switches that are arranged to be operated by an operator to start the motors of the respective propulsion devices. The ignition and injection control unit is arranged such that after cutting the ignition and the injection, the cutting of the ignition and the injection is maintained until the start switch corresponding to the propulsion device for which the stopped state of the motor is detected is operated.

Waste of control can be avoided by this arrangement as well. That is, there is a high possibility that starting of the motor before input of a motor start command is not intended by the user. Waste of control can thus be avoided by cutting the ignition and the injection until the start switch is operated. When the start switch is operated, the cutting of the ignition and the injection is cancelled, and the starting of the motor can be performed in accordance with the intention of the user without any problem.

Also, a preferred embodiment of the present invention provides a marine vessel propulsion system including a plurality of propulsion devices, each in turn including a motor, a propeller rotated by the motor, and a clutch mechanism that is arranged to be switched between a transmitting state, in which power is transmitted between the motor and the propeller, and a cutoff state, in which the transmission of power between the motor and the propeller is cut off. The marine vessel propulsion system further includes a common electric power supply switch arranged to be operated by an operator to turn on and off electric power supplies of the plurality of propulsion devices all at once, an electric power supply control unit putting the electric power supplies of the respective propulsion devices in an on state all at once when the common electric power supply switch is turned on and putting the electric power supplies of the respective propulsion devices in an off state all at once when the common electric power supply switch is turned off, a stopped state detection unit arranged to detect stopped states of the motors of the respective propulsion devices, a clutch state detection unit arranged to detect, when the stopped state detection unit detects the stopped state of the motor of any of the propulsion devices, the transmitting state of the clutch mechanism in the propulsion device for which the stopped state of the motor is detected, and an ignition and injection control unit arranged to cut, when the clutch state detection unit detects the transmitting state of the clutch mechanism in the propulsion device for which the stopped state of the motor is detected, the ignition and injection of the motor.

By this arrangement, when it is detected that the motor is in the stopped state and the clutch is in the transmitting state, the ignition and the injection of the motor are cut and further, the power transmission between the motor and the propeller is cut off. Thereby, the starting of the motor due to entrained rotation can be avoided.

In a preferred embodiment of the present invention, the ignition and injection control unit is arranged such that after cutting the ignition and the injection, the cutting of the ignition and the injection is maintained until the common electric power supply switch is turned off. If the clutch mechanism is in the cutoff state, there is no apprehension of starting of the motor due to entrained rotation even if the motor is in the stopped state. However, if the clutch mechanism is put in the transmitting state again thereafter, the motor may start due to entrained rotation. It is thus wasteful to start and stop the control of cutting the ignition and injection according to the detection results of the stopped state of the motor and the transmitting state of the clutch. This waste of control can be avoided by maintaining the cutting of the ignition and the injection until the common electric power supply switch is turned off.

In a preferred embodiment of the present invention, the marine vessel propulsion system further includes start switches that are arranged to be operated by an operator to start the motors of the respective propulsion devices. The ignition and injection control unit is arranged such that after cutting the ignition and the injection, the cutting of the ignition and the injection is maintained until the start switch corresponding to the propulsion device for which the stopped state of the motor is detected is operated. Waste of control can be avoided by this arrangement as well. That is, there is a high possibility that starting of the motor before input of a motor start command is not intended by the user. Waste of control can thus be avoided by cutting the ignition and the injection until the start switch is operated. When the start switch is operated, the cutting of the ignition and the injection is cancelled, and the starting of the motor can be performed in accordance with the intention of the user without any problem.

Meanwhile, in a case where a single, common electric power supply switch is provided for a plurality of propulsion devices (for example, outboard motors), if, for example, a fault occurs in one propulsion device, the electric power supply of just the faulty propulsion device cannot be cut off. Consumption of electric power thus becomes a problem. That is, when the electric power supply is turned on with the motor (for example, an engine) being in a state of not starting due to a fault, the electric power of the corresponding battery is only consumed and not recharged and eventually the battery may run out. Obviously, there is also a problem in terms of energy saving performance. Also, when a fault (for example, short-circuiting of an electric power supply system, etc.) that ordinarily requires the turning off of the power supply occurs in one propulsion device, the electric power supply of just the faulty propulsion device cannot be turned off. If the electric power supplies of all of the propulsion devices are turned off, a propulsive force for the marine vessel cannot be obtained. Traveling must thus be continued with the power supply of the faulty propulsion device remaining on.

Thus, a preferred embodiment of the present invention provides a marine vessel propulsion system that resolves the above issue. This system includes a plurality of propulsion devices, each in turn including a motor and a motor control unit, a common electric power supply switch arranged to be operated by an operator to turn on and off the plurality of propulsion devices all at once, a plurality of electric power supply off command input units for turning off electric power supplies of the respective propulsion devices individually, and an electric power supply control unit programmed to perform on/off control of the electric power supplies of the respective propulsion devices based on inputs from the common electric power supply switch and the respective electric power supply off command input units. The electric power supply control unit includes an all electric power supply on unit that is arranged to turn on the electric power supplies of the respective propulsion devices all at once when the common electric power supply switch is turned on, an all electric power supply off unit that is arranged to turn off the electric power supplies of the respective propulsion devices all at once when the common electric power supply switch is turned off, and a first individual electric power supply off unit, which is arranged, when the electric power supply off command is input by any of the electric power supply off command input units with the common electric power supply switch being in the on state, individually turn off the electric power supply of the propulsion device corresponding to the electric power supply off command input unit.

By this arrangement, by operating the common electric power supply switch (which may be a single common electric power supply switch), the electric power supplies of the plurality of propulsion devices can be turned on all at once or turned off all at once. Thus, in a case where the common electric power supply switch is arranged from a key switch, consolidation of a main key for turning on and off the electric power supplies of the plurality of propulsion devices is enabled. When the electric power supply off command is input by any of the electric power supply off command input units with the common electric power supply switch being in the on state, the electric power supply of the propulsion device corresponding to the electric power supply off command input unit is turned off individually. A state of the propulsion device with which the electric power supply is turned off individually in this manner may be referred to as an "individual electric power supply off mode."

Thus, for example, when a fault occurs in one propulsion device, the electric power supply of just the faulty propulsion device can be turned off. The power supply of the propulsion device, with which the motor (for example, an engine) cannot be started due to a fault, etc., can thus be turned off individually. Wasteful consumption of electric power can thus be minimized. Also, in a system in which a battery that is used as the electric power supply is recharged by operation of the motor, the running out of the battery can be reduced or prevented. Also, traveling of the marine vessel is not disrupted because the electric power supply of the propulsion device, for which the fault, etc., has occurred, can be put in the off state and the electric power supplies of the other normal propulsion devices can be put in the on state.

In a preferred embodiment of the present invention, the marine vessel propulsion system further includes a plurality of start/stop switches arranged to be operated by an operator for starting and stopping the motors of the respective propulsion devices individually, and an operation judgment unit judging an operation of each start/stop switch as being a first operation for inputting a start/stop command or a second operation that is a specific operation differing from the first operation and is for inputting an electric power supply off command. The plurality of start/stop switches serve in common as the plurality of electric power supply command input units, and the first individual electric power supply off unit is arranged to respond to the judgment by the operation judgment unit that the second operation is performed.

With this arrangement, by performing the second operation on the start/stop switches for starting and stopping the motors of the respective propulsion devices individually, the electric power supplies of the propulsion devices corresponding to the start/stop switches can be turned off individually. Thus, by this arrangement, a special switch for turning off the electric power supplies individually does not have to be provided.

In a preferred embodiment of the present invention, the first operation of each start/stop switch is a short pressing operation of the start/stop switch, and the second operation of each start/stop switch is a long pressing operation of the start/stop switch. With this arrangement, by performing the long pressing operation of a start/stop switch, the electric power supply of the propulsion device corresponding to the start/stop switch can be turned off individually.

In a preferred embodiment of the present invention, the electric power supply control unit further includes a first individual electric power supply on unit, which is arranged to, when the start/stop switch, corresponding to a propulsion device having its electric power supply in the off state, is operated with the common electric power supply switch being in the on state, turn on the electric power supply of the propulsion device individually.

By this arrangement, when the start/stop switch, corresponding to a propulsion device having its electric power supply in the off state (individual electric power supply off mode), is operated with the common electric power supply switch being in the on state, the electric power supply of the propulsion device is turned on. The electric power supply of the propulsion device that is in the individual electric power supply off mode can thus be turned on by a simple operation.

The first individual electric power supply on unit may be arranged to turn on the electric power supply of the propulsion device individually and at the same time generate a start command for starting the motor of the propulsion device.

In a preferred embodiment of the present invention, the marine vessel propulsion system further includes a plurality of individual electric power supply switches arranged to be operated by an operator to turn on and off the electric power supplies of the respective propulsion devices individually, and the electric power supply control unit further includes a second individual electric power supply on unit, which is arranged to, when an on operation of any of the individual electric power supply switches is performed, put the electric power supply of the propulsion device corresponding to the individual electric power supply switch in the on state individually, and a second individual electric power supply off unit, which is arranged to, when an off operation of any of the individual electric power supply switches is performed, put the electric power supply of the propulsion device corresponding to the individual electric power supply switch in the off state individually.

By this arrangement, the electric power supply of each propulsion devices can be turned on and off individually by operation of the individual electric power supply switch. In this case, the individual electric power supply switch is provided dedicatedly for turning on and off the electric power supply of the propulsion device individually, and operation thereof can be made simple.

Also, as mentioned above, there is a case where the first individual electric power supply on unit turns on the electric power supply of a propulsion device individually and generates the start command for starting the motor of the propulsion device. In this case, when the first individual electric power supply on unit operates, the electric power supply of a propulsion device in the individual electric power supply off mode is turned on and, at the same time, the motor thereof is started. Thus, by providing the individual electric power supply switch, the power supply of a propulsion device in the individual electric power supply off mode can be put in the on state without starting the motor of the propulsion device.

In a preferred embodiment of the present invention, the marine vessel propulsion system further includes a display unit arranged to display on/off states of the electric power supplies of the respective propulsion devices. By this arrangement, when there is a propulsion device that has its electric power supply turned off even though the common electric power supply switch is on (a propulsion device in the individual electric power supply off mode), the user can recognize this readily.

A preferred embodiment of the present invention provides a marine vessel including a hull and a marine vessel propulsion system including the features described above.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
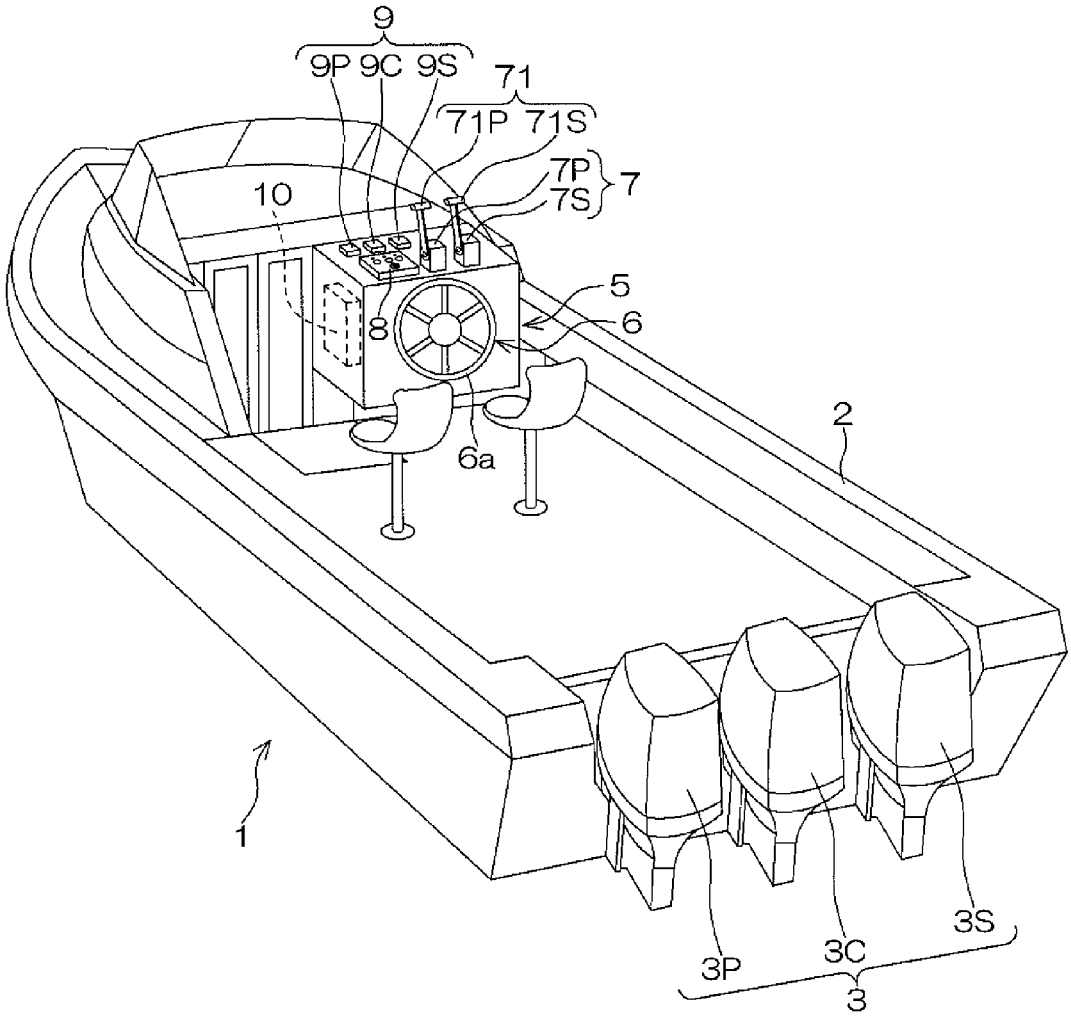
FIG. 1 is a perspective view for explaining an arrangement of a marine vessel according to a preferred embodiment of the present invention.

FIG. 1 is a perspective view for explaining an arrangement of a marine vessel according to a preferred embodiment of the present invention. The marine vessel 1 includes a hull 2 and outboard motors 3 as propulsion devices. A plurality (for example, three, in the preferred embodiment) of the outboard motors 3 are included. The outboard motors 3 are attached in alignment along a stern of the hull 2. When the three outboard motors are to be distinguished, that disposed at a starboard-side shall be referred to as the "starboard-side outboard motor 3S," that disposed at a center shall be referred to as the "central outboard motor 3C," and that disposed at a port-side shall be referred to as the "port-side outboard motor 3P." Each of the outboard motors 3 includes an engine (internal combustion engine) and a propeller (screw) and generates a propulsive force by the propeller being rotated by a driving force of the engine.

A marine vessel maneuvering compartment 5 is provided at a front portion (stern side) of the hull 2. The marine vessel maneuvering compartment 5 includes a steering operation apparatus 6, remote controllers 7, an operation panel 8, gauges 9, and a remote controller ECU (electronic control unit) 10.

The steering operation apparatus 6 includes a steering wheel 6*a* that is rotatingly operated by a marine vessel operator. The operation of the steering wheel 6*a* is mechanically transmitted by a cable (not illustrated) to a steering mechanism (not illustrated) provided at the stern. The steering mechanism is arranged to couplingly move the three outboard motors 3 and change their directions. A direction of the propulsive force is thereby changed and a heading direction of the marine vessel 1 can be changed accordingly. Obviously, a power steering apparatus including a sensor that detects an operation angle of the steering wheel 6*a* and an actuator that is driven in accordance with the operation angle detected by the sensor may be adopted. In this case, there is no mechanical link between the steering wheel 6*a* and the steering mechanism, and the actuator is driven by a control signal that is in accordance with the steering operation so that the outboard motors 3 are steered by a driving force of the actuator.

In the present preferred embodiment, two remote controllers 7 are preferably included, for example. The two remote controllers 7 are disposed in alignment to the right and left facing a stem direction, and each includes a lever 71 that can be inclined forward and in reverse. When the two remote controllers are to be distinguished, that disposed at the right side facing the stem direction shall be referred to as the "starboard-side remote controller 7S" and that disposed at the left side facing the stem direction shall be referred to as the "port-side remote controller 7P." When the two levers 71 are to be distinguished, that corresponding to the starboard-side remote controller 7S shall be referred to as the "starboard-side lever 71S" and corresponding to the port-side remote controller 7P shall be referred to as the "port-side lever 71P."

Inclination positions of the respective levers 71S and 71P are respectively detected by lever position sensors 11S and 11P that may be potentiometers, etc. (see FIG. 4). The lever position sensor 11S corresponds to the starboard-side lever 71S, and the lever position sensor 11P corresponds to the port-side lever 71P.

Three gauges 9 are provided in correspondence to the three outboard motors 3. These gauges 9 are arranged to display states of the corresponding outboard motors 3. More specifically, each gauge 9 displays a rotational speed of the engine and other necessary information of the corresponding outboard motor 3.

Figure 2:
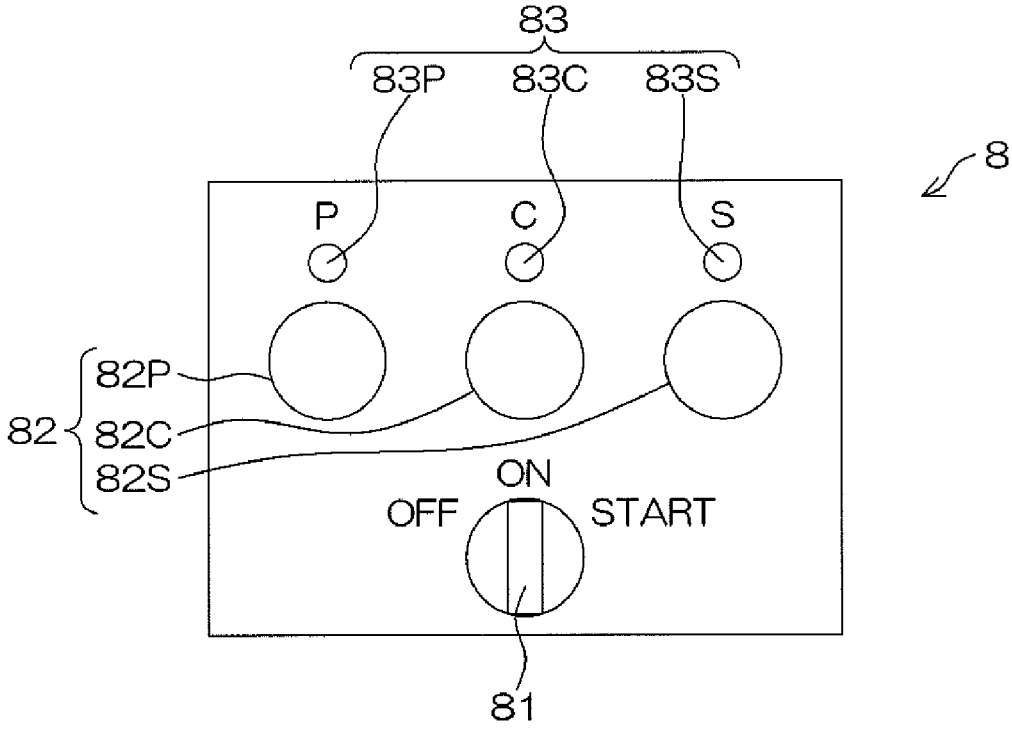
FIG. 2 is a plan view for explaining an arrangement of an operation panel.

As shown in FIG. 2, the operation panel 8 includes a single key switch 81 arranged to be operated by an operator for turning on and off electric power supplies of the three outboard motors 3 all at once, and three start/stop switches 82S, 82C, and 82P, which can be operated individually. The operation panel 8 further includes lamps 83S, 83C, and 83P arranged to display on/off states of the electric power supplies of the three outboard motors 3.

The key switch 81 is arranged to be operated by a user (operator) to turn on and off the electric power supplies of the three outboard motors 3 all at once and to start the engines of the three outboard motors 3 all at once. Specifically, by the user's operating the key switch 81 from an off position to an on position, the electric power supplies of the three outboard motors 3 are turned on all at once. When the user further operates the key switch 81 from the on position to a start position, the three outboard motors 3 are started all at once. Also, by the user's operating the key switch 81 from the on position to the off position, the electric power supplies of the three outboard motors 3 are put in the off states all at once.

Three each of the start/stop switches and the lamps are provided in correspondence to the three outboard motors 3. The start/stop switch 82S and the lamp 83S provided in the vicinity thereof correspond to the starboard-side outboard motor 3S. The start/stop switch 82C and the lamp 83C provided in the vicinity thereof correspond to the central outboard motor 3C. The start/stop switch 82P and the lamp 83P provided in the vicinity thereof correspond to the port-side outboard motor 3P.

Operation methods of each start/stop switch 82 include a first operation and a second operation. In the present preferred embodiment, the first operation is a "short pressing operation," and the second operation is a "long pressing operation." The "long pressing operation" is a continuous operation performed for no less than a predetermined fixed time.

By performing short pressing operations of the start/stop switches 82 individually, the engines of the three outboard motors 3 can be started and stopped individually. By performing the long pressing operation of a start/stop switch 82 individually with the key switch 81 being at the on position, the electric power supply of the outboard motor 3 corresponding to the start/stop switch 82 can be turned off individually.

Figure 3:
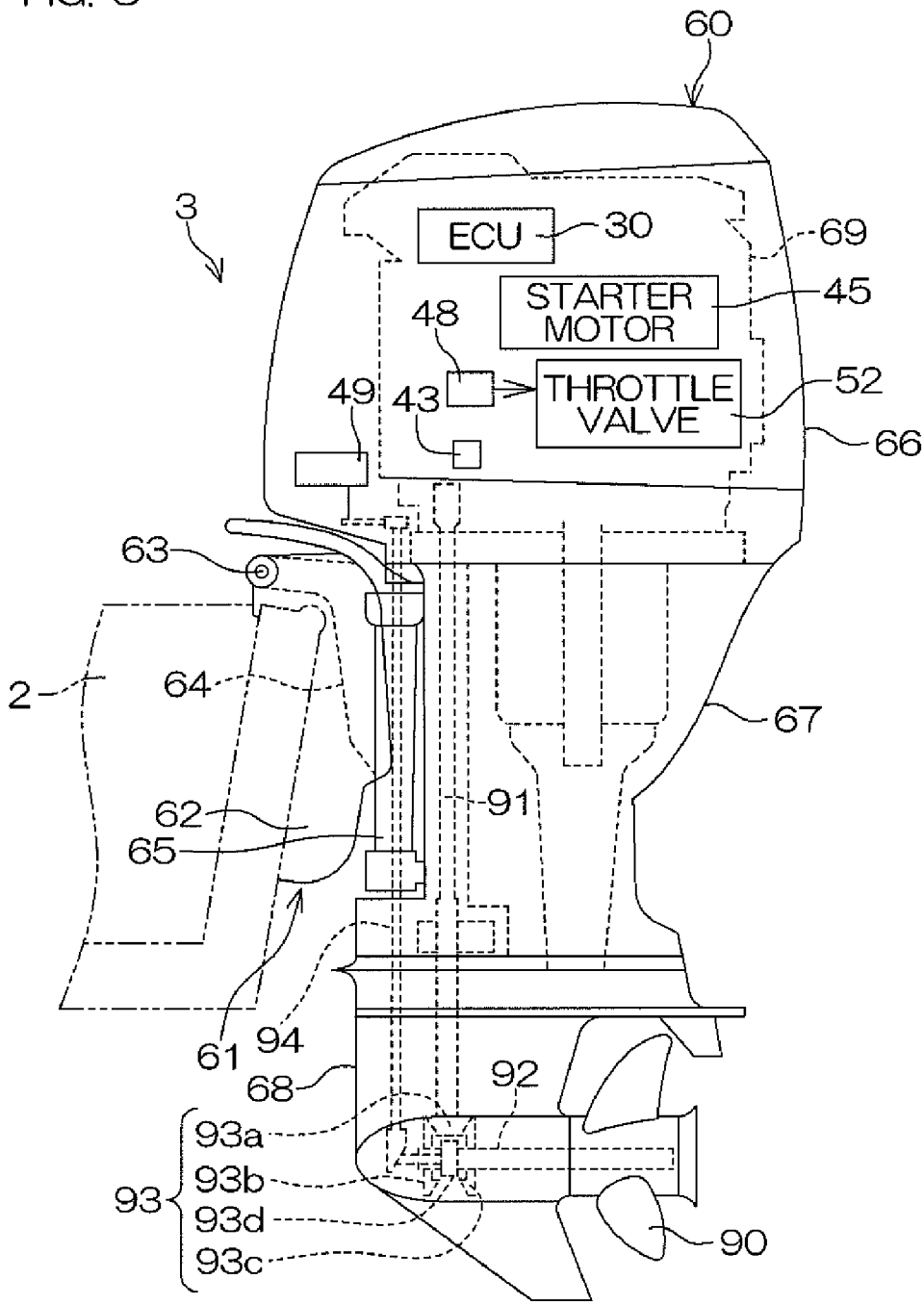
FIG. 3 is a side view of an arrangement example of an outboard motor.

FIG. 3 is a schematic side view for explaining an arrangement example in common to the three outboard motors 3.

Each outboard motor 3 includes a propulsion unit 60, and an attachment mechanism 61 arranged to attach the propulsion unit 60 to the hull 2. The attachment mechanism 61 includes a clamp bracket 62 arranged to be detachably fixed to a transom of the hull 2, and a swivel bracket 64 coupled to the clamp bracket 62 in a manner enabling pivoting about a tilt shaft 63 as a horizontal pivot axis. The propulsion unit 60 is attached to the swivel bracket 64 in a manner enabling pivoting about a steering shaft 65. Thus, a steering angle (a direction angle defined by the direction of the propulsive force with respect to a centerline of the hull 2) can be changed by pivoting the propulsion unit 60 about the steering shaft 65. Further, a trim angle of the propulsion unit 60 can be changed by pivoting the swivel bracket 64 about the tilt shaft 63. The trim angle is an angle of attachment of the outboard motor 3 with respect to the hull 2.

A housing of the propulsion unit 60 includes an engine cover 66, an upper case 67, and a lower case 68. Inside the engine cover 66, the engine 69 as a drive source is installed with an axis of a crankshaft thereof extending vertically. A driveshaft 91 is coupled to a lower end of the crankshaft of the engine 69, and vertically extends through the upper case 67 into the lower case 68.

A propeller 90, which is a propulsive force generating member, is rotatably attached to a lower rear portion of the lower case 68. A propeller shaft 92, which is a rotation shaft of the propeller 90, extends horizontally in the lower case 68. The rotation of the driveshaft 91 is transmitted to the propeller shaft 92 via a shift mechanism 93 as a clutch mechanism.

The shift mechanism 93 includes a drive gear 93*a*, a forward drive gear 93*b*, a reverse drive gear 93*c*, and a dog clutch 93*d*. The drive gear 93*a* is arranged as a beveled gear fixed to a lower end of the driveshaft 91. The forward drive gear 93*b* is arranged as a beveled gear rotatably disposed on the propeller shaft 92. The reverse drive gear 93*c* is likewise arranged as a beveled gear rotatably disposed on the propeller shaft 92. The dog clutch 93*d* is disposed between the forward drive gear 93*b* and the reverse drive gear 93*c*.

The forward drive gear 93*b* is meshed with the drive gear 93*a* from a forward side, and the reverse drive gear 93*c* is meshed with the drive gear 93*a* from a reverse side. Therefore, the forward drive gear 93*b* and the reverse drive gear 93*c* rotate in mutually opposite directions.

The dog clutch 93*d* is in spline engagement with the propeller shaft 92. That is, the dog clutch 93*d* is axially slidable with respect to the propeller shaft 92, but is not rotatable relative to the propeller shaft 92, and thus rotates together with the propeller shaft 92.

The dog clutch 93*d* is slid along the propeller shaft 92 by receiving a force of a shift rod 94 by axial pivoting of the shift rod 94, which extends vertically and parallel to the driveshaft 91. The dog clutch 93*d* is thereby controlled to be at a shift position among a forward drive position at which it is engaged with the forward drive gear 93*b*, a reverse drive position at which it is engaged with the reverse drive gear 93*c*, and a neutral position at which it is not engaged with either the forward drive gear 93*b* or the reverse drive gear 93*c*.

When the dog clutch 93*d* is at the forward drive position, the rotation of the forward drive gear 93*b* is transmitted to the propeller shaft 92 via the dog clutch 93*d*. The propeller 90 is thereby rotated in one direction (forward drive direction) to generate a propulsive force in a direction of moving the hull 2 forward. On the other hand, when the dog clutch 93*d* is at the reverse drive position, the rotation of the reverse drive gear 93*c* is transmitted to the propeller shaft 92 via the dog clutch 93*d*. The reverse drive gear 93*c* is rotated in a direction opposite to that of the forward drive gear 93*b*, and the propeller 90 is thus rotated in an opposite direction (in a reverse drive direction) to generate a propulsive force in a direction of moving the hull 2 in reverse. When the dog clutch 93*d* is in the neutral position, the rotation of the driveshaft 91 is not transmitted to the propeller shaft 92. That is, a driving force transmission path between the engine 69 and the propeller 90 is cut off, so that no propulsive force is generated in either of the forward and reverse drive directions.

In relation to the engine 69, a starter motor 45 is disposed and is arranged to start the engine 69. The starter motor 45 is controlled by an outboard motor ECU 30. A throttle actuator 48 is also provided and is arranged to actuate a throttle valve 52 of the engine 69 to change a throttle opening degree and thereby change an intake air amount of the engine 69. The throttle actuator 48 may include an electric motor. Operation of the throttle actuator 48 is controlled by the outboard motor ECU 30. An engine speed sensor 43 arranged to detect a rotation of the crankshaft is provided to detect a rotational speed of the engine 69.

In relation to the shift rod 94, a shift actuator 49 arranged to change the shift position of the dog clutch 93*d* is provided. The shift actuator 49 includes, for example, an electric motor, and its operation is controlled by the outboard motor ECU 30.

Figure 4:
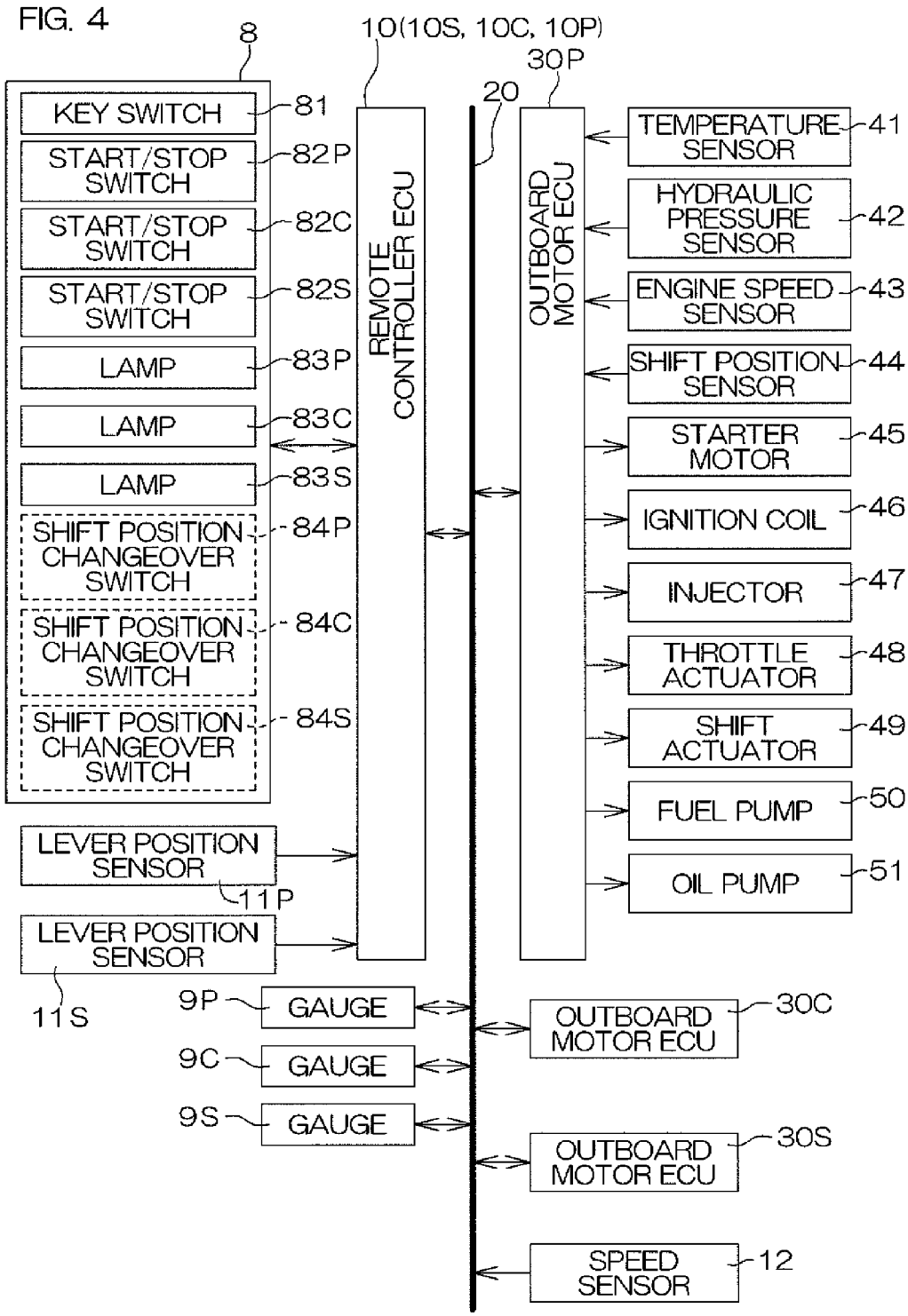
FIG. 4 is a diagram for explaining an electrical arrangement of the marine vessel.

FIG. 4 is a diagram for explaining an electrical arrangement of principal portions of the marine vessel 1.

The operation panel 8 and the lever position sensors 11P and 11S are connected to the remote controller ECU 10. The remote controller ECU 10 includes a computer (microcomputer). Although in the present preferred embodiment, three remote controller ECUs 10S, 10C, and 10P are provided in correspondence to the three outboard motors 3S, 3C, and 3P, in FIG. 4, these are indicated collectively as "remote controller ECU 10." The three remote controllers 10S, 10C, and 10P exchange information mutually via a communication line.

The remote controller ECU 10 is connected to a bus 20 that defines an inboard LAN (local area network). The gauges 9P, 9C, and 9S are connected to the bus 20. Also, a speed sensor 12 arranged to detect a speed of the marine vessel is connected to the bus 20.

The outboard motors 3S, 3C, and 3P respectively include outboard motor ECUs 30P, 30C, and 30S. The outboard motor ECU 30P corresponds to the port-side outboard motor 3P, the outboard motor ECU 30C corresponds to the central outboard motor 3C, and the outboard motor ECU 30S corresponds to the starboard-side outboard motor 3S. The outboard motor ECUs 30S, 30C, and 30P are connected to the bus 20. The outboard motor ECUs 30S, 30C, and 30P are practically the same in internal arrangement, and shall be referred to below as "outboard motor ECUs 30" when these are to be referred to collectively.

Each outboard motor ECU 30 includes a computer (microcomputer). A temperature sensor 41, a hydraulic pressure sensor 42, the engine speed sensor 43, a shift position sensor 44, the starter motor 45, an ignition coil 46, an injector 47, the throttle actuator 48, the shift actuator 49, a fuel pump 50, an oil pump 51, etc., are connected to the outboard motor ECU 30.

The starter motor 45 is a device arranged to perform cranking of the engine. The injector 47 is a device that is arranged to inject fuel into an air intake path of the engine. The throttle actuator 48 is a device that is arranged to actuate the throttle valve 52 to adjust the amount of air supplied to the air intake path of the engine. The ignition coil 46 is arranged to raise a voltage applied to a spark plug (not shown). The spark plug is a device that is arranged to perform discharge inside a combustion chamber of the engine to ignite a mixed gas inside the combustion chamber. The shift actuator 49 is a device that is arranged to drive the shift mechanism 93 of the outboard motor. The fuel pump 50 is a device that is arranged to pump out fuel from a fuel tank (not shown) to supply the fuel to the injector 47. The oil pump 51 is a device that is arranged to circulate engine oil inside the engine.

The temperature sensor 41 is arranged to detect a temperature of cooling water of the engine. The hydraulic pressure sensor 42 is arranged to detect a pressure of the engine oil. The engine speed sensor 43 is arranged to detect the rotational speed of the engine. The shift position sensor 44 is arranged to detect the shift position of the shift mechanism 93 (shift position of the outboard motor).

The computer of the remote controller ECU 10 executes a program to perform functions as a plurality of function processing portions. The function processing portions include an electric power supply control unit, a start/stop control unit, an association changing unit, and a target value computing unit.

Functions of the remote controller ECU 10 as the electric power supply control unit include performing of on/off control of the electric power supplies of the respective outboard motors 3 based on operation signals from the respective switches on the operation panel 8. Functions of the remote controller ECU 10 as the start/stop control unit include performing of start/stop control of the engines of the respective outboard motors 3 based on operation signals from the respective switches on the operation panel 8. Functions of the remote controller ECU 10 as the association changing unit include changing of association or correspondence of the levers 71 and the outboard motors 3. Functions of the remote controller ECU 10 as the target value computing unit include computing of target shift positions and target engine speeds of the respective outboard motors 3 based on the association of the levers 71 and the outboard motors 3 as well as outputs of the lever position sensors 11P and 11S. These functions shall now be described in detail.

Details of the functions of the remote controller ECU 10 as the electric power supply control unit are as follows. When the key switch 81 is operated from the off position to the on position, the remote controller ECU 10 turns on the electric power supplies of all outboard motor ECUs 30 all at once and turns on all lamps 83. Also, when the key switch 81 is operated from the on position to the off position, the remote controller ECU 10 turns off the electric power supplies of all outboard motors 3 all at once and turn off all lamps 83.

Details of the functions of the remote controller ECU 10 as the start/stop control unit are as follows. When the key switch 81 is operated from the on position to the start position, the remote controller ECU 10 outputs an engine start command to each outboard motor ECU 30 under a condition that starting allowing conditions are met. The starting allowing conditions may include that the target shift position of the outboard motor 3 is the neutral position and that the actual shift position of the outboard motor 3 is the neutral position. Information on the actual shift position of each outboard motor 3 is sent from each outboard motor ECU 30 to the remote controller ECU 10 via the bus 20.

When in a case where the key switch 81 is at the on position, a start/stop switch 82 is depressed, the remote controller ECU 10 judges whether the engine of the outboard motor 3 corresponding to the start/stop switch 82 is stopped or is running (in operation). If the engine of the corresponding outboard motor 3 is stopped, the remote controller ECU 10 outputs the engine start command to the outboard motor ECU 30 under the condition that the starting allowing conditions are met. If the engine of the corresponding outboard motor 3 is running, the remote controller ECU 10 outputs an engine stop command to the outboard motor ECU 30.

Upon receiving the engine start command, the outboard motor ECU 30 performs an engine starting process. In the engine starting process, the outboard motor ECU 30 drives the starter motor 45, the ignition coil 46, and the injector 47 to perform ignition control and fuel injection control to start the engine. On the other hand, upon receiving the engine stop command, the outboard motor ECU 30 performs the engine stopping process. In the engine stopping process, the outboard motor ECU 30 stops the fuel injection by the injector 47 and stops the ignition operation by the spark plug and thereby stops the engine.

Figure 5A:
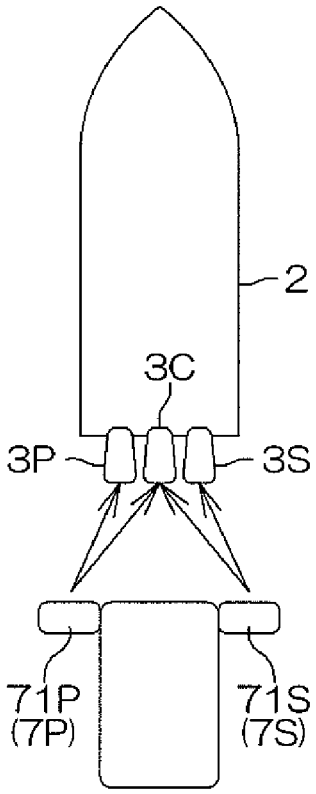
FIGS. 5A, 5B, and 5C are diagrams for explaining modes of association of levers and outboard motors.
Figure 5B:
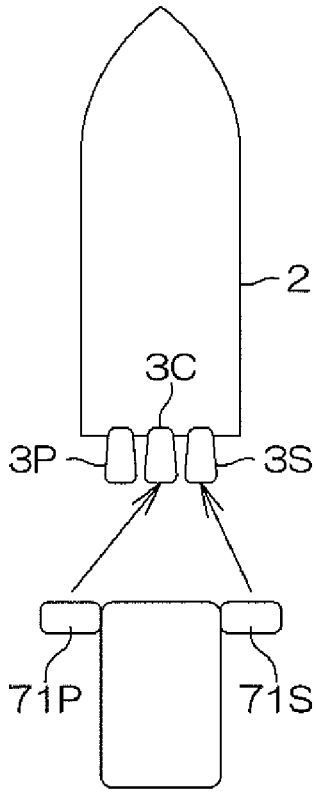
Figure 5C:
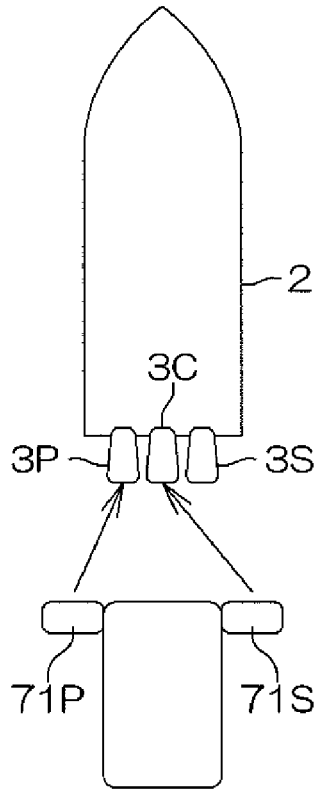

Details of the functions of the remote controller ECU 10 as the association changing unit shall now be described. In the present preferred embodiment, the remote controller ECU 10 has three modes in relation to the association of the two levers 71 and the three outboard motors 3 as shown in FIG. 5A, FIG. 5B, and FIG. 5C. These are a basic mode, a first modified mode, and a second modified mode.

In the basic mode, the port-side lever 71P is associated with the port-side outboard motor 3P, the starboard-side lever 71S is associated with the starboard-side outboard motor 3S, and both levers 71S and 71P are associated with the central outboard motor 3C as shown in FIG. 5A.

In the first modified mode, the port-side lever 71P is associated with the central outboard motor 3C and the starboard-side lever 71S is associated with the starboard-side outboard motor 3S as shown in FIG. 5B. In this case, neither of the levers 71 is associated with the port-side outboard motor 3P.

In the second modified mode, the port-side lever 71P is associated with the port-side outboard motor 3P and the starboard-side lever 71S is associated with the central outboard motor 3C as shown in FIG. 5C. In this case, neither of the levers 71 is associated with the starboard-side outboard motor 3S.

The functions of the remote controller ECU 10 as the association changing unit include a process (association mode switching process) for switching the mode of lever/outboard motor association (hereinafter referred to as the "association mode") among the three modes described above. Details of this process shall be described later.

Details of the functions of the remote controller ECU 10 as the target value computing unit shall now be described. The remote controller ECU 10 computes the target shift positions and the target engine speeds for the respective outboard motors 3 based on the presently set association mode and the output signals of the lever position sensors 11S and 11P, and transmits these target values to the corresponding outboard motor ECUs 30. Each outboard motor ECU 30 controls the shift position and the engine speed of the outboard motor based on the target shift position and the target engine speed transmitted from the remote controller ECU 10. Specifically, the outboard motor ECU 30 preferably controls the shift actuator 49 so that the shift position of the outboard motor 3 is at the target shift position and controls the throttle actuator 48 so that the engine speed is the target engine speed. Such control shall be referred to as "lever-following shift control." The "lever-following shift control" performed at the outboard motor ECU 30 shall be described in detail below.

When the association mode is the basic mode, the shift positions of the respective outboard motors 3 are controlled as follows. When the port-side lever 71P is inclined forward by no less than a predetermined amount from a predetermined neutral position, the shift position of the port-side outboard motor 3P is controlled to be at the forward drive position and a propulsive force in the forward drive direction is generated from the outboard motor 3P. The target engine speed is set at an idling engine speed up to the inclination position of the predetermined amount (forward drive shift-in position). When the port-side lever 71P is inclined forward beyond the forward drive shift-in position, the target engine speed is set to be greater the greater the lever inclination amount. When the port-side lever 71P is inclined in reverse by no less than a predetermined amount from the neutral position, the shift position of the port-side outboard motor 3P is controlled to be at the reverse drive position and a propulsive force in the reverse drive direction is generated from the outboard motor 3P. The target engine speed is set at the idling engine speed up to the inclination position of the predetermined amount (reverse drive shift-in position). When the port-side lever 71P is inclined in reverse beyond the reverse drive shift-in position, the target engine speed is set to be greater the greater the lever inclination amount. When the port-side lever 71P is at the neutral position (or to be more accurate, between the forward drive shift-in position and the reverse drive shift-in position), the shift position of the port-side outboard motor 3P is set at the neutral position and the outboard motor 3P does not generate a propulsive force.

When the starboard-side lever 71S is operated, the shift position and the engine speed of the starboard-side outboard motor 3S are controlled in the same manner as in the above-described control of the shift position and the engine speed of the port-side outboard motor 3P performed when the port-side lever 71P is operated.

Further, the shift position of the central outboard motor 3C is controlled as follows according to the operations of both levers 71P and 71S. That is, when the levers 71P and 71S are both inclined forward to no less than the forward drive shift-in positions from the neutral positions, the shift position of the central outboard motor 3C is controlled to be at the forward drive position and a propulsive force in the forward drive direction is generated from the central outboard motor 3C. When the levers 71P and 71S are both inclined in reverse to no less than the reverse drive shift-in positions from the neutral positions, the shift position of the central outboard motor 3C is controlled to be at the reverse drive position and a propulsive force in the reverse drive direction is generated from the central outboard motor 3C. The target engine speed is set to the idling engine speed if the inclination positions of both levers 71P and 71S are between the forward drive shift-in positions and the reverse drive shift-in positions. When the lever inclination positions are outside the ranges between the forward and reverse drive shift-in positions, the target engine speed is set according to the inclination amounts of both levers 71P and 71S. If at least one of either of the levers 71P and 71S is at the neutral position (or more accurately, a position between the forward drive shift-in position and the reverse drive shift-in position), the shift position of the central outboard motor 3C is controlled to be at the neutral position. The shift position of the central outboard motor 3C is also controlled to be at the neutral position when one of the levers is inclined forward from the neutral position (for example, inclined forward relative to the forward drive shift-in position) and the other lever is inclined in reverse from the neutral position (for example, inclined in reverse relative to the reverse drive shift-in position).

When the association mode is set to the first modified mode, the shift position and the engine speed of the starboard-side outboard motor 3S are controlled according to the operation position of the starboard-side lever 71S in the same manner as in the basic mode. The shift position of the central outboard motor 3C is controlled in accordance with the operation position of the port-side lever 71P. That is, when the port-side lever 71P is inclined forward to no less than the forward drive shift-in position from the neutral position, the shift position of the central outboard motor 3C is controlled to be at the forward drive position. When the port-side lever 71P is inclined in reverse to no less than the reverse drive shift-in position from the neutral position, the shift position of the central outboard motor 3C is controlled to be at the reverse drive position. When the port-side lever 71P is at the neutral position (or more accurately, a position between the forward drive shift-in position and the reverse drive shift-in position), the shift position of the central outboard motor 3C is controlled to be at the neutral position. When the inclination position of the port-side lever 71P is in the range between the forward drive shift-in position and the reverse drive shift-in position, the target engine speed is set at the idling engine speed, and outside this range, a target engine speed is set in accordance with the lever inclination amount. In the first modified mode, the shift position and the engine rotation speed of the port-side outboard motor 3P are not controlled according to operations of the levers 71.

When the association mode is set at the second modified mode, the shift position and the engine speed of the port-side outboard motor 3P are controlled according to the operation position of the port-side lever 71P in the same manner as in the basic mode. The shift position of the central outboard motor 3C is controlled in accordance with the operation position of the starboard-side lever 71S. That is, when the starboard-side lever 71S is inclined forward to no less than the forward drive shift-in position from the neutral position, the shift position of the central outboard motor 3C is controlled to be at the forward drive position. When the starboard-side lever 71S is inclined in reverse to no less than the reverse drive shift-in position from the neutral position, the shift position of the central outboard motor 3C is controlled to be at the reverse drive position. When the starboard-side lever 71S is at the neutral position (or more accurately, a position between the forward drive shift-in position and the reverse drive shift-in position), the shift position of the central outboard motor 3C is controlled to be at the neutral position. When the inclination position of the starboard-side lever 71S is in the range between the forward drive shift-in position and the reverse drive shift-in position, the target engine speed is set at the idling engine speed, and outside this range, a target engine speed is set in accordance with the lever inclination amount. In the second modified mode, the shift position and the engine rotation speed of the starboard-side outboard motor 3S are not controlled according to operations of the levers 71.

FIG. 6A to FIG. 6F are diagrams for explaining relationships between the respective lever positions and movements of the hull when the association mode is set to the basic mode.

Figures 6A, 6B, 6C, 6D, 6E, 6F:
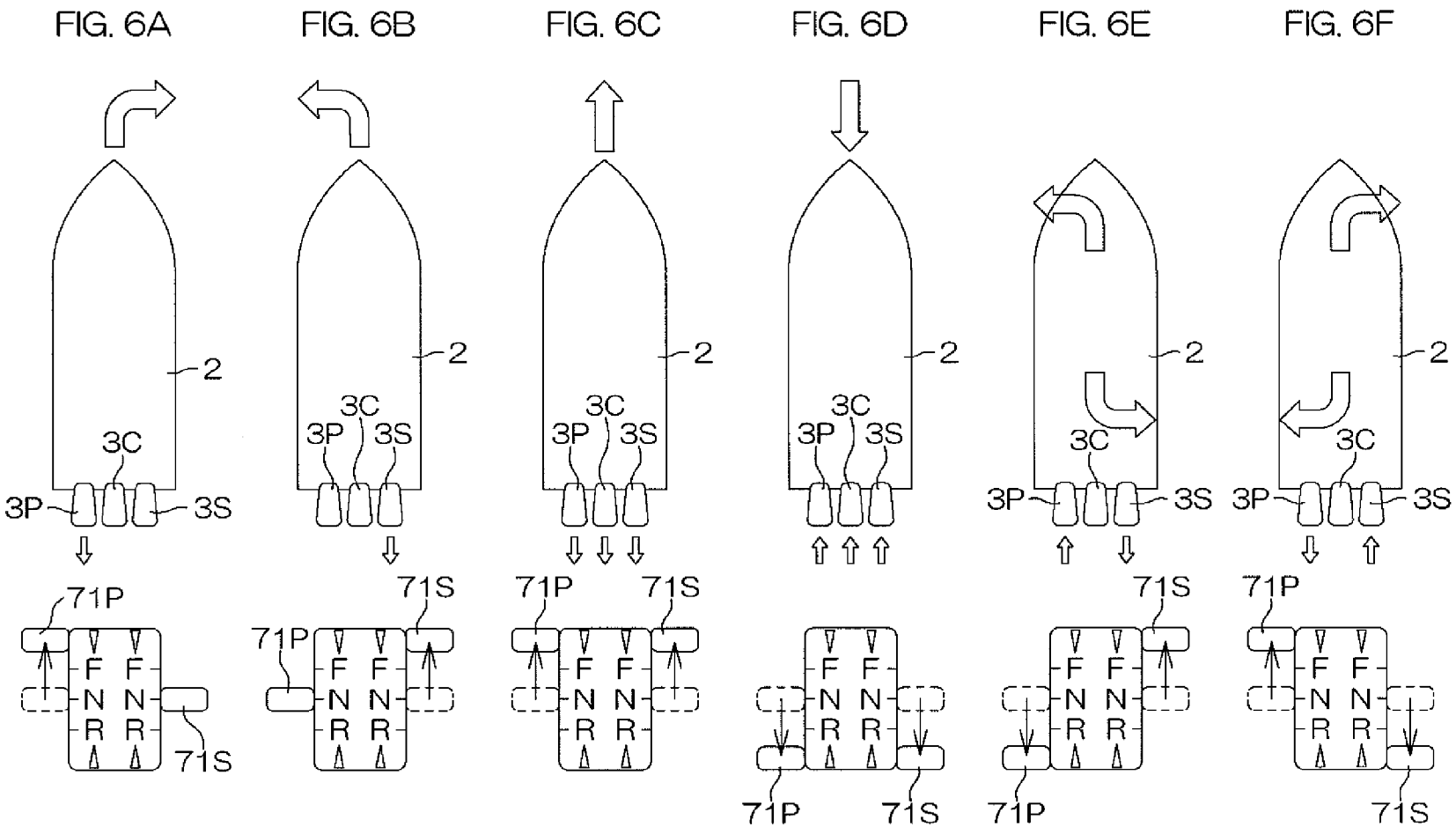
FIG. 6A to FIG. 6F are diagrams for explaining relationships between respective lever positions and movements of a hull when the lever/outboard motor association mode is set to a basic mode.

When, as shown in FIG. 6A, the port-side lever 71P is inclined forward (to an F side) beyond the forward drive shift-in position and the starboard-side lever 71S is at the neutral position, the shift position of the port-side outboard motor 3P is set at the forward drive position and the shift positions of the other outboard motors 3C and 3S are set at the neutral positions. The hull 2 thus receives only the forward drive direction propulsive force of the port-side outboard motor 3P and thus turns in the starboard direction.

When, as shown in FIG. 6B, the starboard-side lever 71S is inclined forward (to the F side) beyond the forward drive shift-in position and the port-side lever 71P is at the neutral position, the shift position of the starboard-side outboard motor 3S is set at the forward drive position and the shift positions of the other outboard motors 3P and 3C are set at the neutral positions. The hull 2 thus receives only the forward drive direction propulsive force of the starboard-side outboard motor 3S and thus turns in the port direction.

When, as shown in FIG. 6C, both levers 71S and 71P are inclined forward (to the F side) beyond the forward drive shift-in positions, the shift positions of all three outboard motors 3 are set at the forward drive positions. The hull 2 thus receives the forward drive direction propulsive forces of all three outboard motors 3 and thus moves forward.

When, as shown in FIG. 6D, both levers 71S and 7P are inclined in reverse (to an R side) beyond the reverse drive shift-in positions, the shift positions of all three outboard motors 3 are set at the reverse drive positions. The hull 2 thus receives the reverse drive direction propulsive forces of all three outboard motors 3 and thus moves in reverse.

FIG. 6E shows a state where the port-side lever 71P is inclined in reverse (to the R side) beyond the reverse drive shift-in position and the starboard-side lever 71S is inclined forward (to the F side) beyond the forward drive shift-in position. In this case, the shift position of the port-side outboard motor 3P is set at the reverse drive position, the shift position of the starboard-side outboard motor 3S is set at the forward drive position, and the shift position of the central outboard motor 3C is set at the neutral position. The hull 2 is thus turned in the port direction by the reverse drive direction propulsive force of the port-side outboard motor 3P and the forward drive direction propulsive force of the starboard-side outboard motor 3S.

FIG. 6F shows a state where the port-side lever 71P is inclined forward (to the F side) beyond the forward drive shift-in position and the starboard-side lever 71S is inclined in reverse (to the R side) beyond the reverse drive shift-in position. In this case, the shift position of the port-side outboard motor 3P is set at the forward drive position, the shift position of the starboard-side outboard motor 3S is set at the reverse drive position, and the shift position of the central outboard motor 3C is set at the neutral position. The hull 2 is thus turned in the starboard direction by the forward drive direction propulsive force of the port-side outboard motor 3P and the reverse drive direction propulsive force of the starboard-side outboard motor 3S.

The computer of each outboard motor ECU 30 executes programs to perform functions as a plurality of function processing units. The function processing units include an engine starting process unit, an engine stopping process unit, and a shift control unit. A function of the outboard motor ECU 30 as the engine starting process unit is to perform the engine starting process. Functions of the outboard motor ECU 30 as the engine stopping process unit include the engine stopping process.

Functions of the outboard motor ECU 30 as the shift control unit include making an entrained rotation judgment at every predetermined time and performing shift control in accordance with the judgment result. In the present preferred embodiment, "entrained rotation" refers to a phenomenon where the crankshaft of the engine of an outboard motor 3, which is stopped or should be stopped, rotates upon receiving of a force from water in accompaniment with the traveling of the marine vessel.

Figure 7:
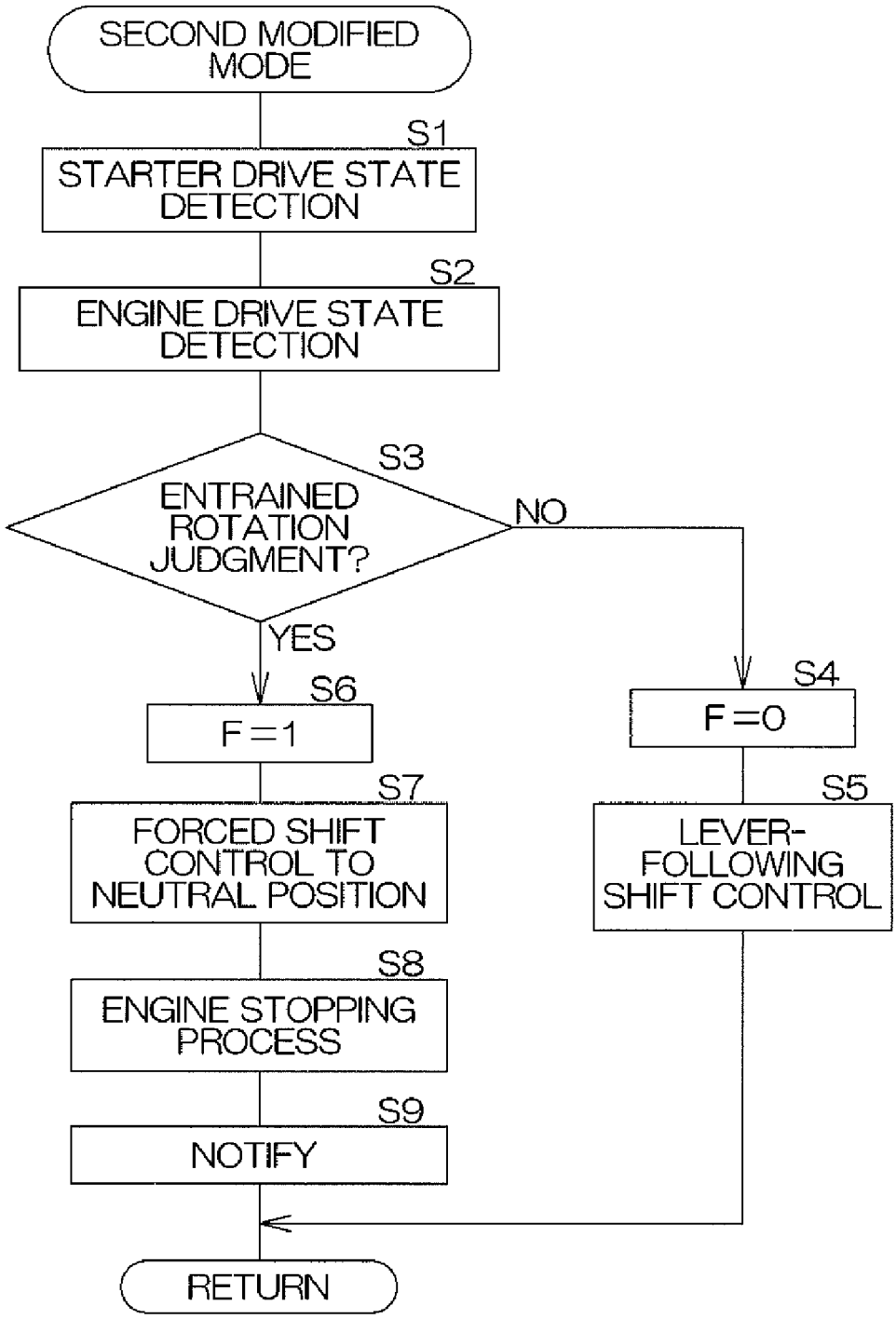
FIG. 7 is a flowchart of procedures of a shift control process executed by an outboard motor ECU.

FIG. 7 is a flowchart of procedures of the shift control process executed by the outboard motor ECU 30. This shift control process is performed repeatedly at every predetermined control cycle.

First, the outboard motor ECU 30 judges a drive state of the starter motor 45 and stores the judgment result (driven or not driven) in a memory (not illustrated) provided in the outboard motor ECU 30 (step S1). A predetermined number of previous judgment results, including the presently obtained judgment result of the drive state of the starter motor, are stored as history information in the memory. Also, the outboard motor ECU 30 acquires the engine speed (information expressing an engine drive state) from the engine speed sensor 43 and stores it in the memory (step S2). A predetermined number of previous engine speeds, including the presently acquired engine speed, are stored as history information in the memory.

The outboard motor ECU 30 then makes the entrained rotation judgment based on the history information of the starter motor drive state judgment results and the engine speeds stored in the memory (step S33). Specifically, the outboard motor ECU 30 judges that entrained rotation is occurring in the engine of the corresponding outboard motor 3 when one of either of the following conditions (i) and (ii) is met:

(i) From a state in which the rotation of the engine was stopped, the driving shaft (for example, the crankshaft) of the engine has rotated with the starter motor 45 not being driven.

(ii) Rotation of the driving shaft of the engine does not stop within a fixed time despite the engine stopping process being started on the engine that was in the running state.

If the outboard motor ECU 30 judges that entrained rotation is not occurring in the corresponding outboard motor 3 (step S3: NO), it resets a flag F (F=0) (step S4) and thereafter performs the "lever-following shift control" described above (step S5). The present process is then ended.

The flag F is a flag that stores which of the controls among the "lever-following shift control" and a "forced shift control to the neutral position" is being performed on the corresponding outboard motor 3. The "forced shift control to the neutral position" is a control by which the shift position of the corresponding outboard motor 3 is set forcibly to the neutral position regardless of the positions of the levers 71.

In an initializing process during starting of the outboard motor ECU 30, the flag F is reset (F=0). Three flags F are respectively provided in correspondence to the three outboard motors 3. When these are to be distinguished, the flag corresponding to the port-side outboard motor 3P shall be indicated as "FP," the flag corresponding to the starboard-side outboard motor 3S shall be indicated as "FS," and the flag corresponding to the central outboard motor 3C shall be indicated as "FC."

When in step S3, it is judged that entrained rotation is occurring in the engine of the outboard motor 3 (step S3: YES), the outboard motor ECU 30 sets the flag F to 1 (F=1) (step S6) and performs the "forced shift control to the neutral position" (step S7). By performing the "forced shift control to the neutral position," the transmission of power between the engine and the propeller of the corresponding outboard motor 3 is cut off. When the "forced shift control to the neutral position" is performed, the shift position of the outboard motor 3 is not switched even when the levers 71 are operated. That is, during execution of the "forced shift control to the neutral position," the outboard motor ECU 30 invalidates the target shift position transmitted from the remote controller ECU 10.

At the same time as or after performing the "forced shift control to the neutral position" in step S7, the outboard motor ECU 30 performs the engine stopping process to stop the driving of the engine of the corresponding outboard motor 3 (step S8). When it is judged in the step S3 that entrained rotation is occurring, there is a possibility for the engine of the corresponding outboard motor 3 to be started by the cranking due to the entrained rotation. Also, even if the engine of the corresponding outboard motor 3 is not being driven at the point at which it is judged that entrained rotation is occurring, the engine may start in an interval until the transmission of power between the engine and the propeller is cut off by the "forced shift control to the neutral position" (step S7).

Thus, in the present preferred embodiment, the engine stopping process is performed at the same time as or after performing the "forced shift control to the neutral position" in step S7. In the engine stopping process, the outboard motor ECU 30 stops the fuel injection by the injector 47 and stops the ignition operation by the spark plug to stop the engine. Thus, even if the engine is being driven when the transmission of the power between the engine and the propeller is cut off by the "forced shift control to the neutral position," the engine can be stopped reliably.

In step S8, the outboard motor ECU 30 may first judge whether or not the engine of the corresponding outboard motor 3 is being driven and then perform the engine stopping process only when it is judged that the engine is being driven. The judgment of whether or not the engine is being driven is made based, for example, on the engine speed detected by the engine speed sensor 43.

During execution of the "forced shift control to the neutral position" in step S7, the outboard motor ECU 30 notifies this (step S9). Specifically, the outboard motor ECU 30 displays on the corresponding gauge 9 that the shift position of the corresponding outboard motor 3 is forcibly maintained at the neutral position by the "forced shift control to the neutral position." When the "forced shift control to the neutral position" is being performed, the shift position of the outboard motor 3 cannot be switched even if the user operates the levers 71. The user may thus mistake that a fault is occurring in the remote controller 7 or the shift mechanism of the outboard motor 3. When the "forced shift control to the neutral position" is being performed, this is notified to the user in the present preferred embodiment to prevent such a mistake.

FIGS. 8A-8D are diagrams for specifically explaining the shift control process executed by the outboard motor ECU 30.

Figures 8A, 8B, 8C, 8D:
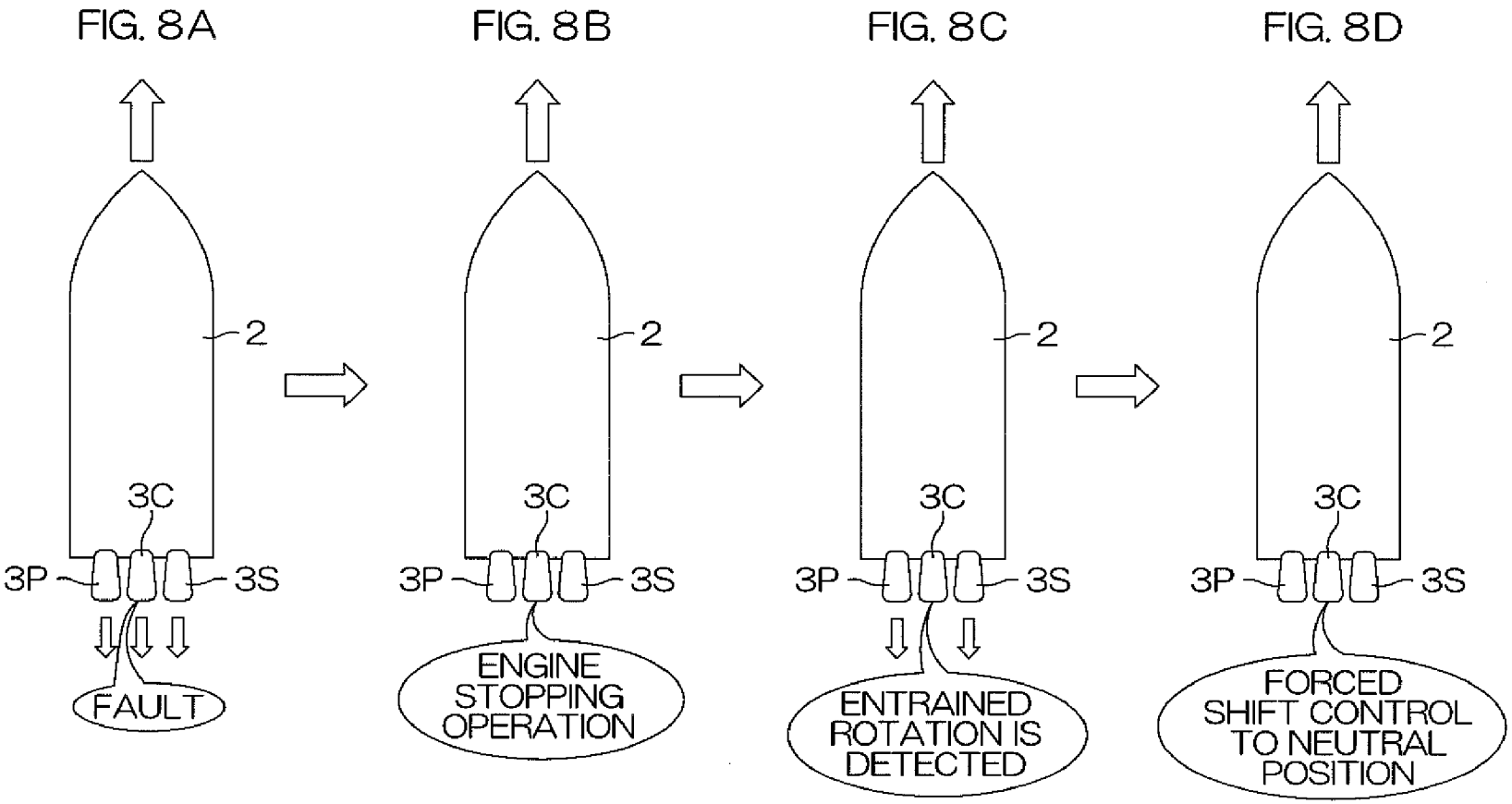
FIGS. 8A-8D are diagrams for specifically explaining the shift control process executed by the outboard motor ECU.

Here, a case shall be assumed where a fault occurs in the engine of the central outboard motor 3C when all three outboard motors 3 are generating propulsive forces in the forward drive direction and the hull 2 is thereby being driven forward as shown in FIG. 8A.

In this case, the user performs an operation (engine stopping operation) for stopping the engine of the central outboard motor 3C in which the fault has occurred as shown in FIG. 8B. That is, the user depresses the start/stop switch 82C corresponding to the central outboard motor 3C.

In response to the engine stopping operation, the outboard motor ECU 30C corresponding to the central outboard motor 3C performs the engine stopping process. During traveling of the marine vessel, a water stream relative to the propeller of the central outboard motor 3C is generated in the vicinity of the propeller. Thus, even if the engine is not generating a driving force, the propeller is rotated by the force received from the water stream. If, at this time, the shift position of the central outboard motor 3C is the forward drive position or the reverse drive position, the rotation of the propeller is transmitted to the engine and the crankshaft is thereby rotated. That is, entrained rotation occurs.

If, despite the engine stopping process being started, the engine does not stop within a fixed time, the outboard motor ECU 30 judges that entrained rotation is occurring in the engine as shown in FIG. 8C. If the shift position during the engine stopping process is the neutral position, the rotation of the engine is stopped. However, if the shift position is changed to the forward drive position or the reverse drive position thereafter, entrained rotation of the engine occurs. Thus, if after the engine is put in the stopped state by the engine stopping process, the engine is put in a rotating state with the starter motor 45 not being driven, the outboard motor ECU 30 likewise judges that entrained rotation is occurring in the engine (FIG. 8C). Entrained rotation detection by the outboard motor ECU 30C is thus executed.

Even if a fault is not occurring in any of the outboard motors, there is a possibility for the phenomenon of entrained rotation to occur in a case where a specific outboard motor is in a driving-stopped state and its electric power supply is on. For example, even in a state where a fault is not occurring in any of the outboard motors, the user may stop a portion of the outboard motors to perform trolling travel at low speed or to reduce the number of outboard motors in the running state for the purpose of reducing fuel consumption when a remaining fuel amount is low. Entrained rotation may occur in such a case as well. As in the above described case of a fault, the outboard motor ECU 30 judges that entrained rotation is occurring in such a case as well.

Upon detecting the entrained rotation, the outboard motor ECU 30C executes the "forced shift control to the neutral position," and controls the shift position of the engine of the central outboard motor 3C to be at the neutral position as shown in FIG. 8D. That is, the shift position of the central outboard motor 3C is maintained at the neutral position regardless of the lever position. Thus, when the entrained rotation of the engine is detected, the shift position of the outboard motor that includes the engine is forcibly set at the neutral position. The inability to stop an engine that should be stopped or the starting of an engine in a stopped state can be prevented thereby.

If, in the state where the "forced shift control to the neutral position" is being performed in response to the detection of entrained rotation, the entrained rotation in the engine of the central outboard motor 3C becomes undetectable, the "lever-following shift control" is performed (see steps S3, S4, and S5 in FIG. 7).

Figure 9:
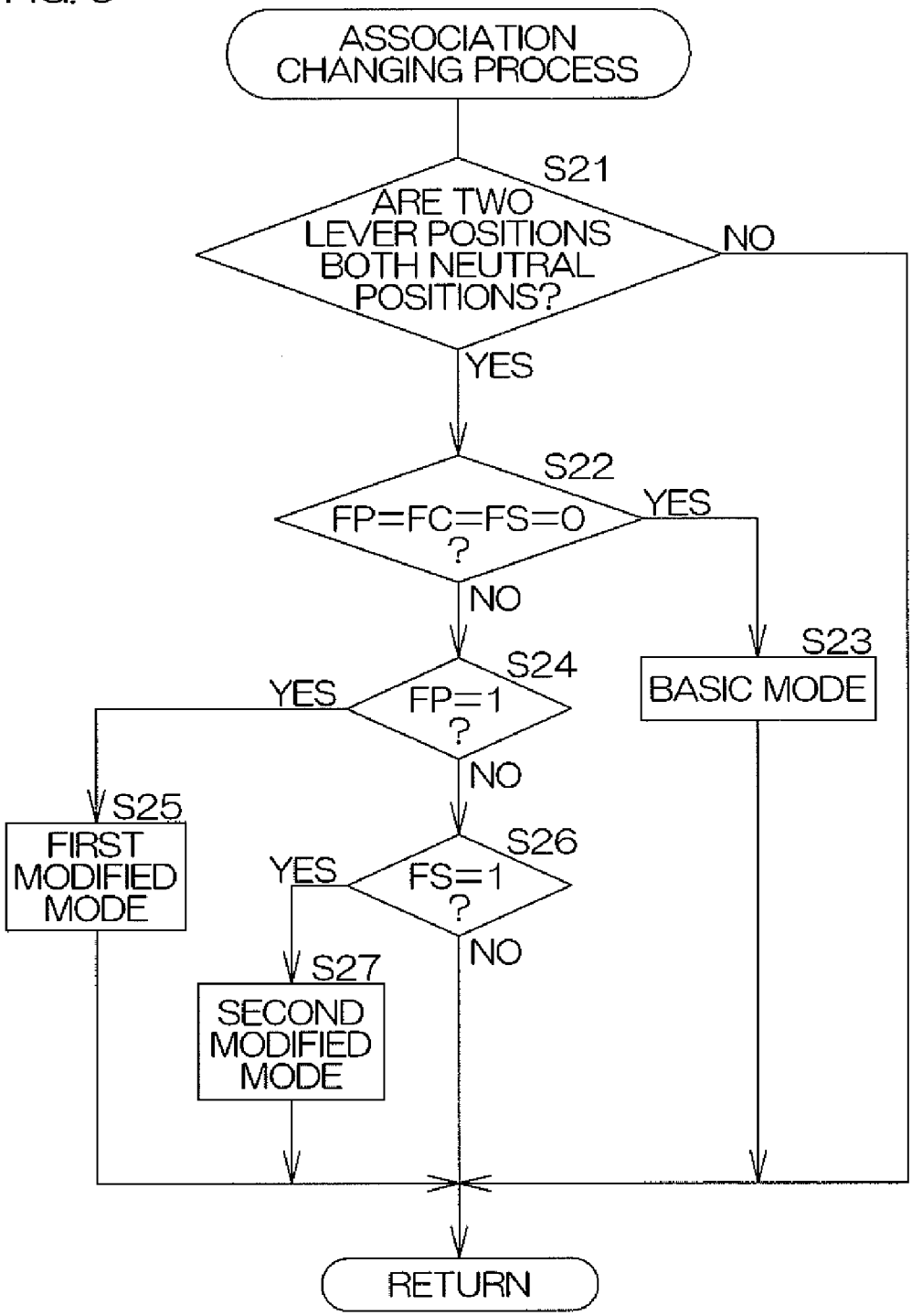
FIG. 9 is a diagram for explaining procedures of a lever/outboard motor association switching control process executed by a remote controller ECU.

FIG. 9 is a diagram for explaining procedures of the association mode switching process executed by the remote controller ECU 10. This process is performed repeatedly at every predetermined control cycle.

The remote controller ECU 10 judges whether or not the lever positions of the two levers 71S and 71P are both at the neutral positions (step S21). If the lever position of at least one of the two levers 71S and 71P is not at the neutral position (step S21: NO), the present process is ended.

If it is judged in step S21 that the lever positions of the two levers 71S and 71P are both at the neutral positions (step S21: YES), the remote controller ECU 10 judges whether or not all of the flags FP, FC, and FS, corresponding to the respective outboard motors 3P, 3C, and 3S, are reset (FP=FC=FS=0) (step S22). The case where all of the flags FP, FC, and FS are reset is a case where the "lever-following shift control" is being performed on all of the outboard motors 3. In this case, the remote controller ECU 10 sets the association mode to the basic mode (FIG. 5A) (step S23). The present process is then ended.

If in step S22, it is judged that not all of the flags FP, FC, and FS are in the reset state (step S22: NO), the remote controller ECU 10 judges whether or not the flag FP corresponding to the port-side outboard motor 3P is set to 1 (step S24). The case where the flag FP is set to 1 (step S24: YES) is a case where the "forced shift control to the neutral position" is being performed on the port-side outboard motor 3P. In this case, the remote controller ECU 10 sets the association mode to the first modified mode (FIG. 5B) (step S25). It thereby becomes possible to select the shift position of the central outboard motor 3C by operation of just the port-side lever 71P and to select the shift position of the starboard-side outboard motor 3S by operation of just the starboard-side lever 71S. Maneuvering of the hull 2 by the two outboard motors 3C and 3S is thus made easy. That is, in the basic mode (FIG. 5A), both the starboard-side and port-side levers 71P and 71S must be operated to the forward drive position or the reverse drive position to set the shift position of the central outboard motor 3C at the forward drive position or the reverse drive position. Marine vessel maneuvering after stopping of the engine of the port-side outboard motor 3P is thus not necessarily easy.

Marine vessel maneuvering is thus made easy by associating the levers 71P and 71S with the outboard motors 3C and 3S, respectively, in accordance with the first modified mode. After the process of step S25, the present process is ended.

If in step S24, the flag FP is not set to 1, the remote controller ECU 10 judges whether or not the flag FS corresponding to the starboard-side outboard motor 3S is set to 1 (step S26). A case where the flag FS is set to 1 (step S26: YES) is a case where the "forced shift control to the neutral position" is being performed on the starboard-side outboard motor 3S. In this case, the remote controller ECU 10 sets the association mode to the second modified mode (FIG. 5C) (step S27). It thereby becomes possible to select the shift position of the central outboard motor 3C by operation of just the starboard-side lever 71S and to select the shift position of the port-side outboard motor 3P by operation of just the port-side lever 71P. Maneuvering of the hull 2 by the two outboard motors 3P and 3C is thus made easy. After the process of step S27, the present process is ended.

If in step S26 described above, the flag FS is not set to 1 (step S26: NO), the remote controller ECU 10 ends the present process without changing the association mode.

FIGS. 10A-10D are diagrams for explaining a specific example of changing the association mode of the levers and the outboard motors.

Figure 10A:
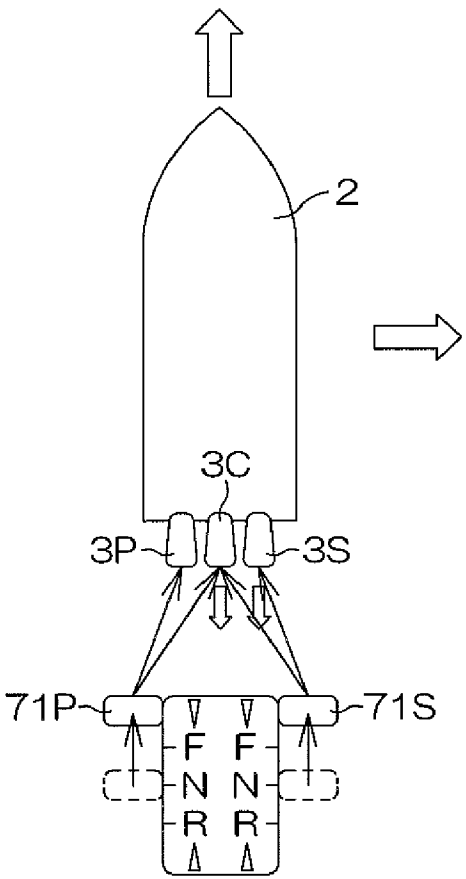
FIGS. 10A-10D are diagrams for explaining a specific example of changing an association mode of the levers and the outboard motors.

Here, a case shall be assumed where a fault occurs in the engine of the port-side outboard motor 3P when the hull 2 is undergoing forward drive by the forward drive direction propulsive forces of the engines of the three outboard motors 3 with the association mode of the levers and the outboard motors being the basic mode as shown in FIG. 10A. In such a case, the user operates the start/stop switch 82P to stop the engine of the port-side outboard motor 3P in which the fault has occurred. If after the engine of the port-side outboard motor 3P is stopped, the crankshaft of the engine rotates due to entrained rotation, the outboard motor ECU 30P judges that entrained rotation is occurring in the engine. That is, the outboard motor ECU 30P detects the entrained rotation.

Figure 10B:
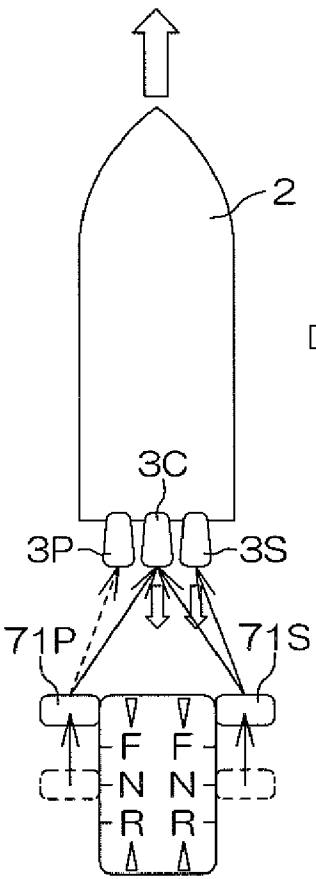

Upon detecting the entrained rotation, the outboard motor ECU 30P performs the "forced shift control to the neutral position" on the port-side outboard motor 3P as shown in FIG. 10B. The shift position of the engine of the port-side outboard motor 3P is thereby forcibly set at the neutral position. In this case, the flag FP is set to 1 (FP=1).

Figure 10C:
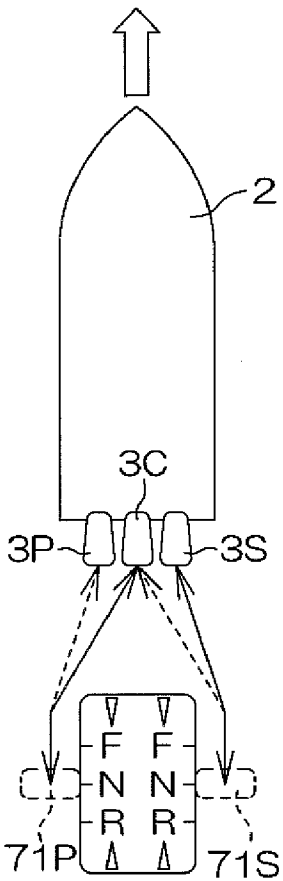

When both levers 71P and 71S are thereafter returned to the neutral positions as shown in FIG. 10C, a negative judgment is made in step S22 and a positive judgment is made in step S24 of FIG. 9 because the flag is FP=1. The association mode of the levers and the outboard motors is thus set to the first modified mode (step S25 of FIG. 9). That is, the port-side lever 71P is associated with the central outboard motor 3C, and the starboard-side lever 71S is associated with the starboard-side outboard motor 3S.

Figure 10D:
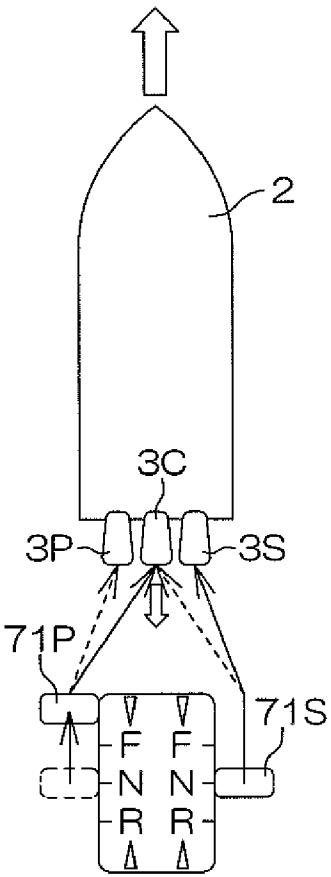

Thus, in this state, even if just the port-side lever 71P is inclined forward beyond the forward drive shift-in position, the shift position of the central outboard motor 3C is switched to the forward drive position and the hull 2 is driven forward as shown in FIG. 10D.

Figure 11:
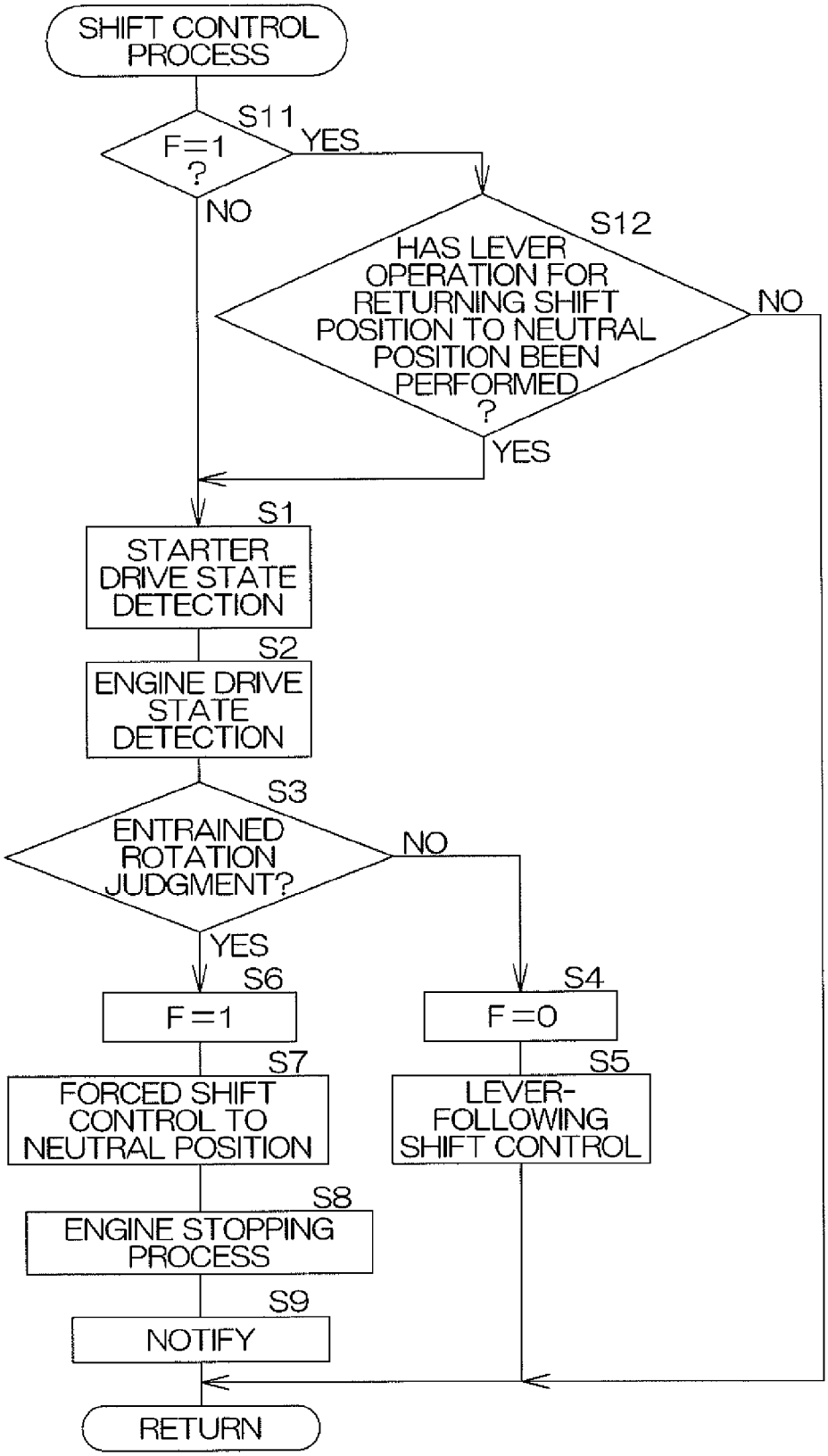
FIG. 11 is a flowchart of a modification example of a shift control process executed by the outboard motor ECU.

FIG. 11 is a flowchart of a modification example of the shift control process executed by the outboard motor ECU 30.

The processes of steps S1 to S9 of FIG. 11 are preferably the same as the processes of steps S1 to S9 in FIG. 7. In the shift control process of FIG. 11, the processes of step S11 and step S12 are added to the shift control process of FIG. 7.

That is, in the shift control process of FIG. 11, the outboard motor ECU 30 first judges whether or not the flag F corresponding to the outboard motor ECU 30 is set to 1 (step S11). If the flag F is not set to 1 (F=0), the outboard motor ECU 30 enters step S1 and performs the processes from step S1 onward.

On the other hand, if in step S11 described above, the flag F is set to 1 (F=1), it is judged whether or not a lever operation for returning the shift position of the outboard motor 3 to the neutral position is performed (step S12). Specifically, this judgment is made by judging whether or not the target shift position of the outboard motor 3 is the neutral position. As described above, the target shift position of the outboard motor 3 is determined by the remote controller ECU 10 in accordance with the lever/outboard motor association mode and the operation positions of the levers 71.

If the target shift position of the outboard motor 3 is the neutral position, the outboard motor ECU 30 judges that the lever operation for returning the shift position of the outboard motor 3 to the neutral position is performed. On the other hand, if the target shift position of the outboard motor 3 is not the neutral position, the outboard motor ECU 30 judges that the lever operation for returning the shift position of the outboard motor 3 to the neutral position is not performed.

If the outboard motor ECU 30 judges that the lever operation for returning the shift position of the outboard motor 3 to the neutral position is not performed (step S12: NO), the present process is ended without performing the processes of step S1 to step S9. On the other hand, if the outboard motor ECU 30 judges that the lever operation for returning the shift position of the outboard motor 3 to the neutral position is performed (step S12: YES), step S1 is entered and the processes from step S1 onward are performed.

That is, in the present modification example, in the case where the shift position of the outboard motor 3 is forcibly controlled to be at the neutral position, the shift position is maintained at the neutral position until the lever operation for returning the shift position of the outboard motor 3 to the neutral position is performed.

Here, for example, it shall be assumed that the engine of one outboard motor 3 is stopped due to a fault occurring in the outboard motor 3 during traveling of the marine vessel. When entrained rotation thereafter occurs in the stopped engine and this is detected, the shift position of the corresponding outboard motor 3 is forcibly set to the neutral position by the "forced shift control to the neutral position." When the shift position of the outboard motor 3 is forcibly set to the neutral position, entrained rotation of the engine of the outboard motor 3 no longer occurs.

When entrained rotation of the engine of the outboard motor 3 no longer occurs, the "lever-following shift control" is performed in the shift control process shown in FIG. 7 (see step S5). That is, depending on subsequent lever operation, the shift position of the outboard motor 3 may be switched to the forward drive position or the reverse drive position, and there is thus a possibility of entrained rotation occurring in the engine again. There is thus a possibility that the "forced shift control to the neutral position" and the "lever-following shift control" are repeated alternately on the outboard motor 3. In such circumstances, an operation of shifting in and an operation of shifting out are repeated alternately and wasteful switching of the shift position is performed frequently. With the modification example shown in FIG. 11, performing of such wasteful switching of the shift position can be prevented.

Figure 12:
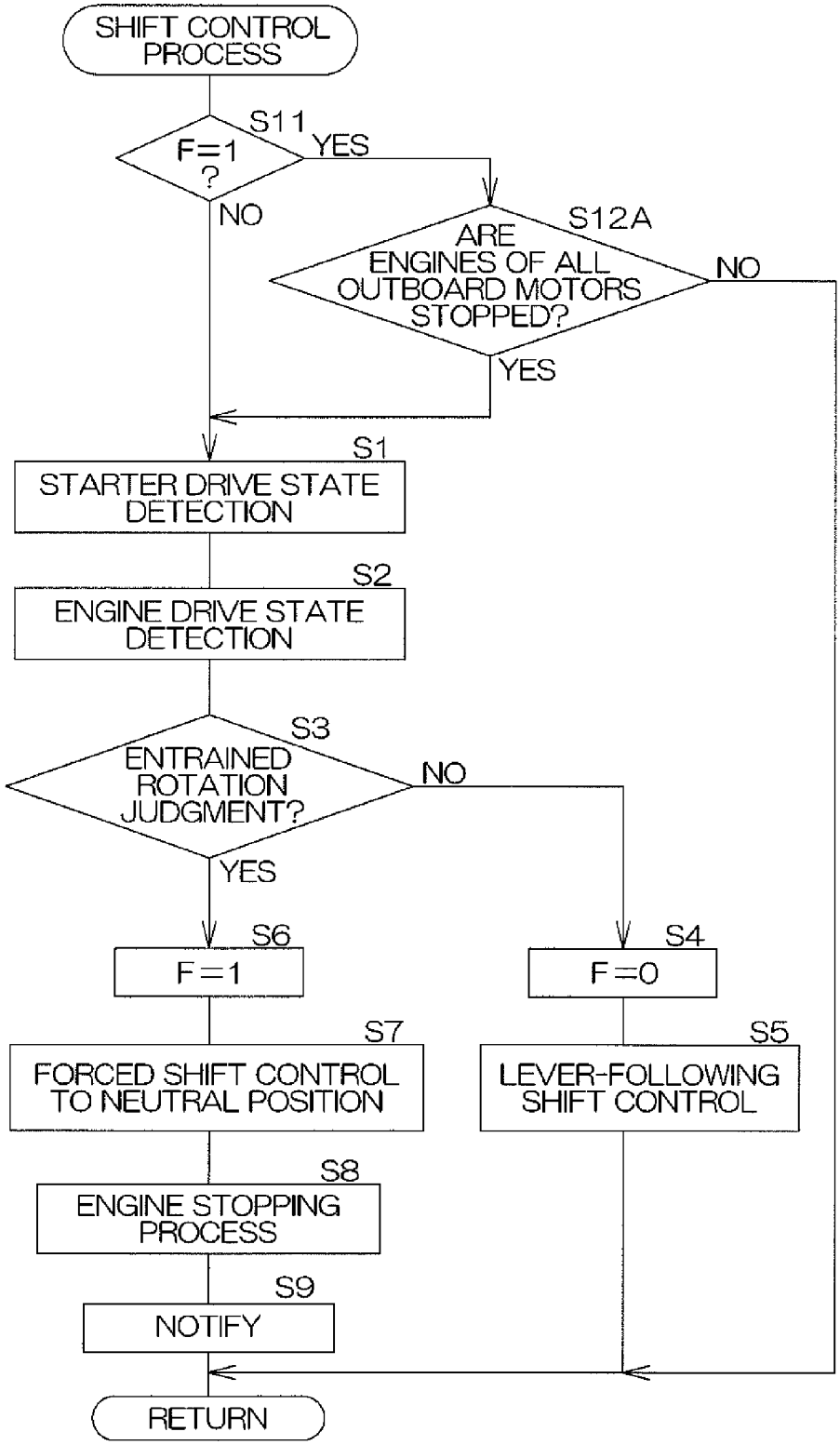
FIG. 12 is a flowchart of another modification example of a shift control process executed by the outboard motor ECU.

If the shift position of the outboard motor 3 is forcibly switched to the neutral position by the "forced shift control to the neutral position" (step S7), the shift position of the outboard motor 3 may be maintained at the neutral position until the engines of all outboard motors 3 stop. In this case, in place of step S12 in FIG. 11, the outboard motor ECU 30 is made to judge whether or not the engines of all of the outboard motors 3 are stopped as shown in FIG. 12 (step S12A). In this case, the outboard motor ECU 30 ends the present process if the engine of at least one of the outboard motors 3 is running, and enters the process of step S1 if the engines of all of the outboard motors 3 are stopped.

Figure 13:
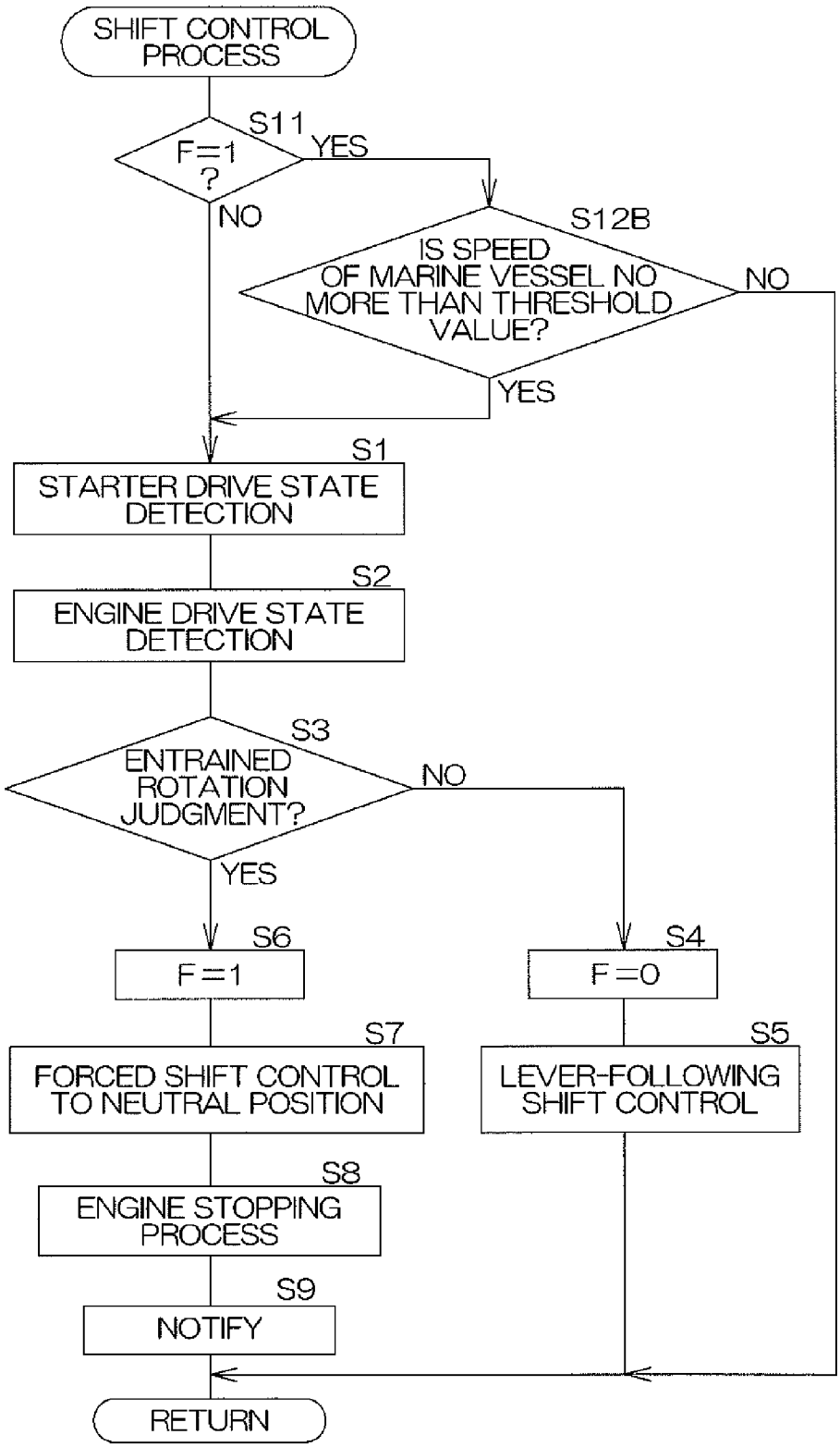
FIG. 13 is a flowchart of yet another modification example of a shift control process executed by the outboard motor ECU.

Also, as shown in FIG. 4, the speed sensor 12 for detecting the speed of the marine vessel may be provided, and maintaining or cancellation of the "forced shift control to the neutral position" may be performed based on the speed of the marine vessel. That is, if the shift position of the outboard motor 3 is forcibly switched to the neutral position by the "forced shift control to the neutral position" (step S7), the shift position of the outboard motor 3 may be maintained at the neutral position until the speed of the marine vessel becomes no more than a predetermined threshold value. In this case, in place of step S12 in FIG. 11, the outboard motor ECU 30 is made to judge whether or not the speed of the marine vessel detected by the speed sensor 12 is no more than the predetermined threshold value as shown in FIG. 13 (step S12B). In this case, the outboard motor ECU 30 ends the present process if the speed of the marine vessel exceeds the predetermined threshold value, and enters the process of step S1 if the speed of the marine vessel is no more than the predetermined threshold value.

Yet further, a docking detection unit that detects that the marine vessel is docked may be provided, and the maintaining or cancellation of the "forced shift control to the neutral position" may be performed based on the docking detection result. That is, if the shift position of the outboard motor 3 is forcibly switched to the neutral position by the "forced shift control to the neutral position" (step S7), the shift position of the outboard motor 3 may be held at the neutral position until it is detected that the marine vessel is docked.

As the docking detection unit, for example, an arrangement that uses a navigation apparatus to detect that the marine vessel is docked at a scheduled docking position set in advance may be used. Also, a docking detection unit with an arrangement that is arranged to measure a distance to a scheduled docking position by a laser and detect that the marine vessel is docked when the distance becomes no more than a predetermined value may be used. Further, a docking detection unit with an arrangement that detects that the marine vessel is docked based on an output of a proximity sensor that is arranged to detect that the marine vessel has approached the scheduled docking position may be used. The proximity sensor may be arranged to detect contact with, for example, a quay, a pier, another marine vessel, or other target of berthing.

Figure 14:
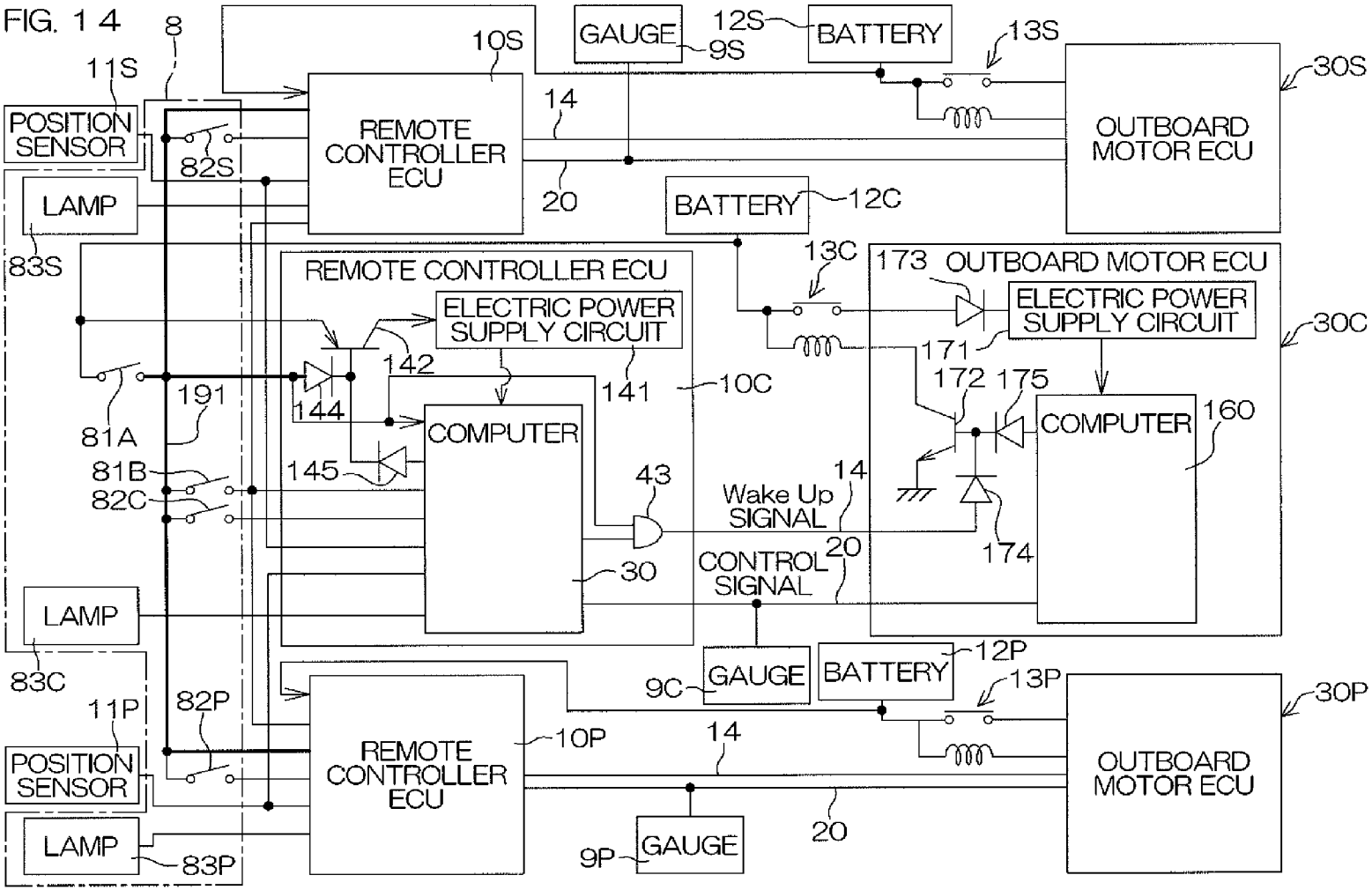
FIG. 14 is a diagram for explaining an electrical arrangement related to electric power supply control and engine start/stop control of the marine vessel.

FIG. 14 is a diagram for explaining an electrical arrangement related to electric power supply control and start/stop control of the outboard motors of the marine vessel 1.

The three remote controller ECUs (electronic control units) 10S, 10C, and 10P are provided in respective correspondence to the three remote controllers 7S, 7C, and 7P. That is, the remote controller ECU 10S corresponding to the starboard-side remote controller 7S, the remote controller ECU 10C corresponding to the central remote controller 7C, and the remote controller ECU 10P corresponding to the port-side remote controller 7P are included. The remote controller ECUs 10S, 10C, and 10P are referred to collectively as the "remote controller ECUs 10."

Three batteries 12S, 12C, and 12P and three electric power supply relays 13S, 13C, and 13P are provided in respective correspondence to the three outboard motors 3S, 3C, and 3P. That is, the battery 12S and the electric power supply relay 13S corresponding to the starboard-side outboard motor 3S, the battery 12C and the electric power supply relay 13C corresponding to the central outboard motor 3C, and the battery 12P and the electric power supply relay 13P corresponding to the port-side outboard motor 3P are included. In the following description, the batteries 12S, 12C, and 12P shall be referred to collectively as the "batteries 12" and the electric power supply relays 13S, 13C, and 13P shall be referred to collectively as the "electric power supply relays 13."

In terms of arrangement, each of the outboard motor ECUs 30S, 30C, and 30P is a motor control unit that controls an engine 69 as the motor. These are the same in arrangement, and the outboard motor ECU 30C, corresponding to the central outboard motor 3C, shall mainly be described. The outboard motor ECUs 30S, 30C, and 30P shall be referred to collectively as the "outboard motor ECUs 30."

The outboard motor ECU 30C includes a computer (microcomputer) 160, an electric power supply circuit 171, a switching transistor 172, and a plurality of reverse current blocking diodes 173, 174, and 175. The electric power supply circuit 171 is arranged to generate electric power supply voltages necessary for the computer 160 and electric components inside the outboard motor 3C including outboard motor ECU 30C.

The battery 12C is connected to the electric power supply circuit 171 via the electric power supply relay 13C and the diode 173 inside the outboard motor ECU 30C. When the electric power supply relay 13C conducts, electric power is supplied from the battery 12C to the electric power supply circuit 171 inside the outboard motor ECU 30C. One end of a coil of the electric power supply relay 13C is connected to the battery 12C and the other end is grounded via the switching transistor 172.

A base of the switching transistor 172 is connected to the corresponding remote controller ECU 10C via the diode 174 and an electric signal line 14. The base of the switching transistor 172 is further connected to the computer 160 via the diode 175. When the switching transistor 172 turns on, the electric power supply relay 13C is put in the conducting state. The switching transistor 172 is put in the on state when a wake-up signal, transmitted to the base thereof from the corresponding remote controller ECU 10C via the electric signal line 14, is set to an H level or when a self-holding output, transmitted to the base thereof from the computer 160, is set to the H level.

The remote controller ECU 10C corresponding to the central remote controller 7C shall mainly be described below because the arrangements of the respective remote controller ECUs 10S, 10C, and 10P are substantially the same.

The remote controller ECU 10C includes a computer (microcomputer) 130, an electric power supply circuit 141, a switching transistor 142, a gate 143, and a plurality of reverse blocking diodes 144 and 145. The electric power supply circuit 141 is arranged to generate electric power supply voltages for the computer 130 and for peripheral equipments connected to the computer 130. The electric power supply circuit 141 is connected via the switching transistor 142 to the corresponding battery 12C. When the switching transistor 142 turns on, electric power is supplied from the battery 12C to the electric power supply circuit 141.

The operation panel 8 includes a common electric power supply switch 81A and a common start switch 81B that are arranged to be actuated in response to operation of the key switch 81.

The common electric power supply switch 81A is a switch that is turned on when the key switch 81 (see FIG. 2) is operated to the on position. One end of the common electric power supply switch 81A is connected to one of the batteries 12. In the present preferred embodiment, the one end of the common electric power supply switch 81A is connected to the battery 12C corresponding to the central outboard motor 3C. The other end of the common electric power supply switch 81A is connected to a common electric power supply line 191.

The common electric power supply line 191 is drawn inside the respective remote controller ECUs 10. In regard to the remote controller ECU 10C, the common electric power supply line 191 is connected to an anode of the diode 144. The cathode of the diode 144 is connected to a base of the switching transistor 142. The anode of the diode 144 is connected to the computer 130 and one input terminal (signal input terminal) of the gate 143 (AND gate). The base of the switching transistor 142 is further connected to the computer 130 via the diode 145.

As mentioned above, when the switching transistor 142 turns on, electric power is supplied to the power supply circuit 141. The switching transistor 142 is put in the on state when the common electric power supply switch 81A turns on or when a self-holding output, transmitted to the base thereof from the computer 130, is set to the H level.

The other input terminal (control input terminal) of the gate 143 is connected to the computer 130. The output terminal of the gate 143 is connected via the electric signal line 14 to the diode 174 inside the corresponding outboard motor ECU 30C. The electric signal line 14 is used for transmission of the wake-up signal output from the gate 143. The wake-up signal is set to the H level when the conditions that the common electric power supply switch 81A is in the on state and a gate control signal transmitted to the control input terminal of the gate 143 from the computer 130 is set to the H level are met. When these conditions are not met, the wake-up signal is set to an L level.

The common start switch 81B is a switch that is arranged to be turned on when the key switch 81 is operated to the start position. One end of the common start switch 81B is connected to the common electric power supply line 191. The other end of the common start switch 81B is connected in common to the computers 130 inside the remote controller ECUs 10P, 10C, and 10S.

Each of the start/stop switches 82S, 82C, and 82P, included in the operation panel 8, has one end connected to the common electric power supply line 191. Each of the start/stop switches 82S, 82C, and 82P has the other end connected to the computer 130 inside the corresponding remote controller ECU 10S, 10C, or 10P.

The computers 130 inside the respective remote controller ECUs 105, 10C, and 10P are connected to the respectively corresponding lamps 83S, 83C, and 83P and the respectively corresponding position sensors 11S and 11P. The signals from both position sensors 11S and 11P are input into the remote controller ECU 10C corresponding to the central outboard motor. The computers 130 inside the respective remote controller ECUs 10S, 10C, and 10P are also connected to the computers 160 of the respectively corresponding outboard motor ECUs 30S, 30C, and 30P via the bus 20 arranged from a LAN cable of the inboard LAN (local area network). The bus 20 is used for communication of control signals and various information.

The respective gauges 9S, 9C, and 9P are connected, for example, to the bus 20. The gauges 9S, 9C, and 9P can thereby perform data communication with the computers 160 inside the corresponding outboard motor ECUs 30S, 30C, and 30P and the computers 130 inside the corresponding remote controller ECUs 10S, 10C, and 10P.

When the key switch 81 is operated from the off position to the on position, the common electric power supply switch 81A turns on. When the common electric power supply switch 81A turns on, the switching transistor 142 turns on, and a common electric power supply on signal that is input into the computer 130 and the input signal into the signal input terminal of the gate 143 are set to the H level. When the switching transistor 142 turns on, electric power is supplied from the battery 12 to the electric power supply circuit 141. The electric power supply of the computer 130 is thus turned on and electric power is supplied to the peripheral equipments thereof. When the electric power supply of the computer 130 turns on, the computer 130 sets the self-holding output to the switching transistor 142 to the H level. The switching transistor 142 thus maintains the on state.

When the common electric power supply on signal that is input into the computer 130 is set to the H level, the computer 130 sets the gate control signal, input into the control input terminal of the gate 143, to the H level. Also, the computer 130 transmits a common electric power supply on command to the computer 160 inside the corresponding outboard motor ECU 30 via the bus 20. Further, the computer 130 turns on the corresponding lamp 83.

An H level signal is already input in the signal input terminal of the gate 143, and thus, when the control signal input into the control input terminal of the gate 143 by the computer 130 is set to the H level, the wake-up signal output from the gate 143 is set to the H level. The switching transistor 172 in the corresponding outboard motor ECU 30 thus turns on and the corresponding electric power supply relay 13 is put in the conducting state.

When the electric power supply relay 13 is put in the conducting state, electric power is supplied to the electric power supply circuit 171 from the corresponding battery 12 via the electric power supply relay 13 and the diode 173. The electric power supply of the computer 160 is thereby turned on, and electric power is supplied to respective portions inside the corresponding outboard motor 3.

As mentioned above, when the common electric power supply switch 81A is turned on, the common electric power supply on command is transmitted to the computer 160 from the computer 130 in the corresponding remote controller ECU 10. Upon receiving the common electric power supply on command, the computer 160 sets the self-holding output to the switching transistor 172 to the H level. The switching transistor 172 thus maintains the on state and the electric power supply relay 13 maintains the conducting state. The electric power supplies of the three outboard motors 3 can thus be turned on all at once by operating the key switch 81 from the off position to the on position.

When the key switch 81 is operated from the on position to the start position, the common start switch 81B turns on. When the common start switch 81B turns on, a common start signal is input into the computers 130 in the respective remote controller ECUs 10. Upon input of the common start signal, the computers 130 in the respective remote controller ECUs 10 transmit an engine start command via the bus 20 to the computers 160 in the corresponding outboard motor ECUs 30 under the condition that the starting allowing conditions are met. The starting allowing conditions include, for example, that the lever positions of the corresponding remote controllers 7 are at the neutral positions (the target shift positions are the neutral positions) and the shift positions of the corresponding outboard motors 3 are the neutral positions.

Upon receiving the engine start command, the respective computers 160 perform the engine starting process. In the engine starting process, each computer 160 energizes the starter 45 and performs fuel supply control and ignition control to start the engine 69. The engines of the three outboard motors 3 can thus be started all at once by operating the key switch 81 from the on position to the start position.

When the key switch 81 is operated from the on position to the off position, the common electric power supply switch 81A turns off. When the common electric power supply switch 81A turns off, the common electric power supply on signal, input into the computers 130 in the respective remote controller ECUs 10, is set to the L level, and the wake-up signal is set to the L level. When the common electric power supply on signal input into the computers 130 is set to the L level, the computers 130 transmit an electric power supply off command (common electric power supply off command) to the computers 160 in the corresponding outboard motor ECUs 30 via the bus 20. After executing other necessary ending processes, each computer 130 sets the self-holding output to the switching transistor 142 to the L level. The switching transistor 142 is thereby turned off and the supply of electric power to the electric power supply circuit 141 is cut off. The electric power supply of the computer 130 is thus turned off and the supply of electric power to the peripheral circuits is also stopped.

Upon receiving the electric power supply off command (common electric power supply off command) from the computers 130 in the corresponding remote controller ECUs 10, the computers 160 in the respective outboard motor ECUs 30 execute predetermined ending processes and thereafter set the self-holding output to the switching transistors 172 to the L level. The wake-up signal is at the L level and thus when the self-holding output to each switching transistor 172 is set to the L level, the switching transistor 172 turns off. Self-holding of the electric power supply relay 13 is thereby canceled and the supply of electric power to the electric power supply circuit 171 is cut off. The electric power supplies of the computers 160 are thus turned off, and the supply of electric power to the respective portions inside the corresponding outboard motors 3 is also stopped. The electric power supplies of the three outboard motors 3 can thus be cut off all at once by operating the key switch 81 from the on position to the off position.

Operations performed when a start/stop switch 82 is operated with the common electric power supply switch 81A being in the on state shall now be described.

Figure 15:
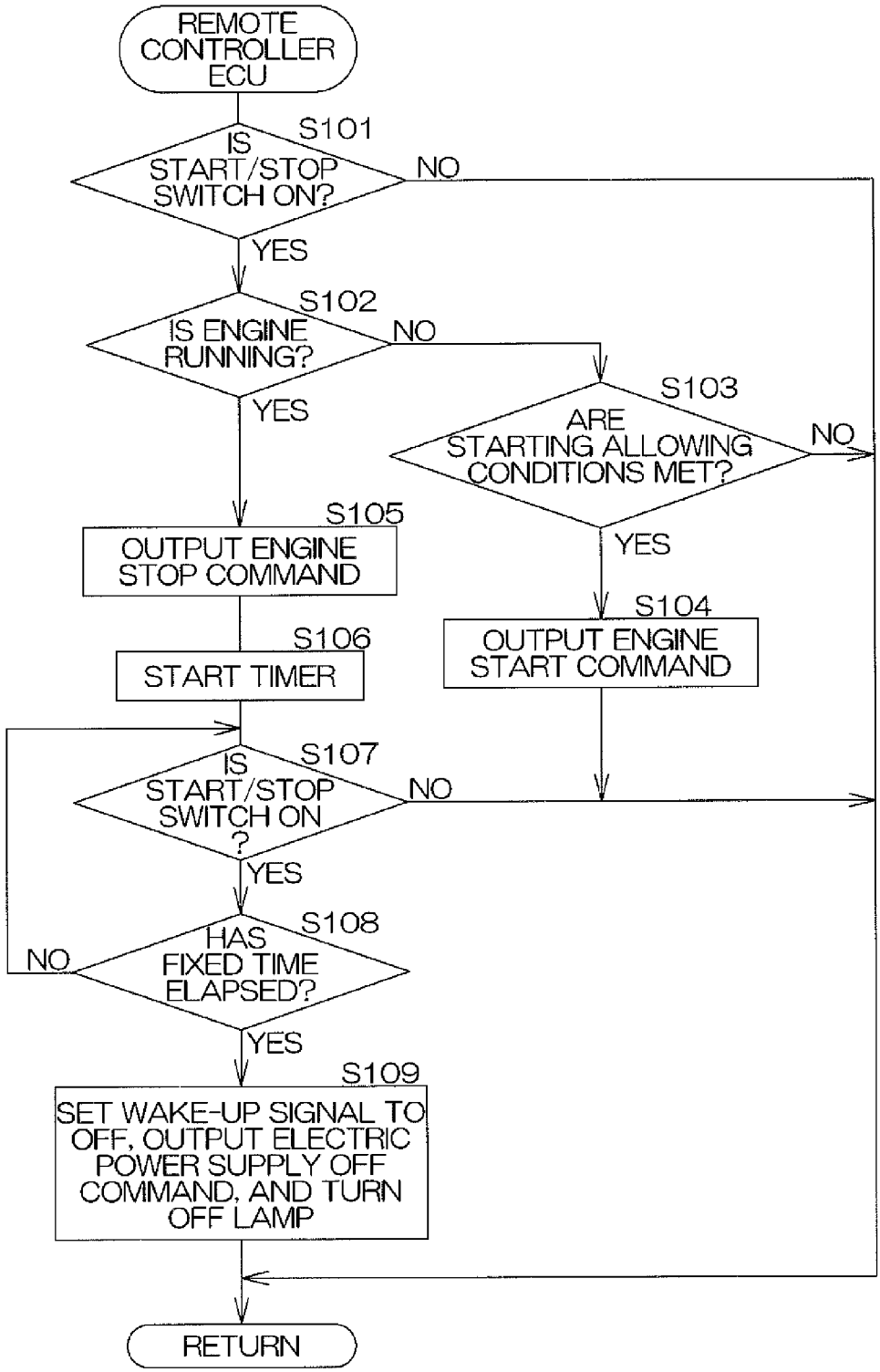
FIG. 15 is a flowchart of procedures of a process (first operation example) executed by a computer inside the remote controller ECU when a start/stop switch is operated.

FIG. 15 is a flowchart of procedures of a process (first operation example) executed by the computer 130 inside the corresponding remote controller ECU 10 when the start/stop switch 82 is operated with the common electric power supply switch 81A being in the on state. The computer 130 executes this process repeatedly at every control cycle.

When the start/stop switch 82 is turned on (depressed) (step S101: YES), the computer 130 judges whether or not the engine of the corresponding outboard motor 3 is running (step S102). Information, such as the running circumstances of the corresponding engine, the shift position of the corresponding outboard motor, etc., is transmitted from the computer 160 inside the corresponding outboard motor ECU 30 to the computer 130 in the remote controller ECU 10 via the bus 20. The judgment in step S102 is made based on the information on the engine running circumstances transmitted from the corresponding computer 160.

If the engine is in the stopped state (step S102: NO), the computer 130 judges whether or not the starting allowing conditions are met (step S103). The starting allowing conditions include, for example, that the lever position of the corresponding remote controller 7 is at the neutral position (the target shift position is the neutral position) and the shift position of the corresponding outboard motor 3 is the neutral position. If the starting allowing conditions are met (step S103: YES), the computer 130 outputs the engine start command (step S104). The present process is then ended. The engine start command output from the computer 130 is transmitted via the bus 20 to the computer 160 in the corresponding outboard motor ECU 30.

If the computer 130 judges in step S103 that the starting allowing conditions are not met, the present process is ended.

If in step S102, it is judged that the engine of the corresponding outboard motor 3 is running (step S102: YES), the computer 130 outputs the engine stop command (step S105). The engine stop command output from the computer 130 is transmitted via the bus 20 to the computer 160 inside the corresponding outboard motor ECU 30.

Also, the computer 130 starts a timer for measuring a predetermined, fixed amount of time (step S106). It is then judged whether or not the predetermined, fixed amount of time has elapsed with the start/stop switch 83 being kept on from step S101 (steps S107 and S108). If the start/stop switch 83 is turned off before the elapse of the predetermined, fixed amount of time (step S107: YES), the computer 130 judges that a "short pressing operation" and not a "long pressing operation" has been performed and the present process is ended.

If the predetermined, fixed amount of time has elapsed with the start/stop switch 83 being kept on from step S101 (step S108: YES), the computer 130 judges that the "long pressing operation" of the start/stop switch 83 is performed, and step S109 is entered. In step S109, the computer 130 sets the gate control signal to the L level. The wake-up signal is thereby set to the L level. Also, the computer 130 outputs an electric power supply off command (individual electric power supply off command; however, the command itself is the same command as the common electric power supply off command). The electric power supply off command (individual electric power supply off command) output from the computer 130 is transmitted via the bus 20 to the computer 160 inside the corresponding outboard motor ECU 30. Further, the computer 130 turns off the corresponding lamp 83 and ends the present process.

Figure 16:
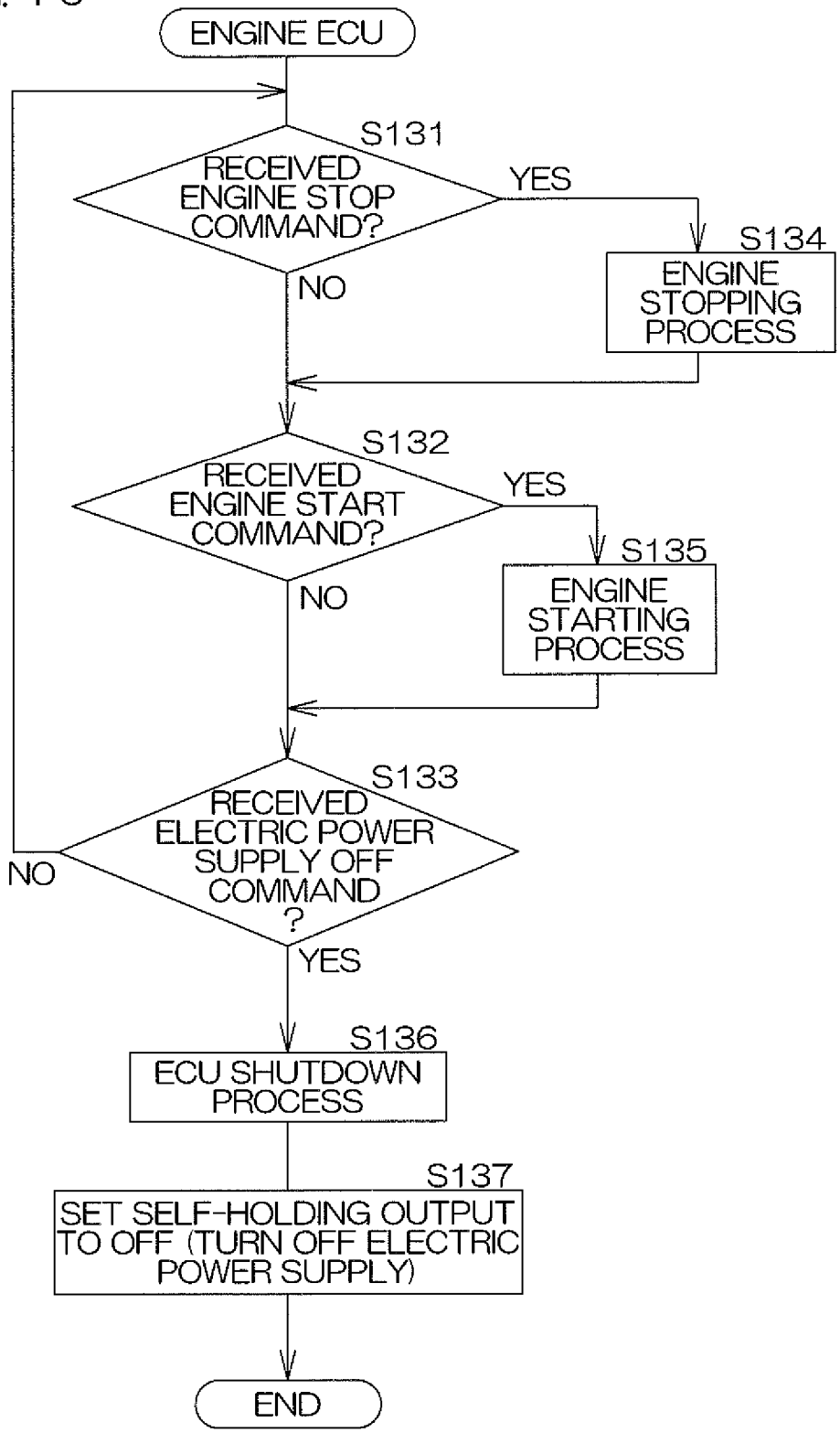
FIG. 16 is a flowchart of procedures of a process executed by a computer inside the outboard motor ECU.

FIG. 16 is a flowchart of procedures of a process executed by the computer 160 inside the outboard motor ECU 30. This process is executed repeatedly at every control cycle.

The computer 160 monitors whether or not the engine stop command is received (step S131), whether or not the engine start command is received (step S132), and whether or not the electric power supply off command (the common electric power supply off command or the individual electric power supply off command) is received (step S133).

When the computer 160 receives the engine stop command (step S131: YES), the computer 160 performs the engine stopping process for stopping the corresponding engine (step S134). Specifically, the computer 160 stops the engine by stopping the fuel injection by the injector and stopping the ignition operation by the spark plug.

When the computer 160 receives the engine start command (step S32: YES), the computer 160 performs the engine starting process for starting the corresponding engine (step S135). Specifically, the computer 160 starts the engine by energizing the starter and performing fuel supply control and ignition control.

When the computer 160 receives the electric power supply off command (step S133: YES), the computer 160 performs an ECU ending process for normal shutdown of the computer 160 (step S136). Thereafter, computer 160 sets the self-holding output to the switching transistor 172 to off (the L level) (step S137). The electric power supply of the computer 160 is thereby turned off.

As described above, in the case where the computer 130 inside the remote controller ECU 10 outputs the electric power supply off command (see, for example, step S109 in FIG. 15), the wake-up signal is set to the L level. Thus, when the self-holding output to the switching transistor 172 is set to the L level in step S137, the switching transistor 172 is turned off and the corresponding electric power supply relay 13 is put in the cutoff state. The supply of electric power from the corresponding battery 12 to the electric power supply circuit 171 is thereby cut off and the electric power supply of the computer 160 is cut off.

Figure 17:
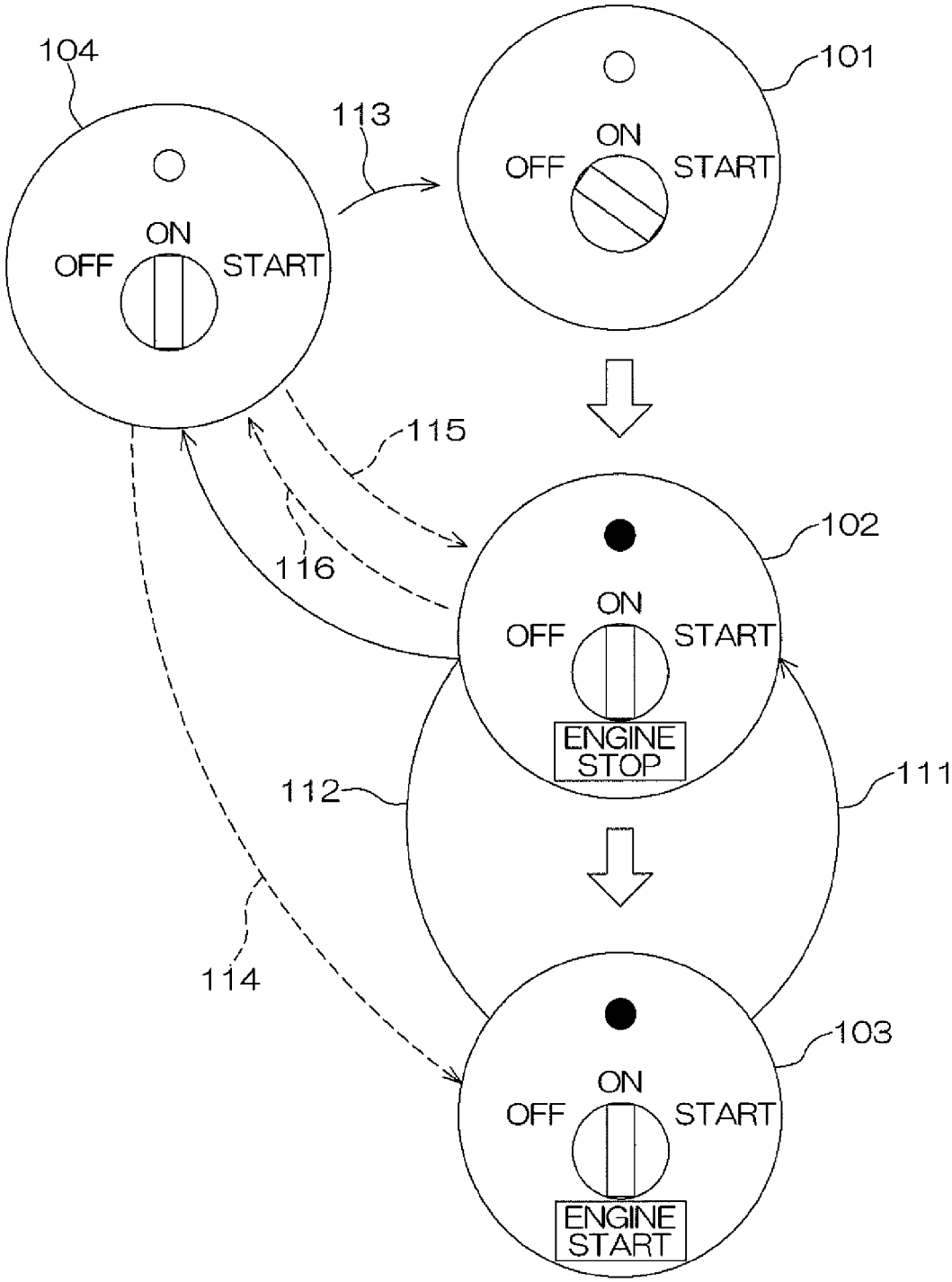
FIG. 17 is a diagram for explaining transitions (state transitions) of an on/off state of an electric power supply of an outboard motor and an operation state of an engine of the outboard motor.

FIG. 17 is a diagram for explaining transitions (state transitions) of the on/off state of the electric power supply of the outboard motor 3 and the running state of the engine of the outboard motor 3. The state transitions are performed for each outboard motor 3. Here, the state transitions of the central outboard motor 3C shall be described.

In an initial state 101, the key switch 81 is at the off position and the lamp 83*c* is in the unlit state. When in the initial state 101, the key switch 81 is operated from the off position to the on position, the electric power supply of the outboard motor 3C is turned on and an engine stopped state 102 is entered. In the engine stopped state, the lamp 83C is put in a lit state.

When in the engine stopped state 102, the start/stop switch 82C is depressed, the engine of the outboard motor 3C is started and the engine running state 103 is entered (see steps S101, 5102, 5103, and 5104 in FIG. 15 and steps S132 and 5135 in FIG. 16). When in the engine running state 103, the short pressing operation of the start/stop switch 82C is performed, the engine of the outboard motor 3 is stopped as indicated by an arrow 111 and a transition into the engine stopped state 102 occurs (see steps S101, 5102, and 5105 in FIG. 15 and steps S131 and 5134 in FIG. 16).

When in the engine running state 103, the long pressing operation of the start/stop switch 82C is performed, the state transitions as indicated by an arrow 112. That is, after transitioning into the engine stopped state 102 (see steps S101, 5102, and 5105 in FIG. 15 and steps S131 and 5134 in FIG. 16), the electric power supply of the outboard motor 3C is turned off individually and an individual electric power supply off mode 104 is entered (see steps S106 to S109 in FIG. 15 and steps S133, 5136, and 5137 in FIG. 16). In the individual electric power supply off mode 104, the electric power supply of the outboard motor 3C is off and thus the lamp 83C is put in the unlit state despite the key switch 81 being at the on position.

When in the individual electric power supply off mode 104, the key switch 81 is operated from the on position to the off position, transition into the initial state 101 occurs as indicated by an arrow 113.

Here, for example, it shall be assumed that when the electric power supplies of all of the outboard motors 3 are on and the engines are running, a fault occurs in the engine of one of the outboard motors 3. In such a case, the electric power supplies of all of the outboard motors 3 can be turned off by operation of the key switch 81. However, it is not possible to turn off the electric power supply of just the outboard motor 3, in which the engine fault has occurred, by operation of the key switch 81.

In the first preferred embodiment, in such a case, the electric power supply of just the outboard motor 3 with the faulty engine can be turned off by performing the long pressing operation of the start/stop switch 82 corresponding to the faulty outboard motor 3 (see an arrow 112 in FIG. 17). Specifically, when the long pressing operation of the start/stop switch 82 corresponding to the outboard motor 3 with the faulty engine is performed, the YES judgment is made in each of steps S101 and 5102 in FIG. 15, the engine stop command is output (see Step S105). Also, the YES judgment is made in Step S108, the wake-up signal is set to the L level, and the electric power supply off command (individual electric power supply off command) is output (see step S109). Consequently, the electric power supply of the outboard motor 3 with the faulty engine is turned off (see step S137 in FIG. 16).

The electric power supply of the outboard motor 3, with which the engine cannot be started due to a fault, etc., can thereby be turned off individually to suppress wasteful consumption of electric power and prevent running out of the battery corresponding to the outboard motor 3. Also, engine starting due to entrained rotation can be prevented because the electric power supply of the outboard motor 3 can turned off individually. Running of the marine vessel is not disrupted because the electric power supply of the outboard motor 3, in which the fault, etc., has occurred, can be put in the off state while keeping the electric power supplies of the other normal outboard motors 3 in the on state.

Another operation example (second operation example) of electric power supply control and start/stop control shall now be described. An outboard motor 3 can be put in the individual electric power supply off mode by the long pressing operation of the corresponding start/stop switch 83 in the second operation example as well. Further, in the second operation example, by operating the start/stop switch 83 when the corresponding outboard motor 3 is in the individual electric power supply off mode, the electric power supply of the outboard motor 3 can be turned on and the engine thereof can be started.

To describe by way of FIG. 17, when, for example, the start/stop switch 83C is depressed with the outboard motor 3C being in the individual electric power supply off mode 104, the engine running state 103 can be transitioned into a state as indicated by a broken-line arrow 114.

Figure 18:
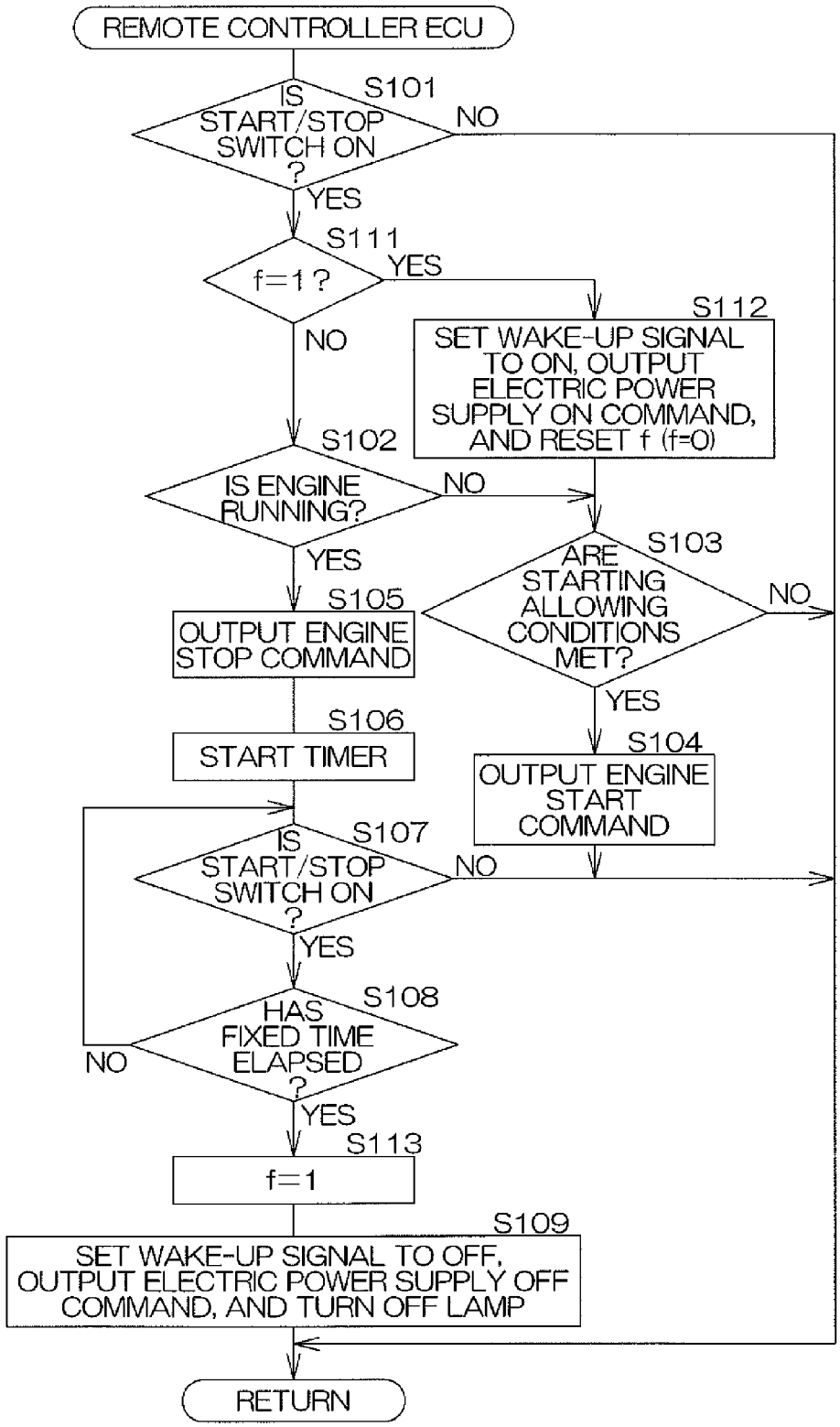
FIG. 18 is a flowchart of procedures of a process (second operation example) executed by the computer inside the remote controller ECU when the start/stop switch is operated.

FIG. 18 is a flowchart of specific process contents (second operation example) performed by the computer 130 inside the remote controller ECU 10. The computer 130 repeats this process at every control cycle. The process contents of the computer 160 inside the outboard motor ECU 30 are substantially the same as those of the first operation example.

The respective steps S101 to S109 in FIG. 18 are the same as the respective steps S101 to S109 in FIG. 15. In comparison to the flowchart of FIG. 15, the flowchart of FIG. 18 differs in that step S111, step S112, and step S113 are added.

In the second operation example, when the start/stop switch 82 is turned on (depressed) (step S101: YES), it is judged whether or not a flag f is set to 1 (step S111). The flag f is a flag for storing that the outboard motor 3 is in the individual electric power supply off mode (the state indicated by reference numeral 104 in FIG. 17). As shall be described below, the flag f is set to 1 (f=1) when the outboard motor 3 is put in the individual electric power supply off mode. The flag f is reset (f=0) during the initialization process that is executed when the electric power supply of the computer 130 inside the remote controller ECU 10 is turned on.

If the flag f is reset (f=0) (step S111: NO), that is, if the corresponding outboard motor 3 is not in the individual electric power supply off mode, the computer 130 enters step S102 as in the first operation example and judges whether or not the engine of the corresponding outboard motor 3 is running. If the corresponding outboard motor 3 is running, the computer 130 outputs the engine stop command (step S105) and starts the timer (step S106).

It is, then, judged whether or not a predetermined, fixed time has elapsed with the start/stop switch 83 being kept on (steps S107 and S108). If the predetermined, fixed time has elapsed with the start/stop switch 83 being kept on (step S108: YES), that is, if the "long pressing operation" of the start/stop switch 83 is performed, the flag f is set to 1 (f=1) (step S113). Step S109 is then entered. In step S109, the computer 130 provides the L level signal to the gate 143 to set the wake-up signal to the L level, outputs the electric power supply off command (individual electric power supply off command) and turns off the corresponding lamp 83. The corresponding outboard motor 3 is thereby put in the individual electric power supply off mode. The flag f is thus set to 1 (f=1) when the outboard motor 3 is put in the individual electric power supply off mode.

The operation of the computer 130 in a case where it is judged in step S111 that the flag f is set to 1 (f=1) (step S111: YES), that is, the corresponding outboard motor 3 is in the individual electric power supply off mode is as follows. That is, the computer 130 provides the H level signal to the gate 143 to set the wake-up signal to on (to the H level), outputs the electric power supply on command, and resets the flag f (f=0) (step S112). The electric power supply on command output from the computer 130 is transmitted via the bus 20 to the computer 160 inside the corresponding outboard motor ECU 30. The electric power supply of the outboard motor 3 that is in the individual electric power supply off mode is thereby turned on.

After performing the process of step S112, the computer 130 enters step S103 and judges whether or not the starting allowing conditions are met. If the starting allowing conditions are met (step S103: YES), the engine start command is output (step S104). The engine start command output from the computer 130 is transmitted via the bus 20 to the computer 160 inside the corresponding outboard motor ECU 30. The engine of the corresponding outboard motor 3 is thus started. If in step S103, it is judged that the starting allowing conditions are not met (step S103: NO), the computer 130 ends the present process.

In the second operation example, by operation of the start/stop switch 83 corresponding to the outboard motor 3 when the outboard motor 3 is in the individual electric power supply off mode, the electric power supply of the outboard motor 3 can be turned on and the engine thereof can be started. That is, the electric power supply of the outboard motor 3 that is in the individual electric power supply off mode can be turned on and the engine thereof can be started by a simple operation.

Figure 19:
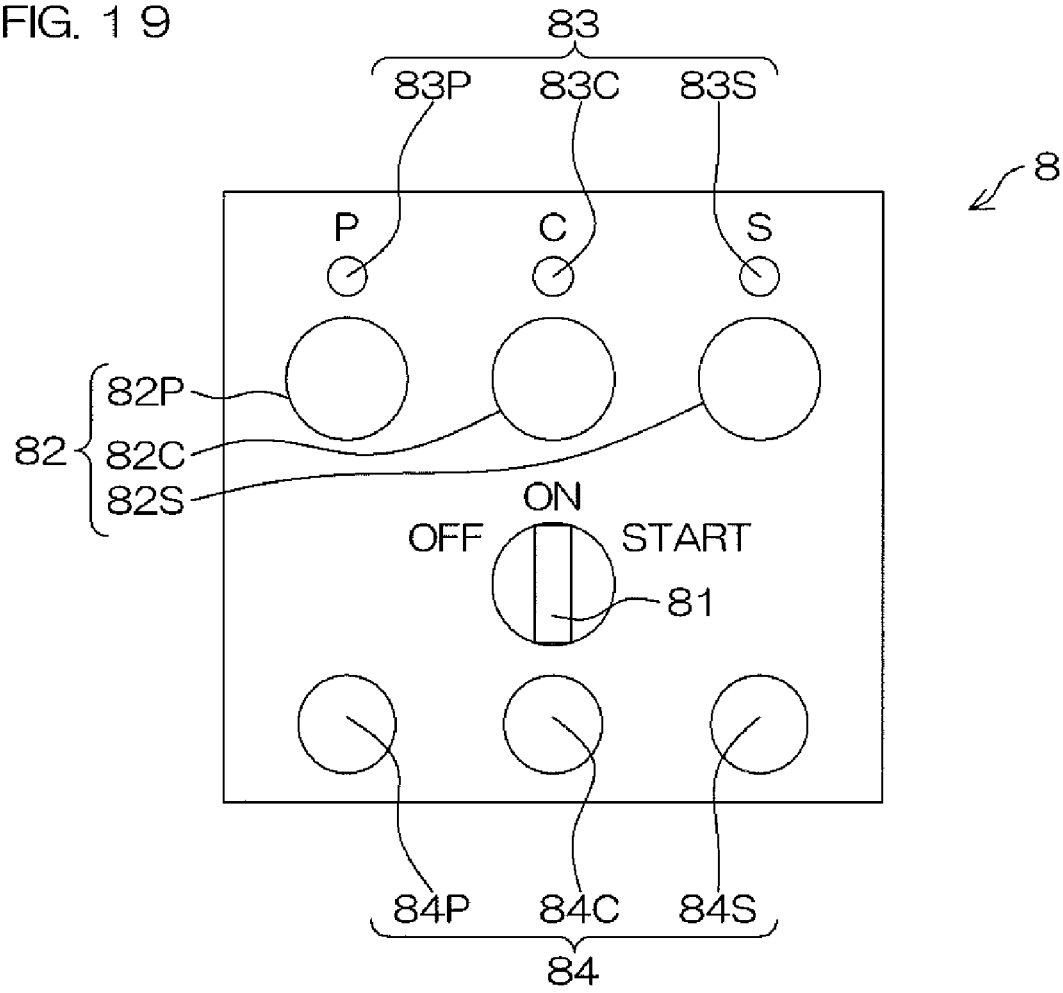
FIG. 19 is a plan view of an operation panel provided with individual electric power supply on/off switches.

A plurality of individual electric power supply on/off switches 184S, 184C, and 184P for turning on and off the electric power supplies of the respective outboard motors 3S, 3C, and 3P individually may be provided on the operation panel 8 as shown in FIG. 19. The individual electric power supply on/off switch 184S corresponds to the starboard-side outboard motor 3S. The individual electric power supply on/off switch 184C corresponds to the central outboard motor 3C. The individual electric power supply on/off switch 184P corresponds to the port-side outboard motor 3P. The individual electric power supply on/off switches 184S, 184C, and 184P shall be referred to collectively as the "individual electric power supply on/off switches 184." The operation signals of the individual electric power supply on/off switches 184 are input into the corresponding remote controller ECUs 10.

Figure 20:
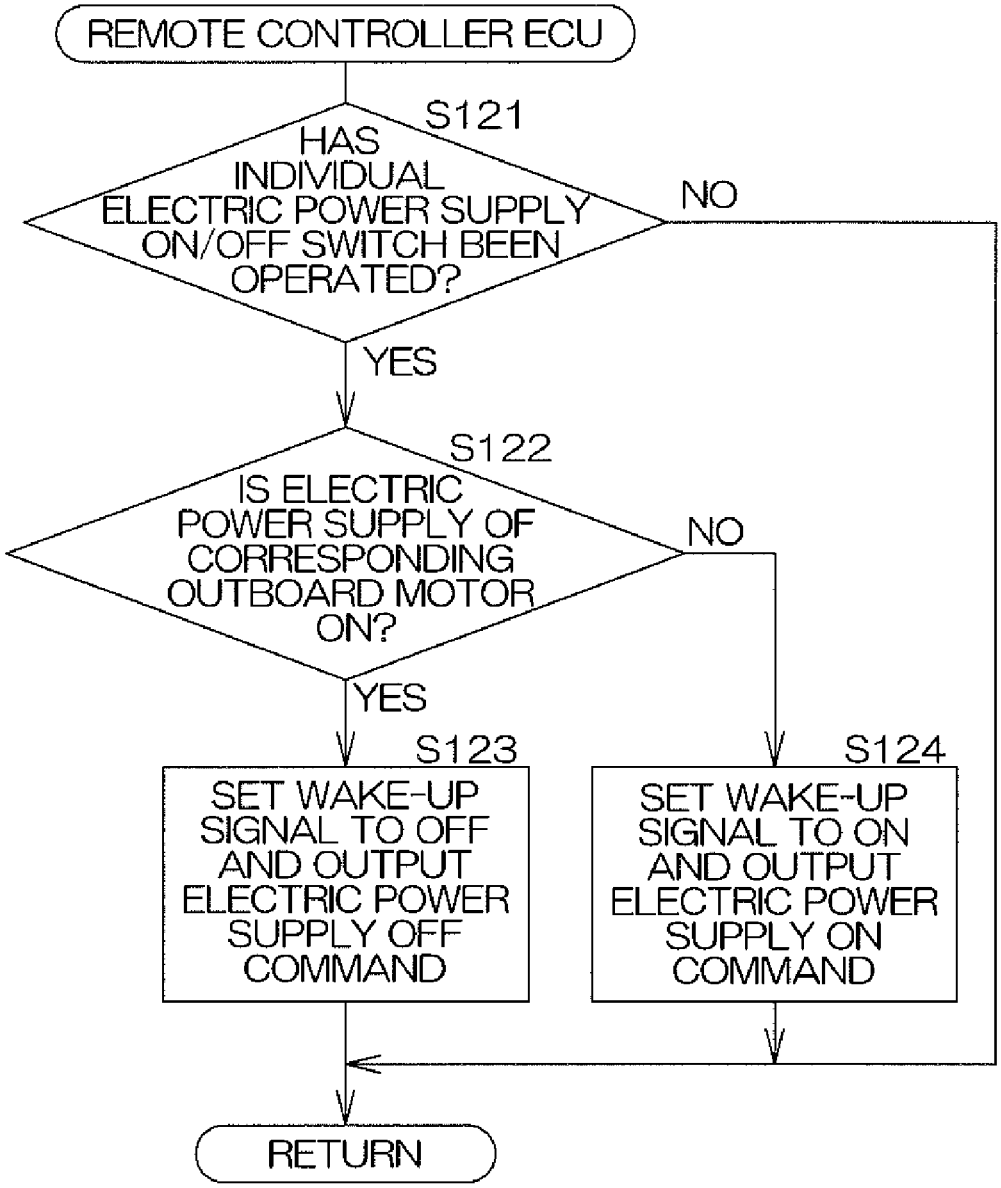
FIG. 20 is a flowchart of procedures of a process executed by the computer inside the remote controller ECU in a case where the individual electric power supply on/off switches are provided.

In this case, the computer 130 in each remote controller ECU 10 executes the process shown in FIG. 20 in accordance with operation of the corresponding individual electric power supply on/off switch 184. The contents of the process of the computers 160 in the outboard motor ECUs 30 do not differ.

Referring to FIG. 20, when the corresponding individual electric power supply on/off switch 184 is operated (step S121: YES), the computer 130 in the remote controller ECU 10 judges whether or not the electric power supply of the corresponding outboard motor 3 (outboard motor ECU 30) is in the on state (step S122). If the electric power supply of the corresponding outboard motor 3 is in the on state (step S122: YES), the computer 130 provides the L level signal to the gate 143 and thereby sets the wake-up output to off (to the L level). Further, the computer 130 outputs the electric power supply off command (individual electric power supply off command) and turns off the corresponding lamp 83 (step S23).

The electric power supply off command (individual electric power supply off command) output from the computer 130 is transmitted via the bus 20 to the corresponding outboard motor ECU 30. The electric power supply of the corresponding outboard motor 3 is put in the off state (individual electric power supply off mode). In the case of application to the second operation example, the computer 130 further sets the flag f to 1 (f=1) in step S123.

If in step S122, the electric power supply of the corresponding outboard motor 3 is in the off state (step S122: NO), the computer 130 sets the wake-up output to on (to the H level), outputs the electric power supply on command, and turns on the corresponding lamp 83 (step S124). The electric power supply on command output from the computer 130 is transmitted to the corresponding outboard motor ECU 30 via the bus 20. The electric power supply of the corresponding outboard motor 3 is thereby put in the on state. In the case of application to the second operation example, the computer 130 further resets the flag f (f=0) in step S124.

Thus, in the case where the individual electric power supply on/off switch 184 is provided for each outboard motor 3, transition from the individual electric power supply off mode 104 to the engine stopped state 102 is enabled as indicated by a broken-line arrow 115 in FIG. 17. For example, when, in a case where the outboard motor 3C is in the individual electric power supply off mode 104, the corresponding individual electric power supply on/off switch 184 is operated, the electric power supply of the outboard motor 3 is turned on and the engine stopped state 102 is entered (steps S121, 5122, and S124 in FIG. 20).

Also, transition to the individual electric power supply off mode 104 from the engine stopped state 102 can be performed without starting the engine as indicated by a broken-line arrow 116 in FIG. 17. For example, when in a case where the outboard motor 3C is in the engine stopped state 102, the corresponding individual electric power supply on/off switch 184 is operated, the electric power supply of the outboard motor is turned off and the individual electric power supply off mode 104 is entered (steps S121, 5122, and 5123 in FIG. 20).

FIGS. 21A-21D are diagrams for describing operations of a marine vessel according to a second preferred embodiment of the present invention. Whereas with the first preferred embodiment, the marine vessel preferably including three outboard motors 3 has been described, the present invention can also be applied to a marine vessel with a plurality of outboard motors 3 of a number other than three (two motors or no less than four motors). FIGS. 21A-21D show operations of the second preferred embodiment in which the present invention is applied to a marine vessel that includes two outboard motors 3P and 3S and a single lever for selecting the shift positions of these motors. This marine vessel has an arrangement where the central outboard motor 3C and portions corresponding thereto are eliminated from the first preferred embodiment described above.

In the marine vessel according to the second preferred embodiment, the single lever is associated with the two outboard motors 3P and 3S. That is, when the lever is set at the forward drive position that is inclined forward to no less than the forward drive shift-in position, the shift positions of the outboard motors 3P and 3S are both controlled to be at the forward drive positions. Also, when the lever is set at the reverse drive position that is inclined in reverse to no less than the reverse drive shift-in position, the shift positions of the outboard motors 3P and 3S are both controlled to be at the reverse drive positions. When the lever is set at the neutral position, the shift positions of outboard motors 3P and 3S are both controlled to be at the neutral positions.

Figures 21A, 21B, 21C, 21D:
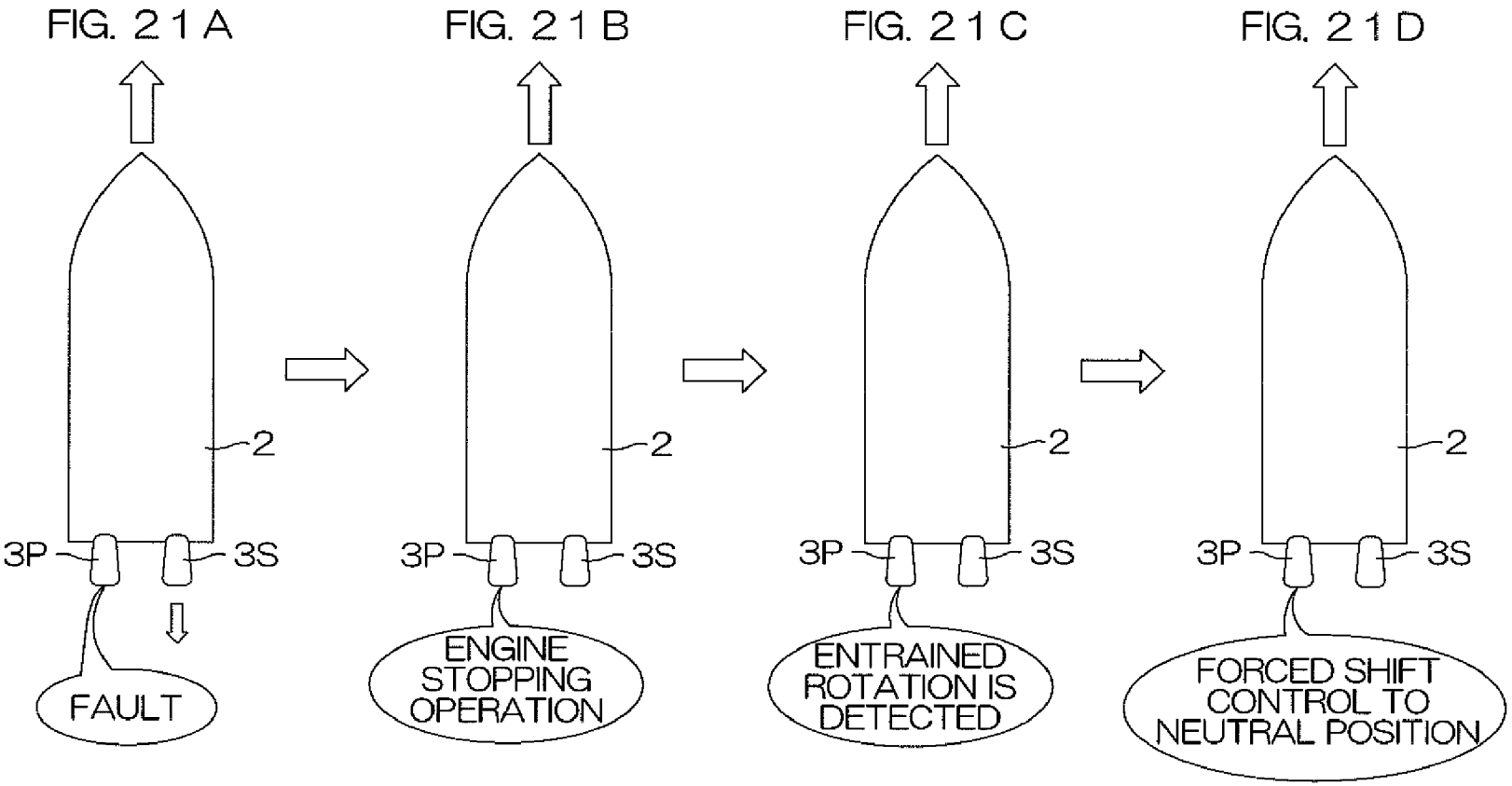
FIGS. 21A-21D are diagrams for describing operations of a marine vessel according to a second preferred embodiment of the present invention.

A case where the a fault occurs in the engine of the port-side outboard motor 3P when the two outboard motors 3P and 3S are generating propulsive forces in the forward drive direction and the hull 2 is being driven forward as shown in FIG. 21A shall now be assumed.

In such a case, the user performs the operation (engine stopping operation) for stopping the engine of the faulty port-side outboard motor 3P as shown in FIG. 21B. That is, the start/stop switch corresponding to the port-side outboard motor 3P is depressed.

Based on the engine stopping operation, the outboard motor ECU 30P corresponding to the port-side outboard motor 3P performs the engine stopping process. If the engine does not stop within a fixed amount of time despite the engine stopping process being started, the outboard motor ECU 30P judges that entrained rotation is occurring in the engine as shown in FIG. 21C. Also, in a case where, after the engine is put in the stopped state by the engine stopping process, the engine is put in the rotating state with the starter motor not being driven, the outboard motor ECU 30P judges that entrained rotation is occurring in the engine as shown in FIG. 21C. That is, the outboard motor ECU 30P detects the entrained rotation.

Upon detecting the entrained rotation, the outboard motor ECU 30P sets the shift position of the engine of the port-side outboard motor 3P to the neutral position by the "forced shift control to the neutral position" as shown in FIG. 21D. That is, the shift position of the central outboard motor 3C is maintained at the neutral position regardless of the lever position. Thus, when the entrained rotation of the engine is detected, the shift position of the outboard motor that includes the engine is forcibly set at the neutral position, and the inability to stop an engine that should be stopped due to entrained rotation or the starting of an engine in a stopped state due to entrained rotation can thereby be prevented.

Figure 22:
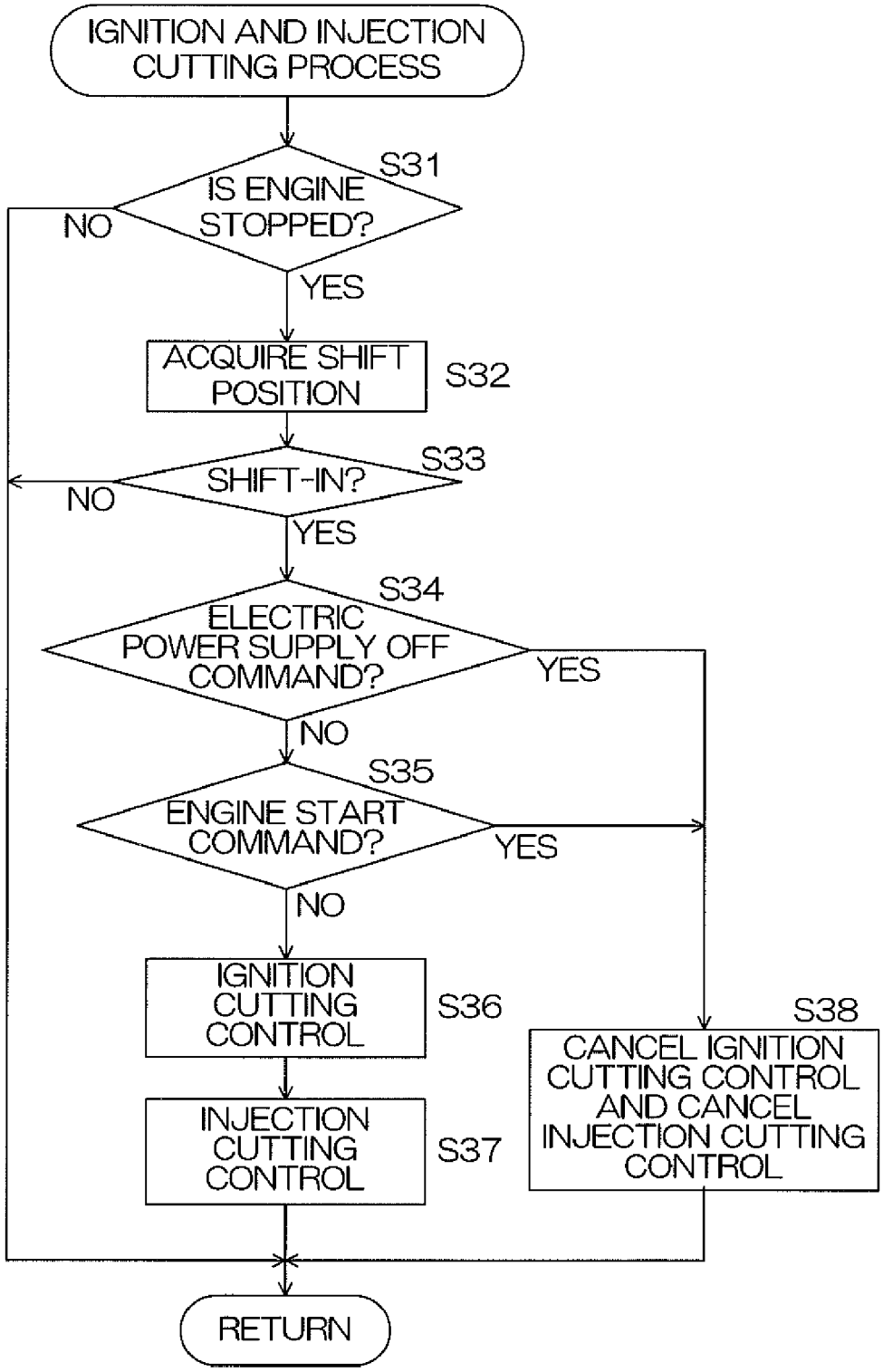
FIG. 22 is a flowchart of a characteristic operation in a third preferred embodiment of the present invention.

FIG. 22 is a flowchart of a characteristic operation in a third preferred embodiment of the present invention. The third preferred embodiment includes, in addition to the arrangement of the first preferred embodiment, an arrangement for an ignition and injection cutting process for cutting ignition and fuel injection when shift-in of an outboard motor in the engine stopped state is detected. More specifically, each outboard motor ECU 30 executes the shift control (FIG. 7, FIG. 11 to FIG. 13), and in parallel to the shift control, repeatedly executes the ignition and injection cutting process shown in FIG. 22 at every predetermined control cycle.

In the ignition and injection cutting process, the outboard motor ECU 30 determines whether or not the engine of the corresponding outboard motor is in the stopped state (step S31). The outboard motor ECU 30 determines that the engine is in the stopped state when the engine is actually stopped and also when the engine stop command for the outboard motor is provided. Whether or not the engine is stopped is determined, for example, based on the output of the engine speed sensor 43. For example, the outboard motor ECU 30 determines that the engine is stopped when the engine speed is no more than a predetermined value. The engine stop command is provided via the bus 20 to the outboard motor ECU 30 from the remote controller ECU 10. The remote controller ECU 10 transmits the engine stop command to the outboard motor ECU 30 when the start/stop switch 82 corresponding to the outboard motor is operated during running of the engine of the outboard motor.

If the engine is determined not being in the stopped state (step S31: NO), the ignition and injection cutting process of the present control cycle is ended.

If the engine is determined being in the stopped state (step S31: YES), the outboard motor ECU 30 acquires the shift position of the outboard motor from the shift position sensor 44 (step S32). The outboard motor ECU 30 then determines whether or not the shift position is the forward drive position or the reverse drive position (step S33). That is, it is determined whether or not the shift mechanism is in the shift-in state (transmitting state) in which rotation is transmitted between the driveshaft and the propeller. If the shift mechanism is not in the shift-in state (step S33: NO), the ignition and injection cutting process of the present control cycle is ended.

If the shift mechanism is in the shift-in state (step S33: YES), the outboard motor ECU 30 further determines whether or not the electric power off command is provided from the remote controller ECU 10 (step S34) and whether or not the engine start command is provided from the remote controller ECU 10 (step S35). When the key switch 81 is operated to the off position, the remote controller ECUs 10 transmit the electric power supply off command to the respective outboard motor ECUs 30 via the bus 20. Also, when a start/stop switch 82 is operated, the remote controller ECU 10 transmits the engine start command to the outboard motor ECU 30 of the outboard motor corresponding to the start/stop switch 82 when the engine of the outboard motor is stopped.

If neither the electric power supply off command nor the engine start command is provided (step S34: NO and step S35: NO), the outboard motor ECU 30 executes an ignition cutting control (step S36) and an injection cutting control (step S37). The ignition cutting control is a control of stopping the driving of the ignition coil 46 and prohibiting the discharge by the spark plug. The injection cutting control is a control of prohibiting fuel injection by the injector 47.

On the other hand, if the electric power supply off command or the engine start command is provided (step S34: YES or step S35: YES), the outboard motor ECU 30 cancels the ignition cutting control and the injection cutting control (step S38).

If when the engine of a certain outboard motor is in the stopped state, the outboard motor is put in the shift-in state, entrained rotation may occur. If, at this time, the shift-in state is detected, the outboard motor ECU 30 executes the ignition cutting control and the injection cutting control immediately. Starting of the engine due to entrained rotation can thereby be avoided. With just the "forced shift control to the neutral position" by the shift control process described above (FIG. 7 and FIG. 11 to FIG. 13), engine starting by entrained rotation may not be avoided reliably. Thus, by using the ignition and injection cutting controls in combination, engine starting by entrained rotation can be avoided.

Upon receiving the electric power supply off command or the engine start command, the outboard motor ECU 30 interrupts the ignition cutting control and the injection cutting control. Put in another way, the ignition cutting control and the injection cutting control are maintained until the user operates the key switch 81 to the off position or performs the engine starting operation of the outboard motor by operating the corresponding start/stop switch 82. Engine starting by entrained rotation can thereby be avoided reliably. Also, if the engine start command is provided, the ignition cutting control and the injection cutting control are interrupted and engine starting is thus enabled.

The present preferred embodiment may be modified by omitting the shift control process (FIG. 7 and FIG. 11 to FIG. 13). Engine starting by entrained rotation can be avoided by the ignition and injection cutting process in this case as well.

Figure 23:
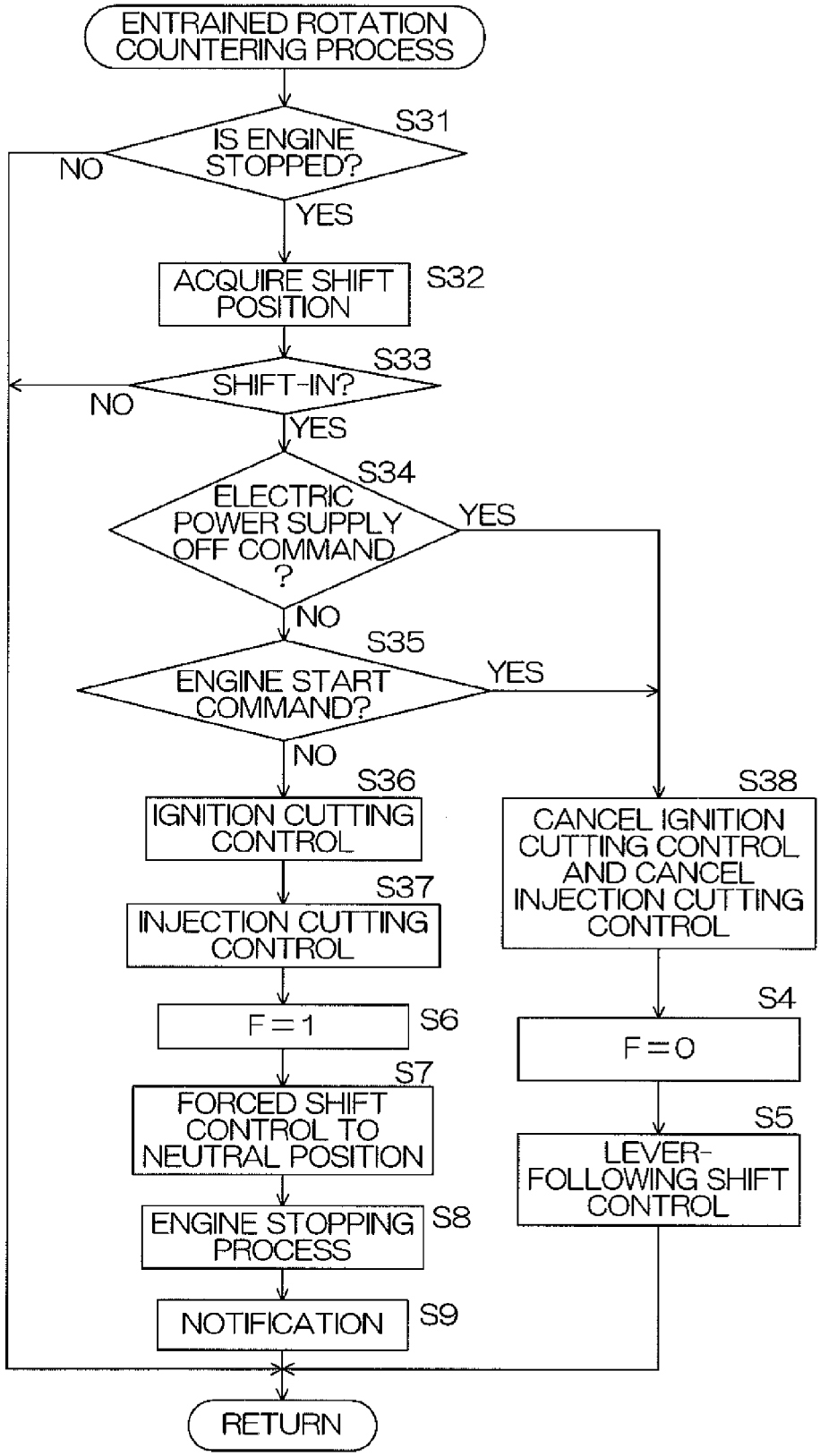
FIG. 23 is a flowchart of a characteristic operation in a fourth preferred embodiment of the present invention.
Figures 24A, 24B, 24C, 24D:
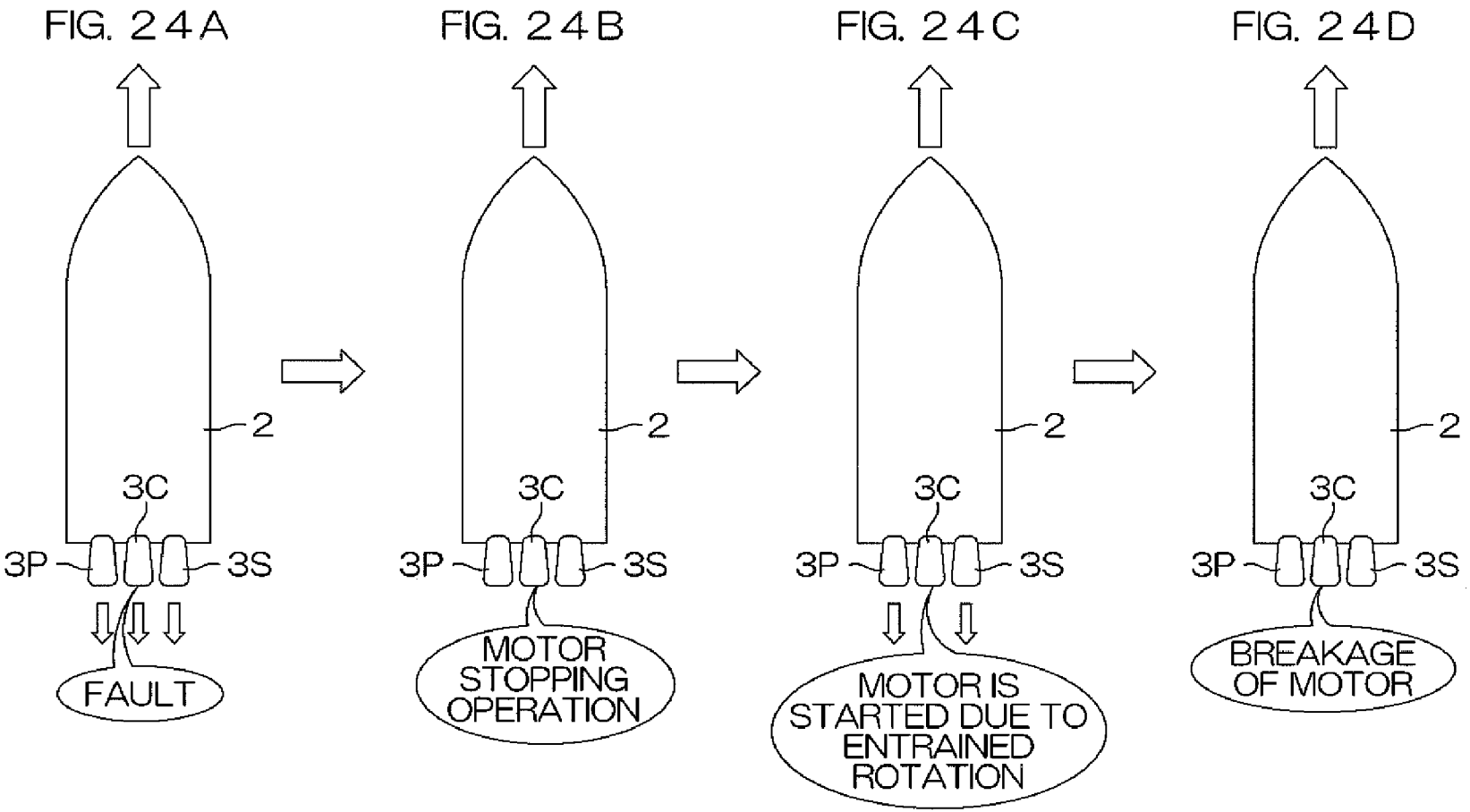
FIGS. 24A-24D are diagrams for explaining a problem in a case where a single, common electric power supply switch is provided in place of individual power supply switches for a plurality of propulsion devices (for example, outboard motors).

FIG. 23 is a flowchart of a characteristic operation in a fourth preferred embodiment of the present invention. As with the third preferred embodiment, the fourth preferred embodiment includes an arrangement for the ignition and injection cutting process for cutting the ignition and the fuel injection upon detection of shift-in of an outboard motor in the engine stopped state in addition to the arrangement of the first preferred embodiment. However, whereas in the third preferred embodiment, the shift control process and the ignition and injection cutting process are individual control processes that are performed in parallel, an entrained rotation countering process in which the above processes are consolidated is executed in the fourth preferred embodiment. The entrained rotation countering process is executed repeatedly by the outboard motor ECU 30 at every predetermined control cycle. Among the steps shown in FIG. 23, the steps in which the same processes as those of the steps shown in FIG. 7 or FIG. 22 are provided with the same reference numerals.

The outboard motor ECU 30 determines whether or not the engine of the corresponding outboard motor is in the stopped state (step S31). If the engine is determined not to be in the stopped state (step S31: NO), the entrained rotation countering process of the present control cycle is ended.

If the engine is determined to be in the stopped state (step S31: YES), the outboard motor ECU 30 acquires the shift position of the outboard motor from the shift position sensor 44 (step S32). The outboard motor ECU 30 then determines whether or not the shift mechanism is in the shift-in state (transmitting state) (step S33). If the shift mechanism is not in the shift-in state (step S33: NO), the entrained rotation countering process of the present control cycle is ended.

If the shift mechanism is in the shift-in state (step S33: YES), the outboard motor ECU 30 further determines whether or not the electric power off command is provided from the remote controller ECU 10 (step S34) and whether or not the engine start command is provided from the remote controller ECU 10 (step S35). If neither the electric power supply off command nor the engine start command is provided (step S34: NO and step S35: NO), the outboard motor ECU 30 executes the ignition cutting control (step S36) and the injection cutting control (step S37). Further, the outboard motor ECU 30 sets the above-described flag F that expresses the state of the shift control to 1 (F=1) (step S6), executes the "forced shift control to the neutral position" (step S7), and executes the engine stop process (step S8). Further, the outboard motor ECU 30 executes the notification process for displaying that the execution of the "forced shift control to the neutral position" is in progress on the corresponding gauge 9 (step S9).

On the other hand, if the electric power supply off command or the engine start command is provided (step S34: YES or step S35: YES), the outboard motor ECU 30 cancels the ignition cutting control and the injection cutting control (step S38), and further resets the flag F (F=0) (step S4). The outboard motor ECU 30 further cancels the "forced shift control to the neutral position" and makes the shift control mode transition to the lever-following shift control (step S5).

If when the engine of a certain outboard motor is in the stopped state, the outboard motor is put in the shift-in state, entrained rotation may occur. If, at this time, the shift-in state is detected, the outboard motor ECU 30 executes the ignition cutting control and the injection cutting control immediately. Starting of the engine due to entrained rotation can thereby be avoided. Further, the outboard motor ECU 30 executes the "forced shift control to the neutral position" to cut off the driving force transmission path between the engine and the propeller. The entrained rotation state can thereby be resolved. That is, engine starting is prevented promptly by the cutting of the ignition and the injection, and the driving force transmission path is thereafter cut off to resolve the entrained rotation state.

Upon receiving the electric power supply off command or the engine start command, the outboard motor ECU 30 interrupts the ignition cutting control and the injection cutting control and interrupts the "forced shift control to the neutral position. Put in another way, the ignition cutting control, the injection cutting control, and the "forced shift control to the neutral position" are maintained until the user operates the key switch 81 to the off position or performs the engine starting operation of the outboard motor by operating the start/stop switch 82. Engine starting by entrained rotation can thereby be avoided reliably, and reoccurrence of the entrained rotation state can also be avoided. Also, if the engine start command is provided, the ignition cutting control, the injection cutting control, and the "forced shift control to the neutral position" are interrupted, so that it becomes possible to start the engine and transmit the driving force of the engine to the propeller.

Although preferred embodiments of the present invention have been described above, the present invention can be put into practice in yet other embodiments and modes as well. For example, shift position changeover switches 84P, 84C, and 84S can also be provided on the operation panel 8 as indicated by broken lines in FIG. 4. The shift position changeover switches 84P, 84C, and 84S preferably are provided to individually switch the shift controls of the outboard motors 3P, 3C, and 3C between the "forced shift control to the neutral position" and the "lever-following shift control." These switches shall be referred to collectively as the "shift position changeover switches 84." The on/off states of the respective shift position changeover switches 84 are provided to the corresponding ECUs 30 from the remote controller ECUs 10.

When the corresponding shift position changeover switches 84 are in the on states, the respective outboard motor ECUs 30 perform the "forced shift control to the neutral position" on the corresponding outboard motors 3. The shift positions of the corresponding outboard motors 3 are thereby set to the neutral positions regardless of the lever positions.

On the other hand, when the corresponding shift position changeover switches 84 are in the off states, the respective outboard motor ECU 30 perform the "lever-following shift control" on the corresponding outboard motors 3. The shift positions of the corresponding outboard motors 3 are thereby controlled in accordance with the mode of association of the levers and the outboard motors and the operation positions of the levers.

Also, in the preferred embodiments described above, the key switch 81 preferably includes, in addition to the function of turning on and cutting off the electric power supplies of all outboard motors 3 at once, the function of starting the engines of all outboard motors 3 at once. However, the key switch 81 may be a switch that does not include the engine all-start function and has only the all electric power supply on/cutoff function for all outboard motors 3.

Also, although in the preferred embodiments described above, the start/stop switches 82, each of which combines an engine start switch and an engine stop switch, are preferably included, different arrangements are possible. That is, start switches for starting the engines and stop switches for stopping the engines may be included individually.

Also, although in the arrangement shown in FIG. 4, three remote controller ECUs 10 are preferably provided, the actions of these may be consolidated in a single remote controller ECU.

Also, although in the preferred embodiments described above, the outboard motor is taken up as an example of the propulsion device, the present invention can be applied to marine vessel propulsion systems that include propulsion devices of other forms. As other examples of the propulsion device, an inboard/outboard motor (a stern drive or an inboard motor/outboard drive) and an inboard motor can be cited. The outboard motor includes a propulsion unit provided outboard of the vessel and having a motor and a propulsive force generating member (propeller), and is further provided with a steering mechanism that horizontally turns the entire propulsion unit with respect to the hull. The inboard/outboard motor includes a motor disposed inboard of the vessel, and a drive unit disposed outboard and having a propulsive force generating member and a steering mechanism. The inboard motor preferably has a configuration in which a motor and a drive unit are incorporated inside the hull, and a propeller shaft extends outboard from the drive unit. In this case, a steering mechanism is provided separately.

A non-limiting example of correspondence between the terms used in the "SUMMARY OF THE INVENTION" section and the terms used in the above description of the preferred embodiments is shown below:

propulsion device: outboard motor 3 common electric power supply switch: key switch 81, common electric power supply switch 81A electric power supply control unit: remote controller ECU 10 abnormal state detection unit (entrained rotation detection unit):

outboard motor ECU 30, S3 in FIG. 7, S3 in FIG. 11 to FIG. 13 power transmission cutoff unit: outboard motor ECU 30, S7 in FIG. 7, S7 in FIG. 11 to FIG. 13 starting device: starter motor 45 notification unit: gauge 9, outboard motor ECU 30, S9 in FIG. 7, S9 in FIG. 11 to FIG. 13 clutch mechanism: shift mechanism 93 clutch state selection operation unit: remote controller 7 speed detection unit: speed sensor 12 association changing unit: remote controller ECU 10, S22 to S27 in FIG. 9 stopped state detection unit: step S31 in FIG. 15 and FIG. 16 clutch state detection unit: step S33 in FIG. 15 and FIG. 16 ignition and injection control unit: steps S36 and S37 in FIG. 15 and FIG. 16 start switch: start/stop switch 82 motor control unit: outboard motor ECU 30 electric power supply off command input unit: start/stop switch 82 individual electric power supply switch: individual electric power supply on/off switch 84 first individual electric power supply off unit: remote controller ECU 10, 5101, 5102, and 5105 to S109 in FIG. 15 first individual electric power supply on unit: remote controller ECU 10, 5101, 5111, 5112, and 5113 in FIG. 18 second individual electric power supply off unit: remote controller ECU 10, 5121 to 5123 in FIG. 20 second individual electric power supply on unit: remote controller ECU 10, 5121, 5122, and 5124 in FIG. 20 operation judgment unit: remote controller ECU 10, 5101, 5102, and S106 to 5108 in FIG. 15 display unit: lamp 83

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application Nos. 2009-87084, 2009-90386 and 2010-66645 filed in the Japan Patent Office on Mar. 31, 2009, Apr. 2, 2009 and Mar. 23, 2010, respectively, and the entire disclosures of the applications are incorporated herein by reference.

What is claimed is:

1. A marine vessel propulsion system comprising:

a plurality of propulsion devices, each including a motor and a propeller arranged to be rotated by the motor;

a common electric power supply switch arranged to be operated by an operator to turn on and off electric power supplies of the plurality of propulsion devices all at once;

an electric power supply control unit arranged to put the electric power supplies of the respective propulsion devices in an on state all at once when the common electric power supply switch is turned on and to put the electric power supplies of the respective propulsion devices in an off state all at once when the common electric power supply switch is turned off;

an abnormal state detection unit arranged to detect an abnormal state of each propulsion device; and a power transmission cutoff unit which is arranged to, when an abnormal state of any of the propulsion devices is detected by the abnormal state detection unit, cut off transmission of power between the motor and the propeller of the propulsion device for which the abnormal state is detected.

2. The marine vessel propulsion system according to claim 1, wherein the abnormal state detection unit includes an entrained rotation detection unit arranged to detect rotation of a driving shaft of the motor due to entrained rotation as an abnormal state of the propulsion device that includes the motor.

3. The marine vessel propulsion system according to claim 2, wherein the entrained rotation detection unit is arranged to detect that the driving shaft of the motor is rotating due to entrained rotation when, from a state where the motor is stopped, the driving shaft of the motor rotates with a starting device of the motor not being driven or when, after starting a stopping process on the motor that is in a running state, the rotation of the driving shaft of the motor does not stop within a predetermined time.

4. The marine vessel propulsion system according to claim 1, further comprising a notification unit arranged to notify the cutting off of transmission of power between the motor and the propeller of a propulsion device for which an abnormal state is detected when the power transmission cutoff unit cuts off the transmission of power between the motor and the propeller of the propulsion device.

5. The marine vessel propulsion system according to claim 1, wherein each of the propulsion devices includes a clutch mechanism arranged to be switched between a transmitting state, in which power is transmitted between the motor and the propeller, and a cutoff state, in which the transmission of power between the motor and the propeller is cut off;

the marine vessel propulsion system further comprising a clutch state selection operation unit arranged to be operated by an operator to select states of the clutch mechanisms in the plurality of propulsion devices; wherein the power transmission cutoff unit is arranged such that when the transmission of power between the motor and the propeller of a propulsion device for which an abnormal state is detected is cut off, the cutoff state is maintained until a selection operation to put the state of the clutch mechanism of the propulsion device in the cutoff state is performed by the clutch state selection operation unit.

6. The marine vessel propulsion system according to claim 1, wherein the power transmission cutoff unit is arranged such that when the transmission of power between the motor and the propeller of a propulsion device for which an abnormal state is detected is cut off, the cutoff state is maintained until the motors of all propulsion devices are stopped.

7. The marine vessel propulsion system according to claim 1, further comprising a speed detection unit arranged to detect a speed of the marine vessel, wherein the power transmission cutoff unit is arranged such that when the transmission of power between the motor and the propeller of a propulsion device for which an abnormal state is detected is cut off, the cutoff state is maintained until the speed of the marine vessel detected by the speed detection unit becomes no more than a predetermined threshold value.

8. The marine vessel propulsion system according to claim 1, wherein each of the propulsion devices includes a clutch mechanism arranged to be switched between a transmitting state, in which power is transmitted between the motor and the propeller, and a cutoff state, in which the transmission of power between the motor and the propeller is cut off, the marine vessel propulsion system further comprising a clutch state selection operation unit arranged to be operated by an operator to select states of the clutch mechanisms in the plurality of propulsion devices;

the clutch state selection operation unit including a fewer number of operational elements than a total number of the plurality of propulsion devices; and the marine vessel propulsion system further comprising an association changing unit which is arranged to, when there is a propulsion device that has the transmission of power between the motor and the propeller cut off by the power transmission cutoff unit, change, in accordance with a location of the propulsion device, an association of the respective propulsion devices and the operation elements.

9. The marine vessel propulsion system according to claim 1, further comprising a unit arranged to control a propulsion device, for which an abnormality is detected, such that the motor of the propulsion device is put in a driving-stopped state at a same time or after the transmission of power between the motor and the propeller of the propulsion device is cut off by the power transmission cutoff unit.

10. The marine vessel propulsion system according to claim 1, wherein each of the propulsion devices includes a clutch mechanism arranged to be switched between a transmitting state, in which power is transmitted between the motor and the propeller, and a cutoff state, in which the transmission of power between the motor and the propeller is cut off;

the marine vessel propulsion system further comprising a stopped state detection unit arranged to detect stopped states of the motors of the respective propulsion devices;

a clutch state detection unit arranged to detect, when the stopped state detection unit detects the stopped state of the motor of any of the propulsion devices, the transmitting state of the clutch mechanism in the propulsion device for which the stopped state of the motor is detected; and an ignition and injection control unit arranged to cut, when the clutch state detection unit detects the transmitting state of the clutch mechanism in the propulsion device for which the stopped state of the motor is detected, an ignition and an injection of the motor.

11. The marine vessel propulsion system according to claim 10, wherein the power transmission cutoff unit is arranged to cut off the transmission of power between the motor and the propeller of a propulsion device for which the stopped state of the motor is detected even when the clutch state detection unit detects that the clutch mechanism in the propulsion device for which the stopped state of the motor is detected is in the transmitting state.

12. The marine vessel propulsion system according to claim 10, wherein the ignition and injection control unit is arranged such that after cutting the ignition and the injection, the cutting of the ignition and the injection is maintained until the common electric power supply switch is turned off.

13. The marine vessel propulsion system according to claim 10, further comprising start switches arranged to be operated by an operator to start the motors of the respective propulsion devices, wherein the ignition and injection control unit is arranged such that after cutting the ignition and the injection, the cutting of the ignition and the injection is maintained until the start switch corresponding to the propulsion device for which the stopped state of the motor is detected is operated.

14. A marine vessel propulsion system comprising:

a plurality of propulsion devices, each including a motor, a propeller arranged to be rotated by the motor, and a clutch mechanism arranged to be switched between a transmitting state, in which power is transmitted between the motor and the propeller, and a cutoff state, in which the transmission of power between the motor and the propeller is cut off;

a common electric power supply switch arranged to be operated by an operator to turn on and off electric power supplies of the plurality of propulsion devices all at once;

an electric power supply control unit arranged to put the electric power supplies of the respective propulsion devices in an on state all at once when the common electric power supply switch is turned on and to put the electric power supplies of the respective propulsion devices in an off state all at once when the common electric power supply switch is turned off;

a stopped state detection unit arranged to detect stopped states of the motors of the respective propulsion devices;

a clutch state detection unit arranged to detect, when the stopped state detection unit detects the stopped state of the motor of any of the propulsion devices, a transmitting state of the clutch mechanism in the propulsion device for which the stopped state of the motor is detected;

an ignition and injection control unit arranged to cut, when the clutch state detection unit detects the transmitting state of the clutch mechanism in the propulsion device for which the stopped state of the motor is detected, an ignition and an injection of the motor; and a power transmission cutoff unit arranged to cut off the transmission of power between the motor and the propeller of a propulsion device for which the stopped state of the motor is detected when the clutch state detection unit detects that the clutch mechanism in the propulsion device for which the stopped state of the motor is detected is in the transmitting state.

15. The marine vessel propulsion system according to claim 14, wherein the ignition and injection control unit is arranged such that after cutting the ignition and the injection, the cutting of the ignition and the injection is maintained until the common electric power supply switch is turned off.

16. The marine vessel propulsion system according to claim 14, further comprising start switches arranged to be operated by an operator to start the motors of the respective propulsion devices, wherein the ignition and injection control unit is arranged such that after cutting the ignition and the injection, the cutting of the ignition and the injection is maintained until the start switch corresponding to the propulsion device for which the stopped state of the motor is detected is operated.

17. A marine vessel comprising:

a hull; and the marine vessel propulsion system according to claim 1 installed in the hull.

18. A marine vessel comprising:

a hull; and the marine vessel propulsion system according to claim 14 installed in the hull.

19. A marine vessel propulsion system comprising:

a plurality of propulsion devices, each including a motor, a propeller arranged to be rotated by the motor, and a clutch mechanism that is arranged to be switched between a transmitting state, in which power is transmitted between the motor and the propeller, and a cutoff state, in which the transmission of power between the motor and the propeller is cut off;

a common electric power supply switch arranged to be operated by an operator to turn on and off electric power supplies of the plurality of propulsion devices all at once;

an electric power supply control unit arranged to put the electric power supplies of the respective propulsion devices in an on state all at once when the common electric power supply switch is turned on and to put the electric power supplies of the respective propulsion devices in an off state all at once when the common electric power supply switch is turned off;

a stopped state detection unit arranged to detect stopped states of the motors of the respective propulsion devices;

a clutch state detection unit arranged to detect, when the stopped state detection unit detects the stopped state of the motor of any of the propulsion devices, the transmitting state of the clutch mechanism in the propulsion device for which the stopped state of the motor is detected; and an ignition and injection control unit arranged to cut, when the clutch state detection unit detects the transmitting state of the clutch mechanism in the propulsion device for which the stopped state of the motor is detected, an ignition and an injection of the propulsion device.

20. The marine vessel propulsion system according to claim 19, wherein the ignition and injection control unit is arranged such that after cutting the ignition and the injection, the cutting of the ignition and the injection is maintained until the common electric power supply switch is turned off.

21. The marine vessel propulsion system according to claim 19, further comprising start switches arranged to be operated by an operator to start the motors of the respective propulsion devices, wherein the ignition and injection control unit is arranged such that after cutting the ignition and the injection, the cutting of the ignition and the injection is maintained until the start switch corresponding to the propulsion device for which the stopped state of the motor is detected is operated.

22. A marine vessel comprising:

a hull; and the marine vessel propulsion system according to claim 19 installed in the hull.

23. A marine vessel propulsion system comprising:

a plurality of propulsion devices, each including a motor and a motor control unit;

a common electric power supply switch arranged to be operated by an operator to turn on and off the plurality of propulsion devices all at once;

a plurality of electric power supply off command input units arranged to be operated by an operator to turn off electric power supplies of the respective propulsion devices individually; and an electric power supply control unit arranged to perform on/off control of the electric power supplies of the respective propulsion devices based on inputs from the common electric power supply switch and the respective electric power supply off command input units;

the electric power supply control unit including an all electric power supply on unit arranged to turn on the electric power supplies of the respective propulsion devices all at once when the common electric power supply switch is turned on;

an all electric power supply off unit arranged to turn off the electric power supplies of the respective propulsion devices all at once when the common electric power supply switch is turned off; and a first individual electric power supply off unit, which is arranged to, when the electric power supply off command is input by any of the electric power supply off command input units with the common electric power supply switch being in the on state, individually turn off the electric power supply of the propulsion device corresponding to the electric power supply off command input unit.

24. The marine vessel propulsion system according to claim 23, further comprising a plurality of start/stop switches arranged to be operated by an operator to start and stop the motors of the respective propulsion devices individually, and an operation judgment unit arranged to judge an operation of each start/stop switch as being a first operation of inputting a start/stop command or a second operation that is a specific operation differing from the first operation and is to input an electric power supply off command, wherein the plurality of start/stop switches are arranged to define in common the plurality of electric power supply command input units, and the first individual electric power supply off unit is arranged to respond to the judgment made by the operation judgment unit that the second operation is performed.

25. The marine vessel propulsion system according to claim 24, wherein the first operation of each start/stop switch is a pressing operation of the start/stop switch for less than a predetermined amount of time, and the second operation of each start/stop switch is a pressing operation of the start/stop switch for not less than the predetermined amount of time.

26. The marine vessel propulsion system according to claim 24, wherein the electric power supply control unit further includes a first individual electric power supply on unit, which is arranged to, when the start/stop switch, corresponding to a propulsion device having its electric power supply in the off state, is operated with the common electric power supply switch being in the on state, turn on the electric power supply of the propulsion device individually.

27. The marine vessel propulsion system according to claim 23, further comprising a plurality of individual electric power supply switches arranged to be operated by an operator to turn on and off the electric power supplies of the respective propulsion devices individually, the electric power supply control unit further including a second individual electric power supply on unit, which is arranged to, when an on operation of any of the individual electric power supply switches is performed, put the electric power supply of the propulsion device corresponding to the individual electric power supply switch in the on state individually, and a second individual electric power supply off unit, which is arranged to, when an off operation of any of the individual electric power supply switches is performed, put the electric power supply of the propulsion device corresponding to the individual electric power supply switch in the off state individually.

28. The marine vessel propulsion system according to claim 23, further comprising a display unit arranged to display on/off states of the electric power supplies of the respective propulsion devices.

29. A marine vessel comprising:

a hull; and the marine vessel propulsion system according to claim 23 installed in the hull.

* * * * *